US008017858B2

(12) United States Patent
Mann

(10) Patent No.: US 8,017,858 B2
(45) Date of Patent: Sep. 13, 2011

(54) ACOUSTIC, HYPERACOUSTIC, OR ELECTRICALLY AMPLIFIED HYDRAULOPHONES OR MULTIMEDIA INTERFACES

(76) Inventor: Steve Mann, West Toronto (CA)

( * ) Notice: Subject to any disclaimer, the term of this patent is extended or adjusted under 35 U.S.C. 154(b) by 0 days.

(21) Appl. No.: 12/479,767

(22) Filed: Jun. 6, 2009

(65) Prior Publication Data

US 2009/0241753 A1 Oct. 1, 2009

Related U.S. Application Data

(60) Provisional application No. 61/059,481, filed on Jun. 6, 2008.

(51) Int. Cl.
*G10H 1/18* (2006.01)

(52) U.S. Cl. ..... 84/742; 84/1

(58) Field of Classification Search ..... 84/742; 345/156

See application file for complete search history.

(56) References Cited

U.S. PATENT DOCUMENTS

| | | | | |
|---|---|---|---|---|
| 3,261,200 | A * | 7/1966 | Vinton | 73/40.5 A |
| 4,320,665 | A * | 3/1982 | Cain | 73/861.04 |
| 4,435,974 | A * | 3/1984 | Fuchs et al. | 73/40.5 A |
| 5,194,048 | A * | 3/1993 | Briggs | 472/128 |
| 5,987,990 | A * | 11/1999 | Worthington et al. | 73/592 |
| 6,427,927 | B1 * | 8/2002 | Hall | 239/17 |
| 6,453,247 | B1 * | 9/2002 | Hunaidi | 702/51 |
| 6,561,032 | B1 * | 5/2003 | Hunaidi | 73/597 |
| 6,647,359 | B1 * | 11/2003 | Verplank et al. | 703/2 |
| 6,702,687 | B1 * | 3/2004 | Henry | 472/128 |
| 7,119,270 | B2 * | 10/2006 | Delaporte | 84/745 |
| 7,179,173 | B2 * | 2/2007 | Henry et al. | 472/128 |
| 7,504,577 | B2 * | 3/2009 | Riopelle | 84/723 |
| 7,551,161 | B2 * | 6/2009 | Mann et al. | 345/156 |
| 7,623,976 | B2 * | 11/2009 | Gysling et al. | 702/47 |
| 2005/0007877 | A1 * | 1/2005 | Martin et al. | 367/82 |
| 2006/0144213 | A1 * | 7/2006 | Mann | 84/724 |
| 2006/0283251 | A1 * | 12/2006 | Hunaidi et al. | 73/597 |
| 2007/0093306 | A1 * | 4/2007 | Magee et al. | 472/128 |
| 2008/0250914 | A1 * | 10/2008 | Reinhart et al. | 84/645 |
| 2009/0223345 | A1 * | 9/2009 | Mann | 84/384 |
| 2009/0241753 | A1 * | 10/2009 | Mann | 84/384 |
| 2009/0288545 | A1 * | 11/2009 | Mann | 84/484 |
| 2010/0050849 | A1 * | 3/2010 | Reynolds | 84/173 |

OTHER PUBLICATIONS

"Natural interfaces for musical expression: Physiphones and a physics-based organology", by S. Mann, in Proceedings of the 7th international conference on New interfaces for musical expression, Jun. 6, 2007, New York), viewed at http://www.eyetap.org/papers/docs/mann_physiphones.pdf on Jun. 15, 2010.*

"flUId streams: fountains that are keyboards with nozzle spray as keys that give rich tactile feedback and are more expressive and . . . ", by S. Mann, in Association of Computing Machinery (ACM), Proceedings of the 13th annual ACM international conference on Multimedia, 2005, Singapore, at http://wearcam.org/acmmm2005funtain.pdf viewed Jun. 16, 2010.*

* cited by examiner

*Primary Examiner* — Elvin G Enad
*Assistant Examiner* — Robert W Horn
(74) *Attorney, Agent, or Firm* — Michael Ries

(57) ABSTRACT

An instrument in which an acoustic or otherwise measurable disturbance or change is made in physical matter is disclosed. In one embodiment an oscillatory vortex shedding phenomenon is formed in water, in association with each of a plurality of finger holes. Water flows past a branch point where it can either flow over a labium, edge or the like in a resonant pipe, or out a finger hole, the finger hole being the path of lesser resistance to the water. Obstruction of the finger hole forces the water past an underwater sound production mechanism. Blocking water from coming out of a given hole produces a given note, which, in some embodiments, is electrically amplified by a hydrophone. In one embodiment there is a further processing of each hydrophone signal. Embodiments with various kinds of acoustic or optical pickups are also disclosed.

13 Claims, 28 Drawing Sheets

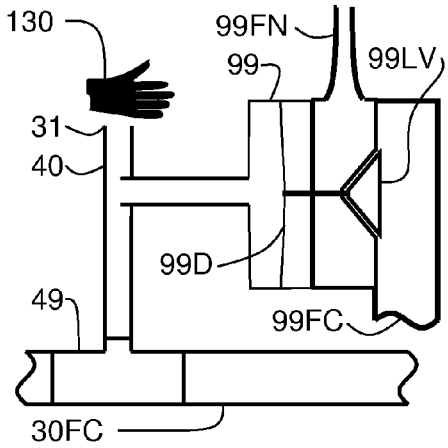
Fig. 1J
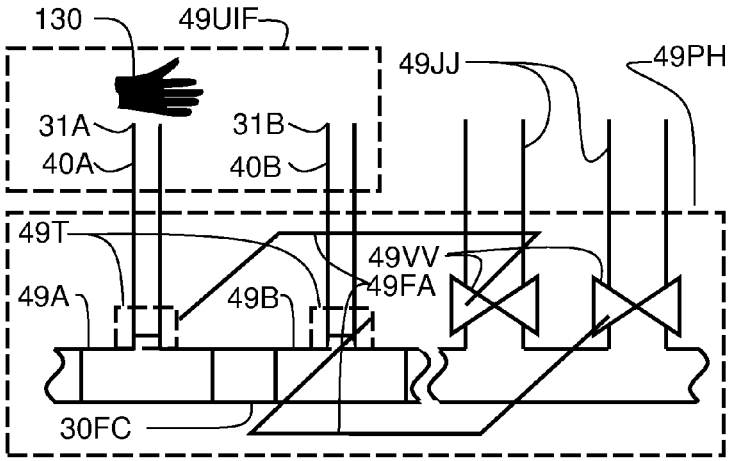

ACOUSTIC, HYPERACOUSTIC, OR ELECTRICALLY AMPLIFIED HYDRAULOPHONES OR MULTIMEDIA INTERFACES

This patent application claims the benefit of U.S. Provisional application Ser. No. 61/059,481 filed on 2008 Jun. 6, the disclosure of which is incorporated herein by reference in its entirety.

FIELD OF THE INVENTION

The present invention pertains generally to a new kind of acoustic musical instrument or input/output device that may be used to control a musical instrument, or other multimedia system or events.

BACKGROUND OF THE INVENTION

Existing musical instruments are divided into three categories: strings, percussion, and wind. Strings are essentially one dimensional solids (i.e. they are long and thin, having a relatively small cross section). Percussion is typically a two-dimensional (i.e. flat and relatively thin) or three-dimensional (bulk) solid. Wind instruments run on matter in its gaseous state.

More generally, various researchers have categorized all known musical instruments into five categories: idiophones, membranophones, chordophones, aerophones, and electrophones. This categorization scheme was devised to categorize all possible musical instruments either known or to be made in the future. This system originated thousands of years ago, was adopted by Victor-Charles Mahillon, and then further refined by Hornbostel and Sachs, and is often referred to as the Hornbostel Sachs Musical Instrument Classification Scheme.

The first three categories refer to solid matter, in three, two, and one dimension, i.e. idiophones make sound from bulk (3*d*) solid matter. Membranophones make sound from membranes (flat thin, essentially 2 dimensional solid matter). Chordophones make sound from stings which are essentially one dimensional solid matter.

Instruments like the piano problematize the "strings-percussion-wind" taxonomy because the piano is both a string instrument and a percussion instrument. This has led other experts such as Andre Schaeffner to classify acoustic instruments into two large categories: solid and gas. The first category, category "I", makes sound by matter in its solid state. The second category, category II, makes sound by matter in its gaseous state.

Musical instruments can also be electrically amplified, and remain in the same category despite this amplification.

Additionally, a category of electrophones refers to instruments in which the sound does not originate from the material world, and is instead originated electrically.

Another state-of-matter, namely liquid, has been found relevance in musical instruments. For example, the ancient Greeks and Romans used water as a supply of power, in order to blow air into organ pipes. These ancient instruments like the "water organ" or "hydraulis" used water as a power source, or as a means to store energy, which was then used to push wind through organ pipes.

In a similar way, modern church organs are examples of water organs because they use hydroelectricity (electricity that is generated by a waterfall) as a source of power to run the electric motor that powers the blower, which blows the wind (air) into the pipes to make the sound.

Sounds can also be produced underwater. For example, municipal swimming baths, various public and private pools, and the like, often have underwater loudspeakers so that music can be played for people to hear underwater. This also facilitates safety, so that announcements over the Public Address (PA) system can be heard underwater.

Some animals such as dolphins and porpoises can make sounds underwater. They do this by having air pockets in which they make sound in air, which then is audible underwater.

SUMMARY OF THE INVENTION

The following briefly describes my new invention.

It is possible with this invention for an aquatic play feature or fountain to be a musical instrument, much like a flute, but that runs on water rather than air. This invention creates a new category of musical instrument, not envisioned previously.

It is possible with this invention to provide a combination of water therapy and music therapy which has clinical use in hospitals and retirement homes for persons suffering from arthritis, and the like.

It is possible with this invention to provide a form of aquatic play as "sophisticated frolic" that appeals to persons of all ages, not just children.

It is possible with this invention to construct a musical instrument that functions like a woodwind instrument but that can be played entirely underwater without any air used in the sound production or sound conveyance, especially if the listeners are also underwater with water in the ear canal and with sound conveyed directly by bone conduction, such that air plays little or no role in the sound production, transfer, or experience.

It is possible with this invention to make a new kind of woodwind instrument in which multiple notes can be played at the same time, and in which the pitch, volume, timbre, and the like, of each note can be changed independently of the other notes, by changes in the fingering.

It is possible with this invention to make a new kind of woodwater instrument in which multiple notes can be played at the same time, and in which the pitch, volume, timbre, and the like, of each note can be changed independently of the other notes, by changes in the fingering.

It is possible with this invention to make a reustophone (fluid-sound-instrument) in which the fluid can be either air or water.

It is possible with this invention to make a variety of reed-based or reedless musical instruments that can take the form and size ranging from large public fountains, down to small bath tub toys.

It is possible with this invention to make a foot-activated fluid instrument played by stomping on foot holes, to obstruct fluid coming out of ground nozzles or the like.

It is possible with this invention to provide a fluidly continuous musical interface that generates or controls sound or other multimedia quantities in a highly expressive and intricate way.

It is possible with this invention to make a general-purpose multimedia input device that can be used to type email messages, generate multimedia events, trigger multimedia events, or modify in a fluidly continuous way, multimedia events.

It is possible with this invention to provide a more "fluid" as well as a more continuous and "immersive" multimedia input device with input elements that a user can feel.

It is possible with this invention to play in a fountain as a form of interactive multimedia to control other fountains, or the like.

It is possible with this invention that the fluid can be optically and visually engaging, as well as tactile, and for the sensing to be acoustic, subsonic, ultrasonic, or optical.

It is possible with this invention to make an acoustic musical instrument that uses natural acoustic phenomenena such that the instrument is not an electrophone, yet such that it can be interfaced to computers and used to continuously modify musical instrument data control streams.

It is possible with this invention to make a musical instrument in which sound production is not directly by matter, and not directly electrophonic, such that it defines new categories beyond the material or electrically-informatic classifications.

It is possible with this invention to straddle multiple classifications, e.g. to make a musical instrument that can operate in any of the four states-of-matter as well as operate informatically.

It is possible with this invention to make a musical instrument or essentially continuously varying user interface that can use a variety of states-of-matter, such as, for example, a solid control surface or surfaces in a continuous way as an acoustic user interface, or by way of similar continuous physical phenomena.

It is possible with this invention to make a physiphone that uses an actual physical process to generate sound or hyperacoustic sound, or input.

It is possible with this invention to make a musical instrument or input device that uses one or more plasma sources as a user-interface.

The following provides an informal review/summary of my new invention.

Whereas previous musical instruments use solid or gas or informatics (e.g. electrophones) as the sound source, and user interface, the invention makes possible new forms of sound production and/or user-interface possibilities.

For example, one aspect of the invention allows an aquatic play device, fountain, pipe, hot tub, or the like to be equipped with a row of holes from which water emerges to form a row of water jets. Inside the device, there is an alternate way for water to enter a sound production mechanism associated with each finger hole. Blocking water from coming out of one of the holes forces it into the sound-production mechanism. Each water jet can have a separate sound-production mechanism associated with it, each sound-production mechanism being such that when it begins vibrating, it vibrates at a different frequency. Blocking the first water jet sets the instrument vibrating at, for example, 220 vibrations per second, corresponding to the note "A". Blocking the second jet sends water into the second sound-producer, which causes vibration at the note "B". Blocking the third jet sends water into the third note sounder for "C", fourth jet for "D" and so on. A whistle, fipple, or similar mechanism that works underwater is described, together with an arrangement whereby each whistle or other mechanism is arranged so as to respond to water diverted from one of the jets when it is blocked.

In another embodiment, a hydrophone (or underwater microphone) listens to the sound made by the sound-producing mechanisms. The output of the hydrophone is connected to a computer system that analyzes the sound and takes various actions in response to the sound. For example, when the computer "hears" an "A", it can print the letter "A" onto the screen of the computer. In this way, a 26-note instrument can be used for typing all the letters "A" through "Z".

In another aspect of the invention, a building monitoring system consists of the installation of sound-producers into plumbing fixtures while the sounds are monitored, and a method of building monitoring includes optimization of the sound-producers which can operate outside the audio range so as not to annoy users, but which can be re-mapped into the audio range for diagnostics, so for example, maintenance staff can hear the sounds of the sound-producers being frequency-shifted into audible frequencies and thus understand, for example, how a particular toilet or faucet or other fixture is working.

In another aspect of the invention, a user-interface and building monitoring system uses one or more radially symmetric flushometer diaphragms designed to oscillate at a specific frequency or to provide a specific sound signature, so as to oscillate each time a toilet associated with the flushometer is flushed, the unique sound signature sounding a note that's audible further upstream in a water supply.

In another aspect of the invention a separate hydrophone is used to pick up the sound made by each sound-producing mechanism. This allows, for example, separate signal processing for each note, or separate amplification for each note so that the sounds can be distributed throughout a waterpark or public art installation.

In another aspect of the invention the hydrophone's listening port forms a whistle, with the hydrophone made of a glass or ceramic membrane located at the end of an underwater whistle pipe.

In another aspect of the invention, manufacturing costs are reduced by making all the notes in an instrument be the same note, for example, "A", and, with a separate hydrophone for each note, a separate post-processing circuit frequency-shifts each note to a desired position on a musical scale.

In another aspect of the invention, the sound produced by the water is principally subsonic, in the form of increases in pressure against a glass or ceramic hydrophonic plate, wherein the output of each of separate hydrophones for each note, goes to a separate frequency up-converter to bring each note up to the desired position on a musical scale.

In another aspect of the invention, notes are changed by changing the changing the angle of a whistle pipe with respect to a stream of water, so that each whistle can be made using the same manufacturing process, to reduce costs, but the whistle mechanisms can be tilted at different angles to tune the instrument and thus eliminate the need for a frequency conversion system.

In another aspect of the invention, each finger hole of the instrument leads directly to a column of fluid, such that pressing the finger deeper into the finger hole shortens the column and increases the resonant frequency of each note, thus allowing greater musical expressivity.

In another aspect of the invention, a fluid amplifier such as a water switch, is equipped with a geophone or hydrophone or other listening device, on the side discharge of the water switch, such that the listening device is responsive to blockage of the main output of the water switch.

In another aspect of the invention, a musical instrument with a fluid amplifier is provided for a light-touch wholly acoustic instrument in which it is possible to have different fluids for the user-interface and sound-producing sections if desired.

In another aspect of the invention, a linear array of bowls of varying size each function as a ripple tank to make a different note on a musical scale. An pickup such as an acoustic or optical pickup feeds to an audio amplifier.

In another aspect of the invention, an array of bowls of the same size each function as a ripple tank, and a separate pickup such as an acoustic or optical pickup feeds to a separate frequency-shifter to shift the sound into a desired position on a musical scale.

In another aspect of the invention, an array of physical objects are each equipped with a pickup, each pickup feeding a frequency-shifter or filter that positions the sound from each one in a desired position on a musical scale.

In another aspect of the invention, an array of plasma vessels are each equipped with a pickup, each pickup feeding a frequency-shifter or filter that positions the sound from each one in a desired position on a musical scale.

In another aspect of the invention, a plasma vessel is equipped with an electrical or optical pickup to generate sound in response to a user touching the plasma vessel or bringing a body part close to the plasma vessel.

Some embodiments of the invention are entirely acoustic. Other embodiments are merely user-interface devices. Many preferred embodiments use acoustically-generated sounds as input to effects such as computerized processor or the like, in such a way that the overall instrument is not an electronic instrument but is more akin to an electric guitar or other acoustically-originated instrument.

On some instruments the only user-interface is a single water jet, and all of the notes come from that one interface. These single-jet hydraulophones are referred to as "water bugles", since, as with the wind bugle where controlling the pitch of the instrument is performed through the player's embouchure, there is no means for pitch control other than the water-mouth of the instrument.

Pitch control on the water bugle is done through the intricate shaping of the player's fingers and hand muscles interacting with the single jet at the mouth of the instrument.

On professional hydraulophones for concert performance, the water jets are often arranged like the keys on a piano, and the instrument is played by pressing down on one or more of the water jets, one for each tone of a diatonic or chromatic scale. In some embodiments there is one acoustic sounding mechanism inside the instrument for each water jet. Whenever a finger blocks the water flow from a jet, the water is diverted into the sounding mechanism for that jet.

A preferred embodiment of the hydraulophone consists of a housing that has at least one hole in it, through which water emerges. The hole and the water coming out of it comprise a user interface, and by placing one's fingers on or near the hole, one can intricately manipulate the water flow to cause the instrument to sound, and to expressively vary the dynamics, timbre, and pitch of each note. Inside the instrument, upstream of the water outlet, there is a special fipple mechanism, reed, or other sound-producing mechanism for each water jet that is intricately responsive to changes in flow rate, pressure, and the like.

Besides the normal way of playing music on a hydraulophone, the instrument's water jets can be used simply as a user-interface and controller for other multimedia devices.

Multiple hydraulophones can be arranged in a two dimensional array, or in a row, to control multiple multimedia events. For example, 88 hydraulophone mechanisms can be arranged in a piano-style layout and used to control a real acoustic player-piano so that people in a swimming pool or hot tub can remotely play the piano without having to worry about splashing water on it with their wet hands.

(It is also a lot of fun to play music while playing in a fountain, and running one's fingers over the water jets is soothing i.e. the invention can be used to combine music therapy with water therapy in retirement homes, or for use by special needs children, and the like.)

With appropriate microphone (hydrophone) pickups and conversion circuitry, computer outputs can be provided. However, merely triggering MIDI notes with water jets merely uses the hydraulophone as a user-interface. We desire, instead, to make a musical instrument that is more than merely a user-interface.

Alternate embodiments: A number of different embodiments of the hydraulophone have been built, the sounding mechanisms of which can be broadly categorized as either forced (where the sound vibrations are forced at a particular frequency rather than by natural resonance) and unforced (where the sound vibrations occur due to resonance). The forced variety, for example, based on one or more spinning disks, choppers, water modulators, and the like are possible.

I now describe hydraulophone embodiments based on a special kind of underwater microphone (hydrophone) developed specifically for hydraulophone use.

One embodiment is the electric hydraulophone as an instrument with electric pickup comprising one or more underwater microphones (hydrophones) designed and built specifically for use in hydraulophones.

This embodiment of the hydraulophone bears some similarity to an electric guitar, in the sense that it can be an acoustic instrument that uses electric processing, filtering, and amplification to increase the range of sounds but maintain a high degree of expressivity and intricacy of musical expression. As with electric guitar, it can be used with numerous effects pedals, computerized effects, guitar synths, hyper instruments, and the like, while remaining very expressive. Particularly when playing the electric hydraulophone underwater, at high sound levels, as with an electric guitar, feedback can be used creatively, to get long or infinite sustain in a way that is similar to the way in which notes can be held for much longer on an electric guitar than is possible with an acoustic guitar. Some of our electric hydraulophones have one or more active "hydrospeakers" (transmit hydrophones, i.e. speakers designed for use underwater) built in, in addition to the "receive hydrophones" (underwater microphones) of the pickup. In much of the literature, the term "hydrophone" means a transducer that can send and receive, whereas similar transducers in air are described by the words "microphone" or "speaker" for receive and transmit, respectively. I prefer to use the term "hydrophone" to denote underwater listening transducers, and "hydrospeaker" to denote underwater sound-producing transducers, in order to disambiguate in applications where the device only sends or only receives.

The underwater hydraulophone with acoustic pickup also for creative use of acoustic feedback, and various interesting forms of interaction with sounds produced in the water, especially if one or more hydrospeakers ("transmit hydrophones") are installed inside the instrument.

Underwater oscillations due to vortex shedding and turbulence: Fluid flow creates an exciting range of acoustic possibilities, especially with water, which has unique turbulence and vortex shedding properties as compared with the air of ordinary woodwind instruments.

Wake produced by an obstacle in water flow gives rise to well-known effects, such as the Von Karman Vortex Street The Karman Vortex Street is a series of oscillatory eddies created underwater, close to a cylindrical obstruction. Various instabilities occur in water flow, giving rise to oscillations and vibrations that are too weak to be useful in an unamplified instrument, but that are used in the invention in amplified instruments. Thus some embodiments of the invention advantageously use water whistling through small openings, and past various structures, to create different kinds of sounds.

For example, a fipple-like whistle-plate and underwater microphone comprises a pickup that is responsive to water flowing past it. In one embodiment each pickup is positioned on the side-discharge of a tee-fitting, so that blocking water from coming out of a particular water jet forces it out the side-discharge of the tee. In a preferred embodiment all the tee fittings are supplied by one manifold. Preferably each tee fitting has, associated with it, a tuning screw.

In some embodiments the output from each microphone is run into a bandpass filter, tuned to the frequency of the note corresponding to that particular water jet.

By cascading a variety of different filterbanks, some embodiments achieve a rich and full sound that is still very expressive, but is easier to play, thus making the instrument suitable for permanent installation in public spaces where visitors can play the hydraulophone without the need for prior practice or special training.

Additionally, to further increase the playability an acoustic exciter, such as one or more hydrospeakers, is placed inside the instrument, causing feedback to occur. When combined with a bank of bandpass filters, this results in a tendency for the instrument to favor playing at or near the center frequency of each bandpass filter. As a result of this feedback, the instrument became a lot easier to play "on key", but still is sufficiently expressive (i.e. there is still sufficient ability to "bend" and sculpt notes).

With the water spray, each note is a time-varying sculpture, in which pitch, timbre, and volume changes manifest themselves as visible changes in the water spray pattern experienced by both the player and his or her audience.

Hydrophone design and placement: In the preferred embodiment, hydrophone design has evolved toward water flowing past glass plates. As with recordings made in air, microphone selection greatly affects the way the sound of acoustic instruments is recorded or amplified. Similarly, the acoustic sounds of the water are greatly affected by these hydrophones. The glass-based hydrophones pickup the water's sounds, and the result is a sound that is very similar to that of Benjamin Franklin's glass harmonica (harmonica), except that with hydraulophone there is a much wider range of expression. For example, with hydraulophone, the pitch of each member of a chord can be individually and independently manipulated, whereas with glass harmonica, the pitch is fixed. Note that the hydraulophone is not a friction idiophone, because the sound actually comes from vibrations that initially form in the water itself, before being picked up by the hydrophones. However, the choice and design of hydrophone pickup affects the sound, i.e. the glass imparts a very nice "glassy" sound that enhances the melancholy and expressive sound made by the water.

The use of glass dictates that in a preferred embodiment the apparatus is built into a rugged stainless steel housing in versions of the instrument installed in public spaces.

Hydrophone placement: There are two main embodiments regarding placement of the receive hydrophones (underwater microphones) inside a hydraulophone flow stream:

1. Cross-flow: water flows sideways past the hydrophone.
2. Fontal-flow: water flows directly to the front of the hydrophone.

Cross flow produces a more gentle and expressive sound, but also provides less gain-before-feedback, so the entire instrument (including the deliberate feedback mechanism) preferably resides in a sound-attenuating enclosure, such as a rigid stainless steel pipe.

Frontal-flow produces a stronger sound, but generates strong DC-offset on the hydrophone as water literally pounds against the front of the hydrophone element. This requires either that the hydrophone element be made much tougher than usual, or that the instrument be placed off limits to non-skilled hydraulists (i.e. the instrument would need to be played only by persons skilled in the art of knowing how to manipulate the water jets without breaking the glass). Frontal-flow also requires that the player not fully obstruct the jet so as not to break the glass, or, in the case of a ruggedized (and therefore less expressive) hydraulophone, full blockage stops or reduces the amount of water flowing past the hydrophone, thus stopping or reducing subtle change in expression. Frontal-flow hydraulophones respond to all of the derivatives (velocity, acceleration, jerk, jounce, etc.) of displacement, as well as to displacement itself, and to the intergral of displacement, which is called "absement".

Logarithmic Superheterodyne Filterbanks: Since the sounds produced by the water can be made to arise from a variety of interesting phenomena, the instrument can be very richly expressive beyond the range of human hearing. Indeed, especially with the frontal-flow hydraulophones, there is a great deal of subsonic components to the sound, as well as supersonic sounds.

In some embodiments, a goal is to bring these subsonic and supersonic sounds into the audible range by way of acoustic processing. In a way similar to (but not the same as) a superheterodyne radio receiver, signals are downshifted and upshifted. In a preferred embodiment this is done logarithmically, rather than linearly, as it pertains to human perception.

In some embodiments much of this frequency-shifting is done using combinations of oscillators and modulators. In particular, a MIDI device is used for the oscillators, and thus some or all of the filterbanks in a hydraulophone installation can be implemented by way of MIDI devices. This is not the manner in which MIDI was designed to be used (i.e. MIDI is usually used for the production of sound rather than for the filtering or modification of already-existing sound), but certain behavior of certain MIDI devices can be exploited to produce the desired effects processing.

Duringtouch: A curious side-effect of using MIDI-compliant oscillators to implement acoustic filterbanks leads to an embodiment I call duringtouch. Duringtouch is the use of MIDI signaling for a smooth, near-continuous processing of audio from a separate microphone, hydrophone, or geophone for each note on an instrument such as a hydraulophone.

Normally MIDI is used to trigger notes using a note-on command, at a particular velocity, perhaps followed by aftertouch (channel aftertouch or polyphonic aftertouch).

In duringtouch, however, the idea is to get a MIDI device to become a sound processing device. With many hydraulophone embodiments, there is no such thing as a note-off command, because all the notes sound for as long as the instrument is running. In preferred embodiments there is a continuous fluidity in which the turbulent flow of water, though each keyboard (jetboard) jet and sounding mechanism, causes each note to sound to some small degree even when no-one is playing the instrument.

When nobody is playing the instrument, it still makes sound from the gurgling of the water, and turbulence, etc. In fact, the gentle "purring" of the instrument is a soothing sound that many people enjoy while sitting in a park eating their lunch.

The enjoyable soothing sound, which is basically the sound of every note playing faintly in the background, is something I call the "compass drone" of the instrument because it makes audible the compass spanned by the instrument.

Preferably all notes are sounding before, during, and after the user touches the water jets (i.e. all the time). The sum of this sound over all notes is called the hydraulophone's "compass drone". Signals from pickups on each note of a hydraulophone can be processed to enhance, reduce, or modify the compass drone. When done via duringtouch, we are left with a computer-modified "duringdrone".

The fact that notes "play" before anyone touches the instrument gives what we might call "beforetouch". Thus, philosophically, the instrument tries to go beyond the idea that a note must come into existence and then be modified by aftertouch.

The concept of duringtouch does not exist within the MIDI standard. As a result, some prototype embodiments work on MIDI devices that can be "hacked", "hijacked" or repurposed into use with hydraulophones. As well, existing MIDI commands can be used to transmit data relevant to the filtering process, but the speed could have benefited if there were MIDI commands specifically for duringtouch that is, messages for smooth variation of MIDI sounds which continuously play (not based on Note on/off) and are smoothly modulated. Presently the most successful use of duringtouch is with the Yamaha PSRE303.

Some embodiments include circuits that downgrade from duringtouch to regular MIDI so that the hydraulophone can be used as a MIDI controller. But then the sound might longer come from the water, because the MIDI is no longer being used as a continuous filter. Thus many of the more preferred embodiments use a "hacked" PSRE303 rather than converting to standard MIDI to ensure that the instrument is operating acoustically (i.e. whereby sound originates in the water) and not merely as a user-interface.

Ideally the bandpass filters of the invention should not necessarily be tuned precisely to one frequency, perfectly "in tune" for each note. In fact it is desirable to have a small but nonzero amount of width in the passband, passed through each filter, because: (1) It allows expressive pitch bending on the instrument. Otherwise, if the player bent a note, the electronic output would abruptly go silent; (2) Width in the filter facilitates a system with a fast response time, owing to the time-bandwidth product (Heisenberg-related uncertainty limit); (3) A slightly wider passband allows more of the expressive sounds made by the water, such as vortex shedding, cavitation, and turbulence, to be heard.

BRIEF DESCRIPTION OF THE DRAWINGS

The invention will now be described in more detail, by way of examples which in no way are meant to limit the scope of the invention, but, rather, these examples will serve to illustrate the invention with reference to the accompanying drawings, in which:

FIG. 1J illustrates an embodiment of the invention that is purely mechanical and purely percussive (producing sound of indefinite pitch).

DETAILED DESCRIPTION OF THE PREFERRED EMBODIMENTS

Figure 1A:
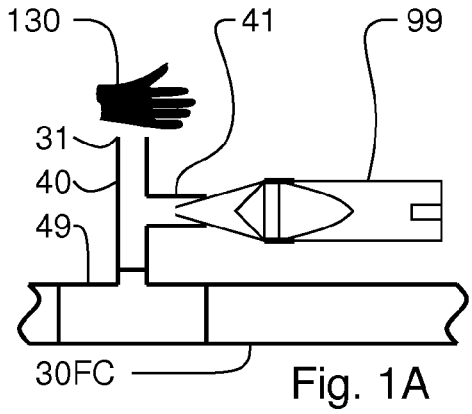
FIG. 1A illustrates a single jet reustophone (or a single jet of a multi-jet reustophone).

While the invention shall now be described with reference to the preferred embodiments shown in the drawings, it should be understood that the intention is not to limit the invention only to the particular embodiments shown but rather to cover all alterations, modifications and equivalent arrangements possible within the scope of appended claims.

In various aspects of the present invention, references to "microphone" can mean any device or collection of devices capable of determining pressure, or changes in pressure, or flow, or changes in flow, in any medium, not just air. Thus a "microphone" in the broad sense may refer to a hydrophone, geophone, ionophone or similar device that converts pressure or pressure changes into electrical signals. Likewise the term "hydrophone" describes any of a variety of pressure transducers that convert changes in hydraulic pressure to electrical signals. Hydrophones may include differential pressure sensors, as well as pressure sensors that measure gauge pressure. Thus hydrophones may have a single "listening" port or dual ports, one on each side of a glass or ceramic plate, stainless steel diaphragm, or the like. The term "hydrophone" may also include pressure sensors that have respond only to discrete changes in pressure, such as a pressure switch which may be regarded as a 1-bit hydrophone. Moreover, the term "hydrophone" can also describe both devices that only respond to changes in pressure or pressure difference, i.e. to devices that cannot convey a static pressure or static pressure differences. More particularly, the term "hydrophone" is used to describe pressure sensors that sense pressure or pressure changes in any frequency range whether or not the frequency range is within the range of human hearing, or subsonic (including all the way down to zero hertz) or ultrasonic. Similarly the term "geophone" is used to describe any transducer that senses or can sense vibrations or pressure or pressure changes in solid matter. Thus the term "geophone" describes contact microphones that work in audible frequency ranges as well as other pressure sensors that work in any frequency range, not just audible frequencies.

The terms "Earth", "Water", "Air" and "Fire" refer to the states-of-matter. For example, the Classical Element indicated by the term "earth" refers to any solid matter. Likewise the term "water" refers to any liquid such as wine, oil, hydraulic fluid, or the like. The term "hydraulic" also refers broadly to any pressurized or pressurizable liquid not just "hydro" (water). The Classical Element of "air" likewise refers to any gas, etc.

FIG. 1A illustrates a single-jet reustophone. The term "reustophone" is the etymologically correct Greek terminology for an instrument that makes sound from fluid. The term "reustophone" can refer to a pneumatophonic aerophone or to a hydraulophone. The word appears in the scientific literature in, for example, "The electric hydraulophone: A hyperacoustic instrument with acoustic feedback" by S. Mann et al., in Proceedings of the International Computer Music Conference (ICMC), Copenhagen, August 2007.

When a user's hand 130 or fingers of the user or other body part such as the foot (e.g. in the case of a foot-operated instrument or the foot division of a hand and foot operated instrument) obstructs fluid jet 31, the fluid is diverted into sounder 99. Sounder 99 is a device that makes sound when water runs through it or is pressed against it.

The fluid may be air or water. A fluid chest 30FC conveys fluid into one or more jet fittings 40 which are (or is) connected to one or more fluid chest fittings 49. Jet fitting 40 has a sounding port 41 to convey fluid to sounder 99.

Figure 1B:
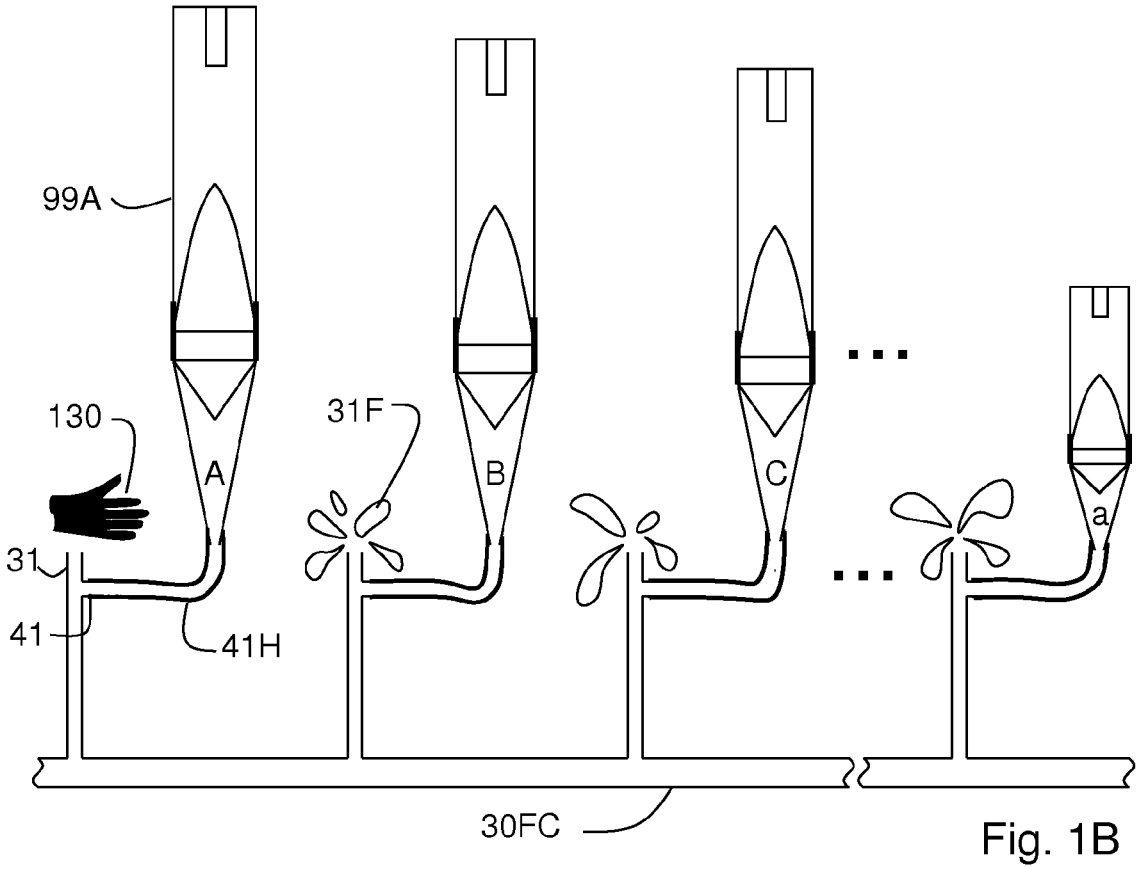
FIG. 1B illustrates the principle of a reustophone having a separate pipe for each jet, with a separate finger hole feeding fluid to each pipe.

FIG. 1B illustrates a multi-jet reustophone. A user's hand 130 may block any of a plurality of fluid jets 31, to direct fluid out any of a plurality of sounding ports 41. Hand 130 may obstruct the fluid 31F in a variety of different ways, in order to get a variety of different sounds out of each sounder. Sounder 99A is the sounder for the note "A" which principally oscillates at the frequency of the note "A" such as 110 vibrations per second or 220 vibrations per second. Each of the plurality of sounders 99 vibrates at a different frequency to make a musical scale, playable by blocking fluid flow coming out of jets 31. A flexible hose 41H may be used to couple to each of the sounders 99 so that the sounders can be optimally arranged. For example, sounders 99 may all be placed in a larger pipe, from which jets 31 emerge. The larger pipe preferably takes on the visual form of a giant flute, playable by blocking the finger holes that match up with jets 31.

If the fluid is water, preferably this outer pipe is filled with water, and sounders 99 are totally submerged in the water. An underwater microphone or preferably a hydrophone can be used to pickup the sound and amplify it.

Optionally a separate hydrophone may be positioned to optimally pick up the sound from each sounder 99. A typical arrangement of sounders 99 includes 12 sounders, one for each note of a 12-note scale. To electrically amplify the sound, each hydrophone may be fed to a 12-channel audio mixer, which may be fed to a sound amplification system. The sound amplification system may include speakers located inside the outer pipe to deliberately feedback some sound into the pipe, and increase the resonance of each note.

Figure 1C:
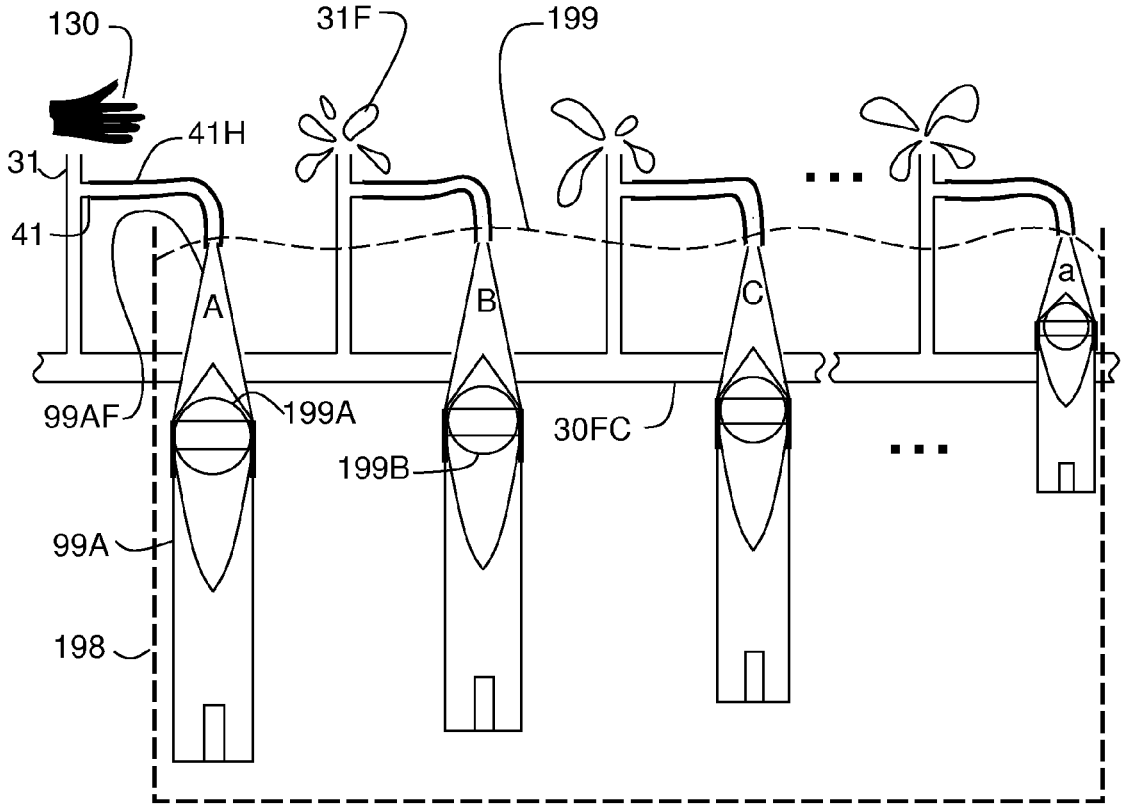
FIG. 1C illustrates an H2Organ (TM) underwater pipe organ with the pipes oriented so that their feet (water inlets) are all at the same depth underwater.

FIG. 1C illustrates an H2Organ™ underwater pipe organ in which sounder 99A is a pipe in a water tank 198, filled with water 199. The tank can be a sealed unit or it can be an open unit such as a clear glass or acrylic aquarium. Alternatively the sounders such as sounder 99A can be installed in an aquarium at an attraction such as a dolphin show space, and a console to operate the sounders can be remote so that people can make underwater sounds to interact with dolphins or other aquatic organisms in the tank 198.

In a pipe organ, the part of the pipe that air flows into is called the "foot". In a traditional pipe organ, each pipe has a foot that rests on a flat surface, and the foot is the lowest part of the pipe.

In the embodiment of FIG. 1C, the pipes are oriented in the opposite way as they are in a standard pipe organ, i.e. in FIG. 1C they are oriented with the feet all facing up, and with the feet all at approximately the same height.

A plurality of sounders such as sounder 99A, etc., have feet, such as foot 99AF on sounder 99A, arranged so that all the feet are approximately the same depth in the tank 198, and therefore each experiences approximately the same pressure or "water column" as measured at the points of user-interface such as jets 31.

In a pipe organ that runs on air this would not matter much since the air pressure at the top of the pipe is approximately the same as at the bottom. However, with the water organ of FIG. 1C, there is considerable difference in pressure or head of water column at the top of the pipes compared to the bottom.

The mouths of the pipes as well as the open ends are underwater, and the pipes are filled up with water.

If listening underwater the instrument is nice and loud, but if listening in air there is a poor coupling to air because air has a higher acoustic impedance when using the analogy that force is like current and velocity is like voltage (or lower impedance if using the reverse analogy).

Therefore some kind of pickup 199A is used for the pipe of sounder 99A, and a pickup 199B is used for the pipe of sounder 99B, and so on. Each of these pickups consists of a diaphragm similar to that of a stethoscope, and each diaphragm is coupled to a connecting rod that transfers the acoustic energy to a larger diaphragm outside the tank, in order to transfer the acoustic energy generated by each sounder such as sounder 99A into the surrounding air.

In some embodiments the linkage is a lever assembly, which transfers small yet forceful movement of pickup 199A into larger movements having less force, on the corresponding diaphragm outside the tank.

In other embodiments, a fluidic sound amplification system, such as that disclosed in U.S. Pat. No. 5,540,248, entitled "Fluidic sound amplification system" by inventors Tadeusz M. Drzewiecki et al, is used.

Alternatively, pickups 199A can be electrical pickups such as hydrophones, which then become electrically amplified to a loudspeaker outside the tank 198. Instead of using hydrophones, a lower cost alternative is to use geophones ("contact microphones"), which are ordinarily intended on picking up vibrations in solids. Geophones can work since solids ("earth") and liquids ("water") have similar acoustic impedance. In this case the geophones can consist of piezoelectric pickups potted in a potting compound having an acoustic impedance similar to that of water.

Each pickup can feed a separate speaker to spatialize the sound the same way as if it were experienced underwater. Alternatively, the pickups may be summed together. If this is the case, fewer pickups than the number of sounders may be used. For example, one pickup might listen to two or more sounders.

In some embodiments a separate pickup is used for each sounder so that the pickups can be separately processed by way of a computer having enough input channels that there can be one processing channel for each sounder. This allows more interesting effects.

Also it makes it easy to use the apparatus of FIG. 1C as a general-purpose aquatic control surface, such as, for example, a lighting console, in which lights can be controlled by pressing on water jets.

The embodiment of FIG. 1C may be thought of as being analogous to an upright piano, in the sense that the sounding mechanisms are aligned up-and-down, whereas an embodiment like that of FIG. 1A, when run in a water tank, is like a grand piano, in the sense that the sounding mechanisms are aligned parallel to the floor.

Both embodiments may be used together, i.e. one unit with a flat tank sitting on the floor as a pedal (foot operated) division, and another in an upright position as a manual (hand-operated) division, and of course there is in some embodiments multiple hand-operated units in a multi-tiered arrangement.

The result is an underwater pipe organ that can have a pedal division, and multiple manuals.

Figure 1D:
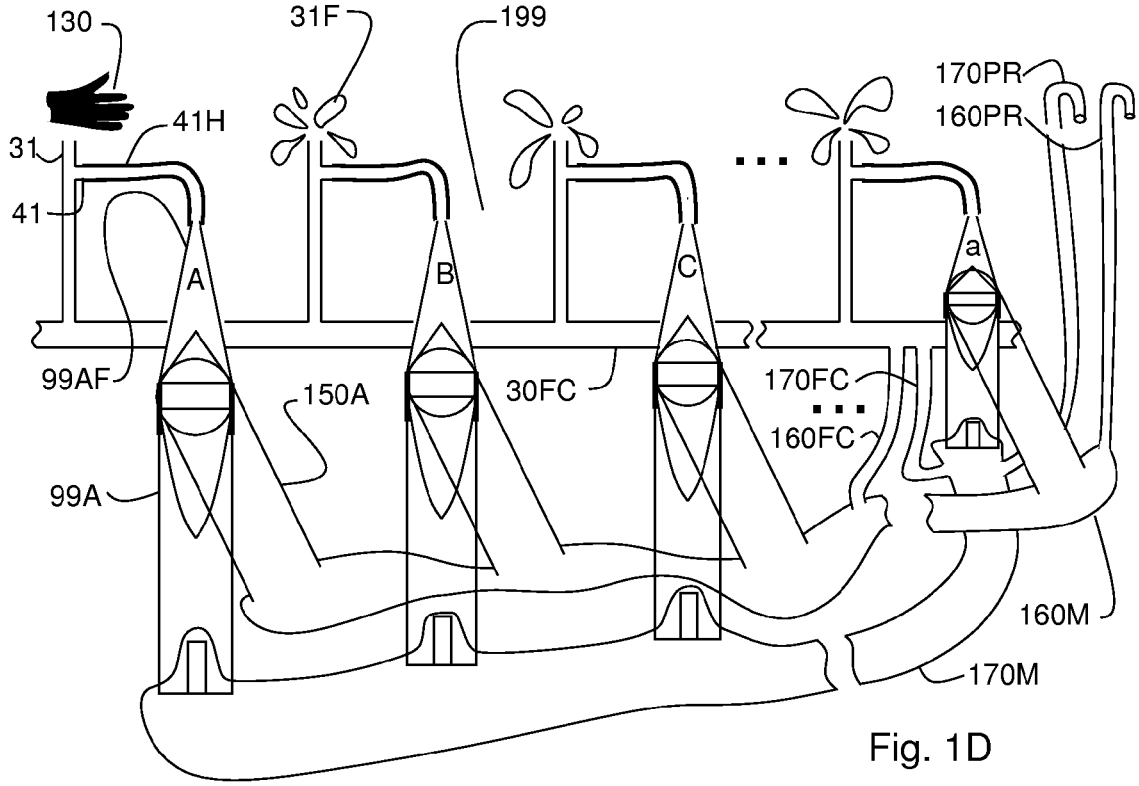
FIG. 1D illustrates an H2Organ (TM) underwater pipe organ in a surrounding medium of air, in which there is extra pipework in order to keep each of the pipes full of water.

FIG. 1D illustrates an H2Organυ underwater pipe organ in a surrounding medium of air, in which there is extra pipework in order to keep each of the pipes, such as sounder 99A, full of water. Each pipe such as sounder 99A has a mouth pipe such as mouth pipe 150A which leads to a mouth manifold 160M. Each pipe such as sounder 99A is also hydraulically connected to an end manifold 170M. Manifolds 160M and 170M can be thought of as exhaust manifolds, since they exhaust fluid after it has run through one or more of the sounders.

However, there are times when fluid can flow from the exhaust manifolds 160M and 170M. For example when no notes are being played, and flow out jets such as jet 31 is very high, the side discharges such as flexible hose 41H may draw a vacuum on the pipes. Thus exhaust manifolds 160M and 170M require a supply of fluid in order to keep the pipes from taking in air or running too much vacuum on the exhaust manifolds.

The supply of water to the exhaust manifold 160M is by way of fluid chest supply connection 160FC. The supply of water to the exhaust manifold 170M is by way of fluid chest supply connection 170FC. In order to prevent the pressure in the exhaust manifolds from increasing too much, each has a pressure release drain. Manifold 160M has pressure release drain 160PR. Manifold 170M has pressure release drain 170PR.

The pressure release drains 160PR and 170PR are located at least as high as the user interface jets 31, so that there is enough head of pressure (height of water column) to prevent air from getting into the system.

This supply and drain of water has the added benefit of preventing the water in the exhaust manifolds from falling stagnant, because there is always a fresh supply of water flowing through the exhaust manifolds.

Figure 1E:
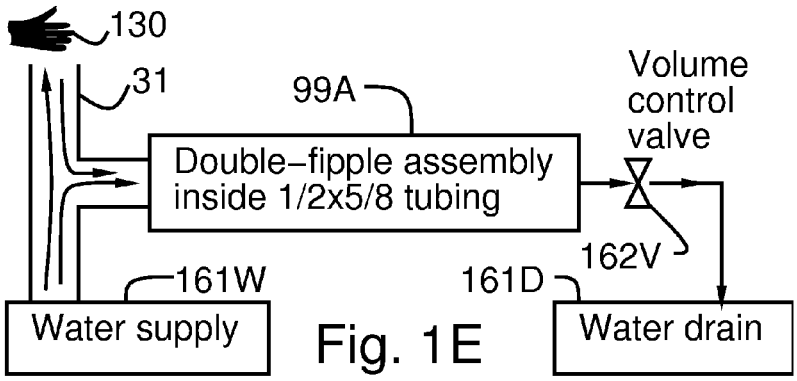
FIG. 1E illustrates a double fipple embodiment of the hydraulophone invention that includes an AC,DC hydrophone pickup and processing.

FIG. 1E illustrates a double fipple embodiment of the invention. This embodiment uses one or more sounders, such as sounder 99A, which include a double-fipple assembly inside ½×⅝ inch tubing, i.e. inside tubing having a ½ inch inside diameter and a ⅝ inch outside diameter. The tubing can be any size desired, i.e. the lower notes can use larger tubing, or, alternatively they can all use one size and a frequency shifter can be used to shift each one to the desired point in the scale.

In this embodiment one or more sounders such as sounder 99A exist at the side discharge of a tee fitting, such that when a user's hand 130 blocks the jet 31, water is pushed through the sounder 99A, which, in this embodiment includes two washers in a pipe to form a double fipple underwater whistle.

Valve 162V inhibits the whistle's ability to expel fluid, and therefore makes it quieter when more inhibited. When valve 162V is fully closed, no water can come out of sounder 99A, and thus no water can go into it, so it doesn't produce sound.

The more open valve 162V is, the louder the sound gets.

Figure 1F:
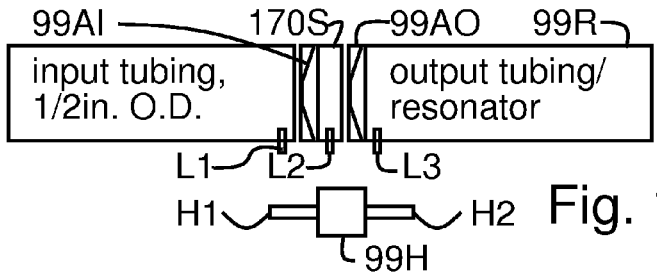
FIG. 1F shows a closeup view of a double-orifice assembly for a sounder of one embodiment of the invention.

FIG. 1F shows a closeup view of the double-fipple assembly inside ½×⅝ inch tubing, in sounder 99A. A spacer 170S consists of a piece of tubing that has a length of ¼ inch and an outside diameter of ½ inch, so that it fits inside the tubing of the double-fipple assembly ½×⅝ inch tubing in sounder 99A.

On either side of spacer 70S there is a washer that has a ½ inch outside diameter. The input washer 99AI channels the water flow so it is incident on the output washer 99AO. The input washer 99AI supplies water to the pair of washers, and there is also an output tubing/resonator 99R that converts the somewhat resonant structure of the double washers into a more strong resonance.

The instrument can be used as a wholly acoustic hydraulophone, or it can also be electrically amplified to make it louder or to control other devices (e.g. to use it as a MIDI or DMX 512 control surface for lighting or other effects).

There are three possible listening ports, L1, L2, and L3, in which one or more hydrophones 99H may be used to detect, measure, sense, or listen to the water in sounder 99A.

A preferred embodiment uses a dual ported hydrophone having a thin glass membrane fitted with piezoresistive elements arranged in a wheatstone bridge. The hydrophone has a response ranging from zero Hertz (D.C.) up to several MegaHertz. Typically the hydrophone is arranged so that water pressure applied to port H1 increases the output voltage of the hydrophone, and water pressure applied to port H2 decreases the output voltage. Typically the hydrophone is supplied with 12 volts DC input and the output is typically a differential output on a Switchcraft A3M male XLR microphone connector, or on an underwater connector if the connection is to be made in a wet environment.

Preferably hydrophone port Ht is connected with a thin flexible hose to listening port L1 or L2 and hydrophone port H2 is connected to listening port L2 or L3. In this way the hydrophone listens differentially.

The apparatus of FIG. 1F is an ACDC (Alternating Current and Direct Current) sounder, because it produces sound and DC offset when water flows through it. When no water flows through it, both sides of the differential hydrophone output are at six volts (half the 12 volt supply voltage). When water flows into input washer 99AI and through to output washer 99AO, one side of the hydrophone output increases above six volts and the other side goes down below six volts. When supplied to a differential amplifier, this voltage difference is amplified, so that a computer system or processor can determine how much water is flowing through the sounder.

Thus the sounder forms an accurate water flow meter that can determine exactly the flow rate of water going through it, and thus it causes the whole apparatus to function as a restrictometer, so that it can be know to what degree a user is obstructing jet 31.

Figure 1G:
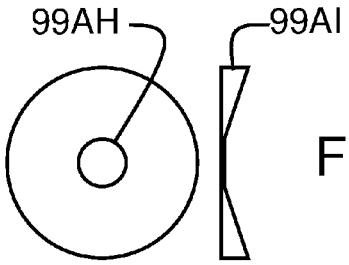
FIG. 1G shows a closeup view of one of the sounding orifices of a double whistle embodiment of a sounder part.

FIG. 1G shows a closeup view of one of the washers having a ⅛ inch hole 99AH. The washers together can function as a Helmholtz resonator, in some embodiments of the invention, and can be varied in size and hole size in order to obtain the desired resonant frequency.

Preferably the hole is drilled so one edge of the washer is sharp and one edge is dull. However, since most cheap washers are stamped out of sheet metal, it is usually already true that one edge is sharp and one is dull, because of the way that a die typically stamps washers out of sheets of stainless steel.

Thus the sounder can be made cheaply from low cost readily available washers and pieces of vinyl tubing. The use of vinyl tubing or PVC tubing avoids any contact between dissimilar metals, since there is no electric contact between washers 99AI, 99AO, and any other metal parts of the system.

Figure 1H:
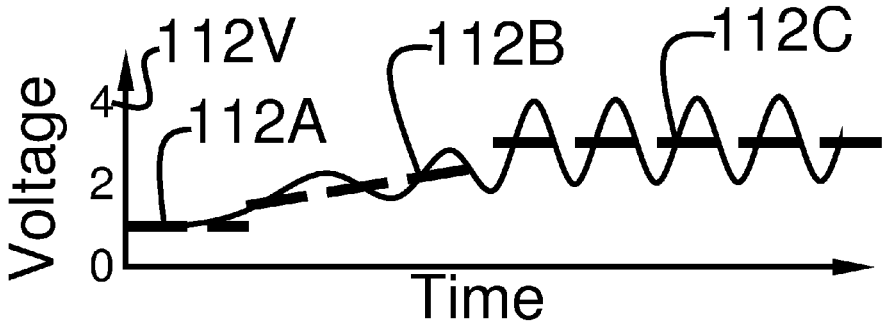
FIG. 1H shows one embodiment of the present invention.

FIG. 1H illustrates the signal from the AC,DC hydraulophonic mechanism of FIGS. 1E, 1F, and 1G. The electrical system is designed so that when jet 31 is not blocked, the output rests at 1 volt. This voltage is chosen for two reasons: (1) if the wire were cut or there was a short circuit we'd know because it might drop to zero or the like; (2) it gives some room for negative pressure so we know if the system is operating properly and also so we know if the water's on, etc.

When the water is running and the jet is not blocked the voltage is 1 volt by calibration and design of the system. One volt is the neutral voltage, and if there's vacuum and water going the other way (backwards) through sounder 99A, the voltage has some room in which it can go below 1 volt, and still not be negative. The system depicted here has a maximum voltage of 5 volts, so the range from 0% blockage to 100% blockage is preferably accompanied with voltage variation in the range 1 to 5 volts.

This system is consistent with a 4-20 mA system in which there is a 250 Ohm load on it. Alternatively a current loop can be used in which the signal is 4 mA when the jet 31 is unblocked and 20 mA when fully blocked.

This means that we don't need an input that has the capacity to handle negative voltages or amperages.

The unblocked resting state is depicted as region 112A in FIG. 1H. FIG. 1H depicts a scenario in which the water jet is initially unblocked and then is partially blocked in time region 112B, and then is fully blocked in time region 112C.

In the transitional region 112B where the blockage increases from less to more blockage, we observe that the general trend of the voltage is an increasing trend. Also we notice an alternating current (AC) component in the way of an oscillation that initially is lower in pitch and then gets higher in pitch as more blockage occurs.

This is consistent with the sound of a wind instrument in which the pitch is "flatter" when there's less wind and "sharper" when there's more wind.

In region 112C, where the jet 31 is fully blocked, the oscillation is fully developed and the DC offset is significantly higher.

The waveform depicted in FIG. 1H can simply be amplified and fed to a loudspeaker to produce a satisfactory musical experience.

However, it can be processed by a computer to add other hyperinstrumentation and hyperacoustic instrumentation.

For example, if we subtract the resting value of 1 volt from the signal, we can then frequency-shift it to the desired note, and add this shifted signal to the sound produced in a loudspeaker.

This AC,DC aspect of the invention can be implemented in other forms. For example, in one embodiment of the invention, a ladder is made where each rung is a bar on a tubular glockenspiel, and the pickup measures AC (Alternating Current) sound vibrations in the bar as well as DC (Director Current) strain, flex, or bending of the bar.

If the rungs of the ladder are struck with rubber mallets, they ring like chimes, with a tone that attacks and then dies out. If you stand on one of the rings, the tone is steady and never dies out for as long as you stand on the rung.

A processor continues to make a sound for as long as the rung is flexed, i.e. by frequency-shifting the DC offset up to whatever note corresponds to a particular rung.

If you stand on one rung and hang onto another with your hand, both will sound, and you will have a musical chord, and the chord can very depending on your weight distribution across the rungs.

A similar effect is possible with a wooden bridge in which each plank on the bridge is a xylophone plank having infinite sustained tone duration.

In another embodiment of the invention, each plank of the xylophone has a separate pickup AND effector. The effector can be, for example, a 50 Watt 4 Ohm AURA AST-2B-04 "Bass Shaker" as described in U.S. Pat. No. 5,424,592.

The pickup listens to the sound made by the wood being struck or flexed, and the effector feeds this sound back. With feedback, the xylophone tone can sound for as long as desired.

By measuring the flex of the wood, the tone is sounded for as long as the wood is flexed. This is sustained by feedback.

Therefore the sound originates xylophonically (i.e. by the wood) and the sound also comes from the wood. Thus the instrument is a not an electrophone.

Moreover the listener experiences the sound xylophonically, i.e. by listening to vibrating wood.

Thus, in the Hornbostel Sachs sense, the instrument is an idiophone, both in its initial sound production and in the way that the instrument is finally experienced by the listener.

Figure 1I:
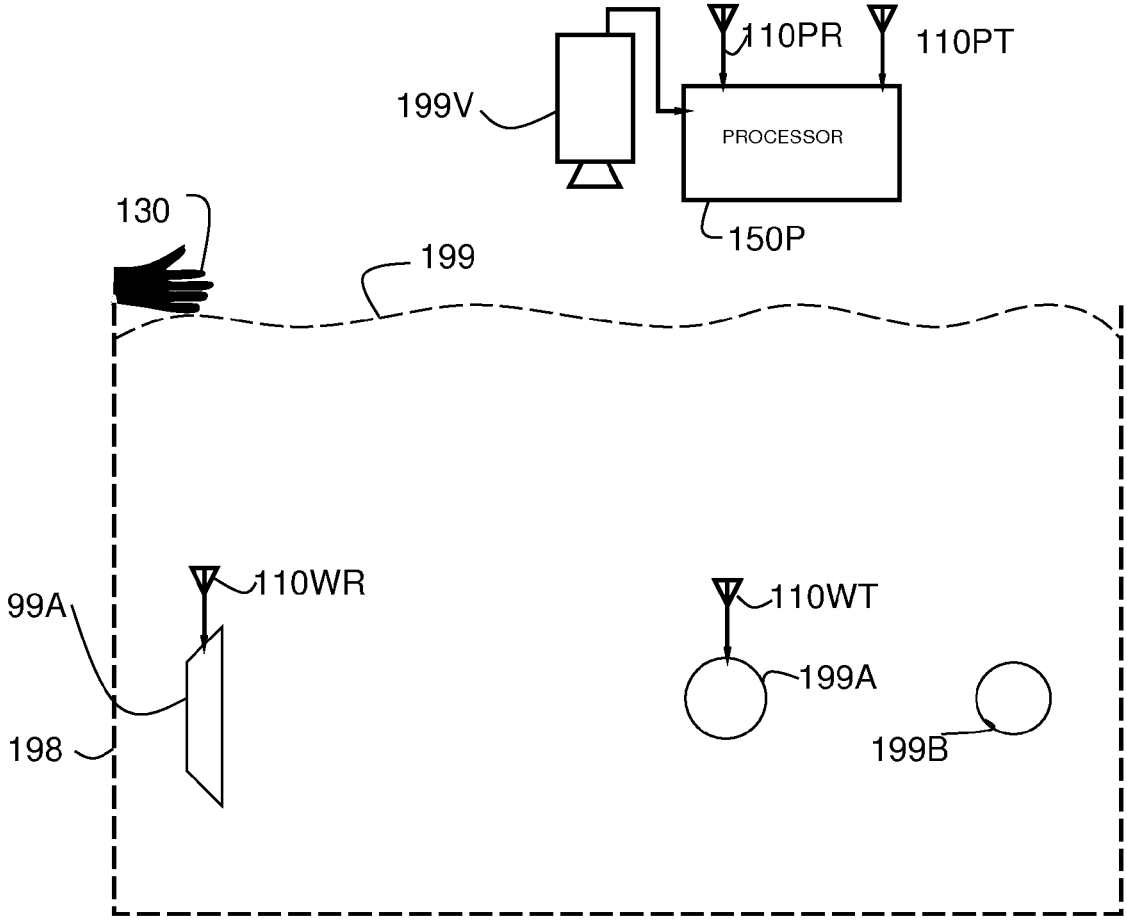
FIG. 1I illustrates an embodiment similar to an infinite xylophone described in this document, but where the medium is water instead of wood, and where one piece or container or sample or instance of the water plays more than one note.

FIG. 1I illustrates an embodiment similar to the infinite xylophone described above, but where the medium is water instead of wood, and where one piece or container or sample or instance of the medium plays more than one note.

Rather than having a different wooden bar for each note, in FIG. 1J, there is one tank of water that can be made to resonate at a plurality of different frequencies, so that it can play all the notes in the musical scale.

A sounder 99A takes the form of an underwater speaker or hydrophone transmitter or other device that excites the water into vibration. An underwater pickup 199A takes the form of a hydrophone or waterproof geophone that detects vibrations in the water and transmits them by way of underwater transmitter 110WT to processor 150P by way of processor receiver 110PR. Processor 150P receives these sounds from the water vibrations, and transmits them through processor transmitter 110PR to underwater receiver 110WR which is connected to sounder 99A.

Processor 150P provides enough gain (amplification) that the overall gain is sufficient to sustain vibrations in the water for an infinite duration if desired.

Hand 130 creates initial disturbances in the water 199. These disturbances are heard or sensed or detected or measured or listened to by pickup 199A.

Thus touching the water initiates a feedback tone, or howling sound, tempered by processor 150P.

Preferably processor 150P invokes a bandpass filter to cause the water to tend to vibrate at a certain frequency for a desired note that depends on position of hand 130. A video camera 199V connected to processor 150P determines where the hand 130 touches the water, and selects a band of frequencies for which more gain is provided.

Touching the water at the left end of the tank causes selection of an emphasis of lower frequencies so the water vibrates at low frequencies.

Touching the water at the right end of the tank causes selection of an emphasis of higher frequencies so the water vibrates at high frequencies.

Touching the water in the middle of the tank causes selection of an emphasis of midrange frequencies so the water vibrates at midrange frequencies.

Thus the surface of the water functions like a "water piano" or water organ, in the sense that touching the water causes it to vibrate at a frequency dependant on where it is touched.

Since the initial sound is caused by vibrating water, the instrument is not an electrophone in the Hornbostel Sachs sense. In fact it is in a new category not previously contemplated by Hornbostel or Sachs or any other previously known musical instrument or musical instrument taxonomy.

The instrument is highly expressive in the sense that slapping the water will produce a much different sound than touching it or scraping it.

Processor 150P executes a simple algorithm:

1. receive input from camera;
2. determine location of hand using computer vision algorithm such as OpenCV hand tracker. This is made even easier by simply putting the whole tank on a light box and selecting the darkest area of silhouette formed by the hand;
3. lookup a wavetable corresponding to hand position;
4. use the wavetable as the filter (shifterbank) by way of its Fourier Transform or simple convolution;
5. initiate feedback in which pickup is amplified and fed back to the underwater sounder 99A;
6. repeat in infinite loop.

The algorithm can be modified for example to have two axes of hand position, e.g. the "X" axis (across) controls pitch and the "Y" axis (up and down) controls volume or gain or timbre.

Additionally the hand size can control bandwidth so you can play broader hand versus sideways hand to change timbre, and you can even stretch fingers to play chords by recognizing more than one component.

You can also use both hands at once and sense multiple objects and even more than one person can play in the water to make very full jazz chords.

A slight modification of the algorithm is then needed:

1. receive input from camera;
2. determine locations, size, shape, and orientation of hands or feet or whole bodies of multiple bathers in the case of a large swimming pool, using computer vision algorithm such as OpenCV object tracker. This is made even easier by simply lighting the whole pool from within using underwater lights, or putting the whole tank on a light box and selecting the darkest area of silhouette formed by the people or hands and feet, etc.;
3. lookup wavetables or filters corresponding to body positions;
4. use a plurality of wavetables as the filters (shifterbanks) by way of their Fourier Transforms and linear superposition or simple convolutions;
5. initiate feedback in which pickup is amplified and fed back to the underwater sounder 99A or multiple sounders in the case of a large pool;
6. repeat in infinite loop.

Other variations of the invention can include pipes with a speaker or other sounder 99A at one end and a microphone or other pickup 199A at the other end, and air or water in the pipe.

An array of pipes, one for each note of a musical scale, can each be fitted with a sounder 99A and pickup 199A, and a processor can listen and replay on each one, affecting the amount of gain in response to sensed quantities such as touch or flex or pressure applied to each pipe.

Thus pressing on a pipe can cause it to squeal or squawk or sing at a particular note that depends on where and how it is pressed.

The result creates a user experience like that of playing a large tubular glockenspiel in a park or playground, where banging on plastic pipes can create a nice clear bell-like tone on each pipe, where the tone rings like tubular bells but can also sustain like a glass harmonica if a player keeps pressing on a pipe rather than just hitting it.

FIG. 1J illustrates an embodiment of the invention that can be purely mechanical (i.e. does not require any electric components) and that produces a visual, tactile, and auditory effect that is not necessarily a specific musical note.

When hand 130 blocks jet 31, user-interface fluid (e.g. air or water or beer or Skyy Vodka or the like) at comparatively low pressure enters sounder 99. Inside sounder 99 there is a diaphragm 99D that pushes open a large valve 99LV to allow the flow of extremely high pressure and extremely voluminous fluid from fluid chest 99FC into nozzle 99FN. Nozzle 99FN is a nozzle similar to a firehose nozzle.

Fluid chest 99FC can be connected to a fire engine pumper truck that is in turn connected to a fire hydrant to boost the pressure of the hydrant so that the water jet from nozzle 99FN sprays approximately 300 feet into the air whenever hand 130 blocks jet 31. Jet 31 might typically spray one inch or less in the air. Thus blocking a small 1 inch jet that is maybe a quarter inch in diameter sprays up a much larger jet that is maybe 2 to 4 inches in diameter and 300 feet high in spray.

This creates a dramatic visual effect, as well as a wholly acoustic auditory effect of indefinite pitch, suitable for percussion in a large rock concert, on a hot summer day, to cool off the audience members when the water eventually comes back down, or the like.

Sounder 99 creates an auditory effect by way of the fact that the spray of water from nozzle 99 makes a large sound, resulting from blocking jet 31. If desired, a two-stage fluidic amplifier or two stage fluid-controlled valve may be used, or a multistage fluid amplifier or valve.

The effect can also be enhanced with pneumatics. For example, fluid chest 99FC can be supplied with compressed air or steam to drive steam calliope pipes that can be heard from 20 miles away, such that the sound is loud enough for a large rock concert without the need for any electric amplification, while still maintaining light touch on jet 31.

Sounder 99 may be adapted from a pressure regulator by removing the screw from the diaphragm and replacing it with an inlet hose that supplies low pressure user-interface fluid to the diaphragm to control or regulate the flow of high pressure effects fluid.

The invention thus allows a low pressure fluid to control a higher pressure fluid that creates auditory and visual effects.

More generally, various other embodiments are possible in the sense that an arbitrary mechanical, pneumatic, hydraulic, and/or electric sensor technology can sense changes in user-interface fluid flow and process these changes and cause these detected or sensed changes to generate, trigger, modify, modulate, or vary some kind of auditory, visual, tactile, or other observable effect.

For example, fluid chest 99FC can be supplied with high pressure oil, and nozzle 99FN can be replaced with a connection to a hydraulic actuator, so that, for example, a performer, user, or worker can crush cars, split logs, or do other hydraulic actions by blocking jet 31.

In one embodiment, a freight elevator or goods lift is controlled by blocking two air holes, one for up, and another for down. The degree of obstruction of the hole causes hydraulic fluid to move the elevator car up or down.

The user can block an air hole of jet 31 to run hydraulic fluid from fluid chest 99FC into a hydraulic cylinder that performs various other actions, or actuates various robotic systems.

In an alternative embodiment, a remote pump house 49PH contains one throttling sensor devices or throttler sensor 49T associated with one or more user interface jets, such as jets 31A and 31B. Each throttler sensor senses the amount of flow passing through a jet fitting, such as one or more jet fittings 40A and 40B.

For example, the amount of flow passing through jet fitting 40A is sensed in order to estimate, detect, or sense changes in flow of fluid out jet 31A.

Each of the one or more throttler sensors 49T supplies input to one or more fluid amplifiers or is part of one or more fluid amplifiers 49FA. Fluid amplifiers 49FA each supply or supplies fluid to, or control or controls one or more effectors or throttling valves 49VV.

Thus blocking a first jet 31A sprays a large stream of water out a first jet of the jets 49JJ, and blocking a second jet 31B sprays a large stream of water out a second jet of jets 49JJ and so on.

User interface jets 31A and 31B are located in a user-interface facility 49UIF which may be remote from the pump house 49PH. Connection from the pump house 49PH to the user-interface facility 49UIF is through flexible hoses or plastic tubing. Fittings such as fittings 40A and 40B comprise, include, or are plastic tubing or vinyl tubing, or PVC tubing, or rigid tubing if quicker response time is desired.

Fluid amplifiers are well known in the art, and may amplify flow or pressure or both, in various ways.

The invention, in some embodiments, makes use of fluid amplifiers in an inventive new way, by providing a user interface port, sensing changes in blockage of the user interface port, and generating a visible, auditory, or tactile effect in response to those sensed changes.

The apparatus does not require electricity or compressed air, i.e. it can run on water alone, and is therefore ideally suited to use in waterparks.

Figure 1K:
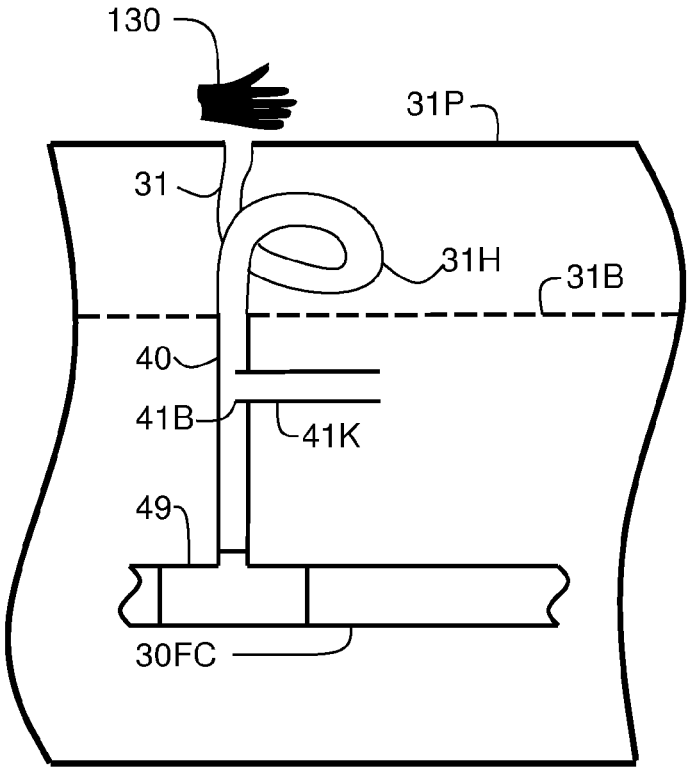
FIG. 1K illustrates ruggedization of the fluid user interface.

FIG. 1K illustrates ruggedization of the fluid user interface. Obviously we can ruggedize the apparatus of the invention by putting the sensing technology further from the user. In the extreme case, we can put the sensory technology in a pump house or below ground, and run long hoses to the finger holes. This however reduces sensitivity and also reduces response speed (e.g. note-attack time in a musical application) and desponse speed (e.g. note-release time in a musical application).

In some embodiments it is desired to have the sensory technology close to the finger hole of jet 31, but since the innards of a very sensitive user-interface system might be delicate and damaged by vandalism, whether from glue or acid poured into the finger holes, or from exposure to loud sound that might damage the "eardrum" of sensitive listening equipment such as hydrophones or the like (e.g. if a firecracker were inserted into the finger hole and exploded making a loud sound at close range).

In one embodiment, a motion detector turns water on as persons approach, so that the instrument is always protected by water flow (e.g. it is difficult to get glue to stick to something that's wet, or to stick things into the finger holes when water is spraying out).

Another form of protection arises from a sacrificial hose 31H that forms the last element to supply the finger hole by jet 31.

If nails or sharp objects are driven into the finger hole of jet 31, then it will merely damage a short loop of sacrifical hose 31H.

The entire apparatus is protected inside pipe 31P which is preferably a schedule 40 or schedule 80 pipe of type 316 stainless steel, or other durable material.

In order to make it easy for the park attendants or the like to replace hoses, there is a bulkhead 31B that totally separates the non-user-serviceable parts from the user-serviceable hose or hoses 31H.

Because the hose 31H offers some resistance to water exiting from jet fitting 40, there would ordinarily be some side-discharge 41K even when no hand 130 is present blocking jet 31.

In a computer interface, we can simply subtract the small amount of side discharge from the total, to sense the difference. There can even be a calibration algorithm that measures the side discharge when blocked and subtracts with an automatic self calibration algorithm:

turn on water pump;
initialize flow to starting value;
measure side discharge due to flow value set;
change flow to new value, by increment;
measure side discharge for new flow;
for each flow determine side discharge when no user hand 130 present;
build lookup table for neutralization of zero blockage flow;
begin operation with normal usage;
for each flow level index into lookup table and subtract zero blockage flow In some embodiments we wish to have no side discharge when there is no blockage of jet 31, or we wish to have controlled side discharge. For example, when there is an organ pipe connected to each side discharge, we might wish to have zero sound when jet 31 is not blocked, or we might wish to be able to control or adjust the amount of sound slightly above zero but not too high (this is called the "compass drone" or the "during drone" of the instrument).

In order to reduce, control, or adjust the zero-blockage side discharge level, we arrange the system so that side discharge 41K can slide in and out of the tee fitting to make a Bernoulli vacuum channel 41B.

Vacuum channel 41B is a narrowing of the flow which speeds it up and draws a vacuum. Therefore, not only can we make the zero-blockage side-discharge go all the way to zero, we can even make it go negative. When it goes negative (by sliding side discharge 41K further into the tee fitting), the side discharge actually draws a vacuum. If connected to an organ pipe it will suck on the pipe rather than blow into it.

This capability helps to mitigate the effect of the sacrificial hose.

The special tee fittings can be made with non-adjustable side discharge inset at a fixed distance for a fixed vacuum channel 41B, to reduce costs. For example, a pipe with ⅝ inch outside diameter and ½ inch inside diameter forms jet fitting 40, and then side discharge 41K is made from pipe having an OUTSIDE DIAMETER of ½ inch. A ½ inch hole is drilled in the pipe from which jet fitting 40 is made, and the side discharge 41K is inserted and soldered, welded, or glued in place.

Figure 1L:
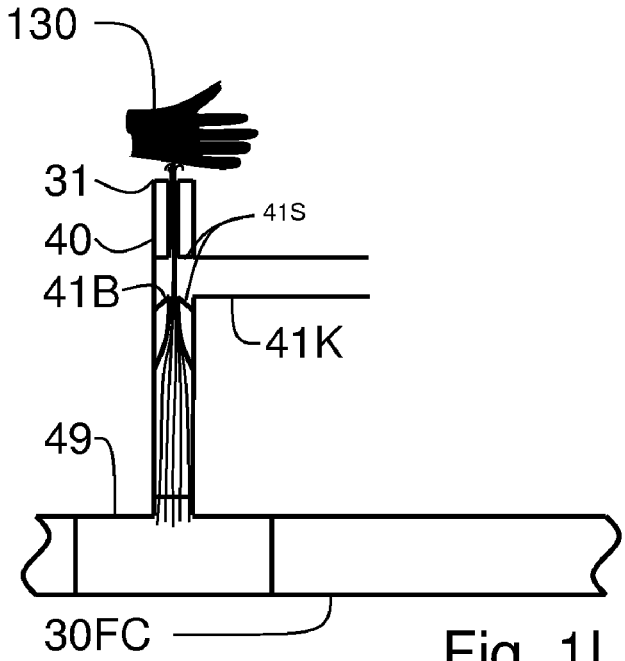
FIG. 1L illustrates embodiments of the sensing technology that sense changes in fluid flow or pressure arising from a fluid jet being touched by a user of the fluid user interface.

FIG. 1L illustrates an alternate embodiment of the restrictometric sensing technology used to sense changes in obstruction. A sensor 41S is comprised of a narrowing of the flow channel and a discharge into side discharge 41K. The sensor does not require electricity or computation, but of course computation can be added if desired.

Sensor 41S includes a Bernoulli vacuum channel 41B made from a nozzle inside the jet fitting 40. further along jet fitting 40 there is a narrowing of the pipe that the nozzle sprays into. In this way water flows very quickly past side discharge 41K even when there is a small amount of restruction at jet 31, such as might be caused by a short length of sacrificial hose.

The apparatus of FIG. 1L is a sensor that senses change in flow at a user interface port having a fluid jet 31, i.e. it senses the presence of the user's hand 130, and when the hand 130 is detected it produces a visual, auditory, or other effect in response to this sensed activity. The effect manifests itself as water spraying out side discharge 41K which can itself be the effect, or which can be used acoustically, hydraulically, pneumatically, or otherwise to create some other effect(s).

Figure 1M:
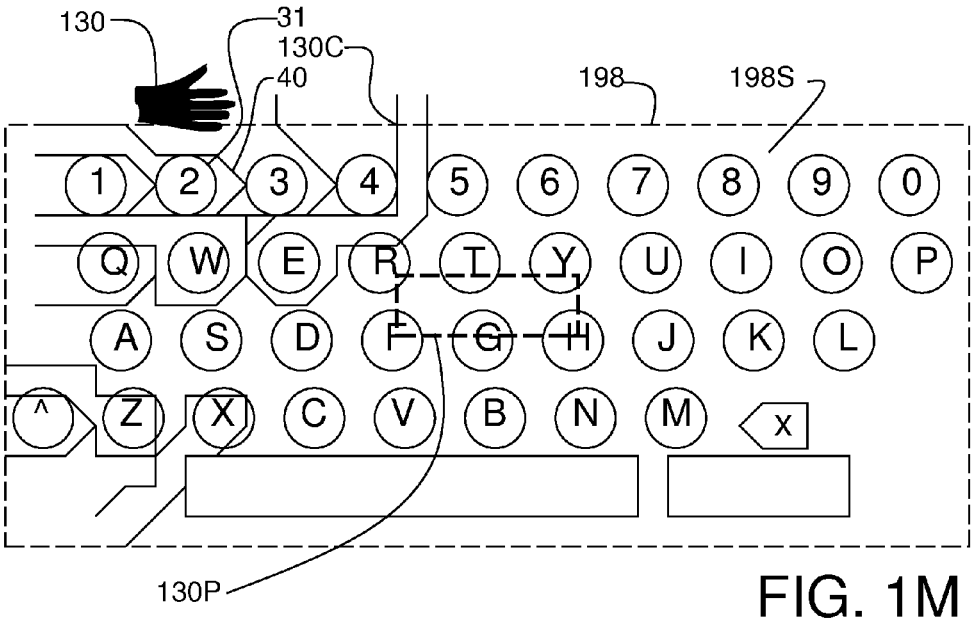
FIG. 1M illustrates an embodiment of the invention built into a touchscreen surface with back projection, where the surface may also be solar powered.

FIG. 1M illustrates an embodiment of the invention built into a touchscreen surface 198S with back projection by way of camera and sensor unit with projector 130P that back projects through a translucent screen surface 198S.

Surface 198S is filled with fluid conduits. Ideally the fluid conduits are made of material having the same refractive index as water (or whatever fluid is flowing through the system as the user interface fluid).

Since it is difficult to find transparent plastic tubing with exactly the same refractive index as water, and since xylene index matching fluid is not an ideal user-interface fluid, a cheaper and simpler approach is to form fluid conduits 130C as part of the surface substrate, like a printed circuit board of sorts, where the conduits have straight edges that have little or no adverse effect on the projection, especially when edges of conduits 130C are feathered toward the optical axis of projector 130P so that they are always facing on edge and thus occupy negligible space in shading the surface 198S from projection and sensing.

The jets 31 are sensing jets but also additionally the surface 198S is a sensing surface, so the system is both hydraulophonic and touch sensitive.

This embodiment can be built into hot tubs, jacuzzis, pools, and the like so that people can put on their swimsuits and surf the Web.

In an alternate embodiment, an underwater camera simply looks at the holes of jets such as jet 31 that are all supplied with the same water, and no individual pressure or flow sensing is needed. The camera simply sees which jets are covered and how much.

The projector can also encode structured lighting to the water jets. All of this sensory apparatus is hidden inside the interior of a hot tub, so that there is no clutter or apparatus above the surface 198S. The hot tub's hollow cavity forms the shell or housing for the apparatus, and water emerges from holes in the housing, on surface 198S, and apparatus inside the housing senses the flow by vision and inference, i.e. by observing the degree of obstruction of each finger hole with hand 130 or fingers or feet, etc., in the case of a pedal division or the like.

In an alternate embodiment a bath tub may be presented as a marketing device by placing it on wheels and having a multimedia mobile interactive bathing environment or "bathmobile".

A transparent or translucent hot tub, or bath tub, for example on wheels, may be used for product placement (such as soap product advertisement or the like), and falls well within the tradition of engineering students riding in bath tubs ("bath tub races" etc.), but with the added twist that the tub is an immersive multimedia environment.

In alternative embodiments surface 198S is a solar panel to power the pumps and other elements of the system. Various embodiments include renewable energy such as solar surface, wind power, and also water turbines that derive power from the water supply supplied to the apparatus of the invention.

The electric circuit analogy for surface 198S has been disclosed, but in some embodiments the surface 198S is actually a printed circuit board or solar panel or the like, with jets integrated into a photovoltaic surface that is advantageously cooled by the water flowing out the finger holes while at the same time heating the water flowing out the finger holes.

In other embodiments, the surface is a passive solar hot water collector.

Figure 1N:
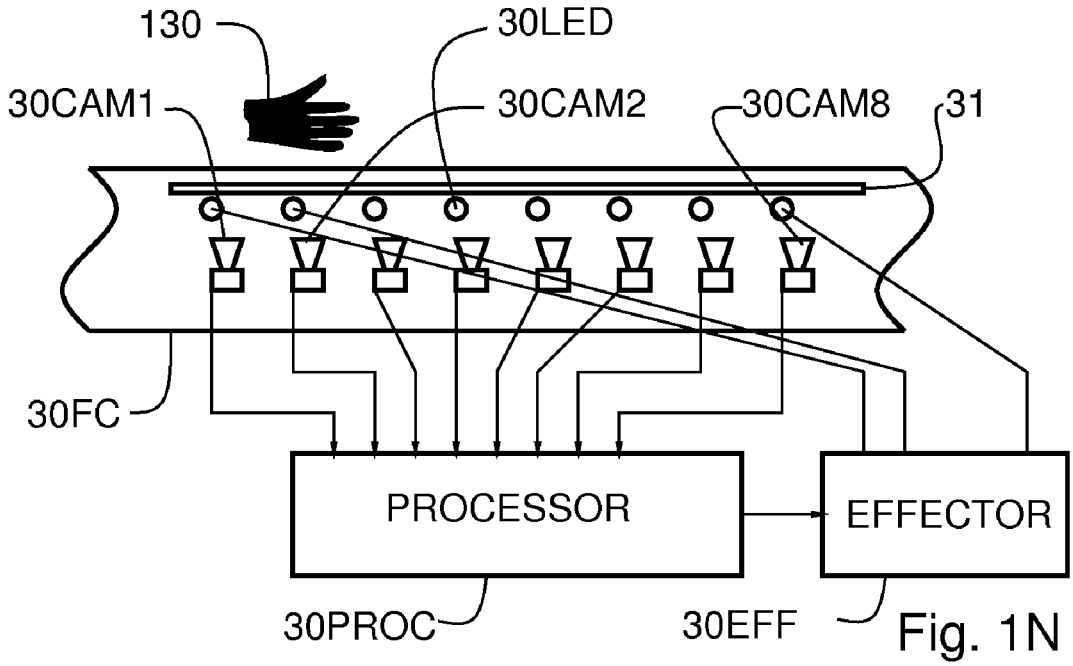
FIG. 1N illustrates a continuous embodiment of the instrument.

FIG. 1N illustrates a continuous embodiment of the instrument. In this patent description, and claims, what is meant by instrument is a musical instrument or other instrument such as a measuring instrument, or lighting control surface, or MIDI control surface, or DMX512 control surface, or the like, or any sensory and effectory user interface.

The embodiment of FIG. 1N captures this general spirit in one embodiment, by being in this example a continuous slot jet 31 that comes out of a long slot so it can be played like a violin or cello or slot flute by blocking jet 31 anywhere along its length or in multiple places at the same time.

An array of underwater cameras 30CAM1, 30CAM2, . . . 30CAM8 use total internal refraction (or regular computer vision) to sense where the hand is in the waterfall or slot-shaped water jet.

Ideally a laminar jet is used so the cameras can see down into the jet and apply LIDAR (Light Direction And Ranging) to determine not only where but how far away each body part is.

Ideally cameras such as those made by Canesta that measure time-of-flight are used, or other suitable holographic cameras, in combination with laser or LED active illumination lights 30LED.

The lights can be a visible effect as well as for active vision at the same time. Processor 30PROC is responsive to input from the cameras that function as an array of restrictometers. Each camera is preferably a 30 by 30 pixel optical mouse system, so the cost is low. A total pixel density of the 8 cameras shown is 240 pixels across, but more can be used or the pixel count can be higher.

Here the emphasis is on low cost, so the leaky pipe user interface can be used, for example, in a washroom to control the temperature of the water, or it can be used in a hot tub as a control surface for adjusting parameters of the tub, much like the slider on an audio mixer that has a slide potentiometer. The user touches water and slides the slider, and the lights follow the slider to show the position. If you touch the middle, the first four lights 30LED light up to show you've set it halfway. If you touch the right side and block the water jet rightmost, all the lights come on. If you touch it leftmost they all go off. Thus the "slot pot" (slot potentiometer) is made from a waterfall or slot shaped water jet.

Figure 2A:
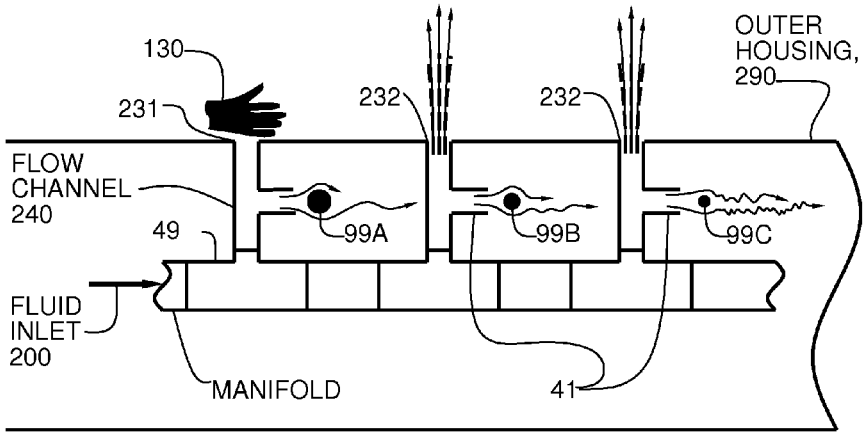
FIG. 2A illustrates an embodiment based on vortex shedding in an end-blown or end-flown configuration, and also shows the arrangement for a housing for the instrument.

FIG. 2A illustrates a typical housing for the reustophone, giving it the appearance of a giant flute. Outer housing 290 is typically a large stainless steel pipe typically having 12 a linear array of 12 finger holes, or a chromatic array of 33 or 45 finger holes, although any number or arrangement of finger holes is possible. Alternatively, outer housing 290 is in the shape of a snake or giant tadpole, whale, sea monster, or other shape. Hand 130 can interact with one or more finger holes 231 in order to force fluid into separate sound production mechanisms, or sounders for each note.

Fluid is supplied by fluid inlet 200. Fluid flows into fluid chest fittings 49, and into flow channels 240. Blocking a first finger hole, say, for example, finger hole 231, forces fluid to be directed at sounder 99A. Blocking a second finger hole, say, for example, finger hole 232, forces fluid to be directed at sounder 99B. Blocking a third finger hole, say, for example, finger hole 233, forces fluid to be directed at sounder 99C. Sounder 99A produces the first note of a musical scale, typically the note "A". Sounder 99B produces the next note, typically "B". Sounder 99C produces the next note after that, typically "C". Typically there are more finger holes than the three holes shown.

FIG. 2 shows sounders 99A, 99B, and 99C as cylinders, viewed on end. In one embodiment, sounders 99A, 99B, and 99C are long cylinders placed in the water stream. These are called "Karmanizers" or "Karmonizers" (see for example, "Natural interfaces for musical expression: Physiphones and a physics-based organology", by S. Mann, in Proceedings of the 7th international conference on New interfaces for musical expression, 2007 Jun. 6, New York).

These produce oscillatory vibrations in the water, over a wide range of Reynolds numbers for about $40_i Re_t 400$. Advantageously, the frequency of oscillation depends on the flow rate. This gives a wide range of musical expressivity, i.e. the ability to "bend" the pitch of a given note by partially covering one of the finger holes 231, 232, and 233.

Outer housing 290 gives the appearance of a giant flute but it also provides a simplicity more like the piano or organ, in which each finger hole is associated with one note, so that there is no need to learn a complicated fingering pattern as is the case with typical woodwind instruments like the tin flute or recorder.

Moreover, since each sounder can operate separate of the others, it is possible to play more than one note at the same time by simply blocking more than one hole at the same time.

In this sense, the reustophone shown in FIG. 2 combines aspects of the flute with aspects of the pipe organ. The reustophone in this sense is often referred to as a "florgan". The word "florgan" is a portmanteau of the words "FLute" and "ORGAN". This neologism is commonly used in the scientific literature. See for example, "flUId streams: fountains that are keyboards with nozzle spray as keys that give rich tactile feedback and are more expressive and more fun than plastic keys", by S. Mann, in Association of Computing Machinery (ACM), Proceedings of the 13th annual ACM international conference on Multimedia, 2005, Singapore.

Chords can be played on the florgan by blocking multiple finger holes at the same time, in various combinations. For example, blocking the "A" hole, the "C" hole, and the "E" hole at the same time produces an A-minor chord. While blocking these three holes together at the same time, any one note can be independently "bent" in pitch while the others continue to sound.

The sound generated by the Von Karman Vortex Street, or other vortex shedding, can be picked up by one or more underwater microphones or hydrophones. In one embodiment, a separate hydrophone for each note is used. Each of these hydrophones may therefore be electrically processed in a different way. For example, the "bending" of the pitch can be accentuated for more expressive play or reduced for easier on-key play at varying per-note volume.

Figure 2B:
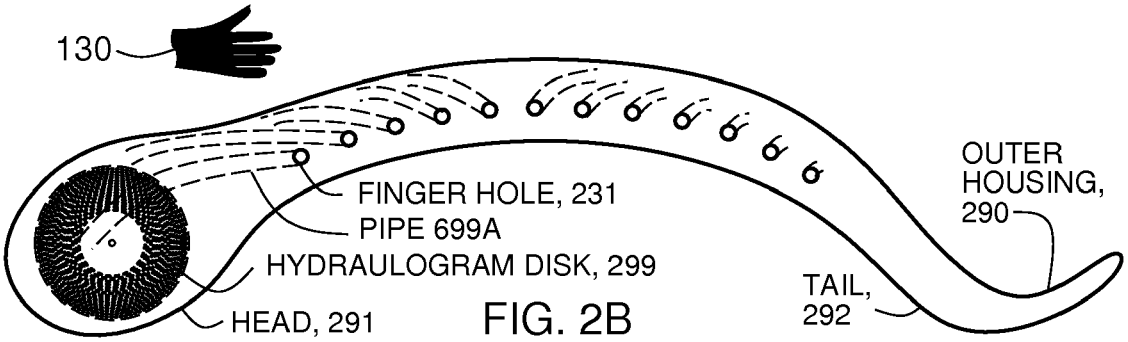
FIG. 2B illustrates more details of a preferred housing.

FIG. 2B illustrates a typical housing 290 for the reustophone. This housing is a preferred shape of housing because it can house many different embodiments of the invention. The housing is a tapered pipe with a fat end for the low notes and a slender end for the high notes, which gives better sound quality in some embodiments and also an easthetic and look-and-feel as well as a user-interface that is easy for users to comprehend.

The user stands at the concave side of the curve, and faces the instrument from a position that is approximately equidistant to all of the finger holes 231. The user's hand 130 then reaches to one or more of the desired finger holes 231.

A large round head 291 houses a spinning perforated disk in some but not all embodiments. If an embodiment is sold that does not use the spinning disk, the product can be modified to use or not use the disk, as desired by the customer or as recommended by the vendor depending on particular usage scenarios. The spinning disk has 12 concentric patterns in it, and functions like a mechanical phonograph disk but with concentric recordings rather than spiral recordings. It makes sound entirely mechanically, without the need for use of electricity other than to spin the disk, although this sound can be electrically amplified if desired. Alternatively other power sources such as a small gasoline powered motor can spin the disk. The disk may be thought of as phonograph record being "scratched" by a hydraulic stylus as will be described later in this disclosure. Alternatively two disks, one spinning and the other stationary may be used, in an arrangement similar to that of an air raid siren. This helps increase the sound level so that the instrument can be heard several miles away, especially when out on a lake, if desired, although it is usually preferable to have the instrument play at a nice peaceful quiet level except in very large concert venues. The spinning disk can also be thought of as an entirely mechanical sound synthesizer, which thus turns the instrument into an entirely mechanical sampling keyboard, where the samples are changed by changing the disk. In some embodiments the spinning disk shares a common shaft with a water pump, so that only one gasoline powered or electric battery powered motor is required to run the whole instrument. When a water pump is present the instrument may have a "drink hole" under the head, to pump water out of a shallow part of a lake or pool, so that the head does not need to go in all the way to the mouth, if it is desired to run on more shallow (e.g. 1 inch or so) water.

The other end of the instrument ends in a tail 292 that accentuates the sound and resonance of the high notes in some embodiments but not necessarily in all embodiments.

This shape is sometimes referred to as a Nessie after the large green female sea snake said to inhabit Loch Ness. Accordingly the housing, made of fiberglass, is typically provided in a green gel coat, with a high gloss finish that repels dirt while providing for easy cleaning.

The part of the head 291 that is furthest from the tail 292 has an opening in it which is referred to as the "main mouth". The other 12 finger holes are often referred to as the "mouths" (plural). In a preferred embodiment the Nessie housing 290 is approximately 5 feet long in chordal distance (i.e. "as the crow flies") from the mouth of head 291 to the tip of tail 292, and the disk, if present, is 10 inches in diameter. Preferably the Nessie housing 290 is partially filled with foam so that the entire instrument floats in water, with the water level rising about halfway up the main mouth, so that half of the main mouth is underwater and half is in air. The spinning disk, if present, spins at the height of the mouth, in the same plane as the water, so that when the instrument is floating, a user can push the instrument down a little to submerge the disk and change the sound, or push down on the tail 292 to make the head go up and bring the disk into air, and make the sound more "airy". The instrument can thus operate as a woodwind or woodwater instrument, or anywhere in between, depending on how far down or up the head 291 is pushed.

In other embodiments the Nessie housing 290 is placed on a stand.

In some embodiments other sounding mechanisms are used instead of or in addition to the spinning disk.

For example, pipes 699A can be used to make sound together with the disk for a more rich sound, or instead of the disk. Alternatively a speaker can be placed in the head, or a speaker cabinet sculpted into the head and hydrophones can be used to amplify sounds from water in pipes or other weaker sound producing mechanisms.

Figure 3:
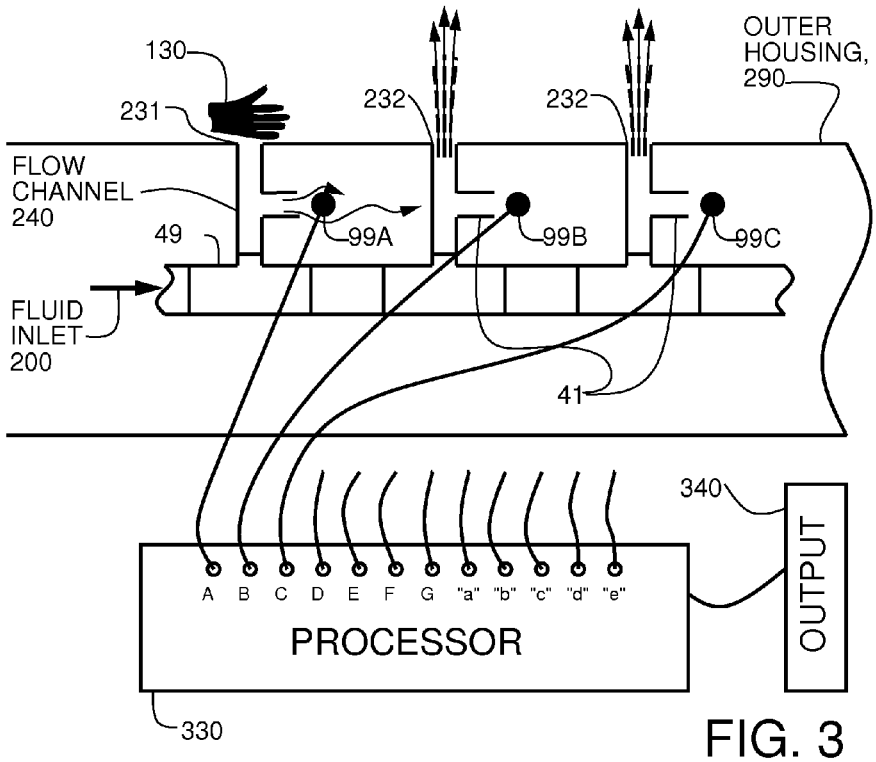
FIG. 3 illustrates an embodiment based on vortex shedding in an end-blown or end-flown configuration with economy of manufacture, by using a processor to frequency-shift identical notes to the different notes needed for a musical scale.

FIG. 3 illustrates another embodiment of the reustophone in which each Karmanizer operates at the same frequency. In this example, a reference frequency of 440 vibrations per second is chosen. This reduces manufacturing costs. Ordinarily Karmanizers are sold as replacement parts, and the last "number" of the serial number is a letter indicating the note, i.e. "A" through "G", and higher notes are designated using the extended alphabet in which "a" is denoted by "H" and so on, up to "Z", which is the highest note on a standard 45-jet concert hydraulophone. There are 26 natural notes on a 45-jet hydraulophone that correspond to the white keys of the piano from 110 Hz "A" up to "Z". A lower case "b" is used to denote flats, e.g. flats go from "Ab" up to "Zb" ("Z-flat"). Karmanizer serial numbers are usually denoted by flats rather than sharps, so if the serial number for example ends in "Zb" this denotes the highest "E-flat" on the instrument.

Typically maintenance staff would need spares for each note of a 45-jet hydraulophone as shown in FIG. 2. However the embodiment of FIG. 3 gives a cost-savings on both manufacturing as well as maintenance because all of the karmonizers are identical, and they typically consist of an "A" (e.g. last letter of serial number is "A" for 110 Hz, "H" for 220 Hz, "O" for 440 Hz, or "V" for 880 Hz).

For simplicity consider an "A" Karmanizer used in all notes, although in practice it may be preferable to use a higher note for quicker response. When hand 130 blocks finger hole 231, water sprays past sounder 99A, to produce an "A" note. Processor 330 passes this signal to output 340. Output 340 may be an amplifier and speaker system, or it may be a more natural acoustic sound generator or interactor.

When hand 130 blocks finger hole 232, sounder 99B also produces an "A" note, but it is picked up by a separate microphone or hydrophone and fed to a separate input of processor 330. The processor takes whatever is fed from this separate input, denoted "B", and frequency-shifts the incoming "A" note into a "B" note, and passes this shifted note to output 340.

Likewise, when hand 130 blocks finger hole 233, sounder 99C also produces an "A" note, but it is picked up by a separate microphone or hydrophone and fed to a "C" input of processor 330. This "C" input Frequency-shifting is well known in the art, e.g. to correct the pitch of singers who sing off key. In this way we could regard the instrument as playing off key, or as playing always on the key of "A" at all times every note an "A", and then shifting the notes to the desired pitch. This instrument is not an electrophone in the ethnomusicological sense (or in the organological sense). If the fluid is air, the instrument is an aerophone, and in fact is a woodwind instrument. The term "woodwind" applies regardless of material, e.g. like a metal saxophone or a tin flute is still called a "woodwind" instrument. If the fluid is water the instrument is a hydraulophone. If the fluid is plasma, the instrument is a plasmaphone.

Acoustic pickups appropriate to the fluid may be used. The pickup may be near, on, or in the Karmanizer, or it may actually be part of the Karmanizer. In fact the cylinder itself may be the pickup element such that the Karmanizer is a device that both causes the vortex shedding and measures the vortex shedding.

Pickups for picking up in solid matter are called geophones (or contact microphones). Pickups for picking up in liquid are called hydrophones (or underwater microphones). Pickups for picking up in plasma are called ionophones (see for example, "Natural interfaces for musical expression: Physiphones and a physics-based organology", by S. Mann, in Proceedings of the 7th international conference on New interfaces for musical expression, 2007 Jun. 6, New York).

Unlike an electronic instrument, or a mere user interface, the embodiment of FIG. 3 maintains a great deal of intimate musical expressivity and can play in a very "fluid" way, or in a very "fluidly continuous" way.

Typically processor 330 is simply a frequency-shifter, but, if desired, processor 330 can analyze the sound coming from each pickup and generate or synthesize another kind of sound. In order to avoid the lack of expressivity of typical electronic instruments, it is preferable that the sound change be done in a continuous or fluid fashion. Ideally therefore, the overall instrument remains a physiphone (e.g. gaiaphone, hydraulophone, aerophone, or plasmaphone) rather than an electrophone.

Karmanizers when connected directly to amplifiers and speaker systems sound a lot like flutes. The sound is very similar to the sound of wind whistling through telegraph wires. But in addition to being merely frequency-shifted this sound can also be filtered in such a way as to change it to any other desired sound.

For example, suppose we want the reustophone to sound like a strings ensemble. We can record an actual strings ensemble and record the sound of the Karmanizer, and then take the ratio of these recorded sounds to derive a transfer function, H, that will map the sound of a Karmanizer to the sound of a strings ensemble.

This method is an aspect of the invention, and it can work in general for any of the instruments disclosed here or for other instruments. It tends to work most dramatically on continuously flowing instruments but will work on other instruments such as struck instruments as well. For example, the method disclosed will work for an array of wooden blocks of identical size, to transform this array of equal sized blocks into a xylophone.

For a single-piece instrument, such as a single water jet, or a single block of wood, the method is as follows:

1. training or calibration of reference sound:

(a) record sound of actual instrument, A;

(b) record sound of desired instrument, D;

(c) compute a transfer function, H that maps reference sound of actual instrument to sound of desired instrument (this could, for example, be the quotient, H=D/A);

(d) load transfer function into processor;

2. system usage or musical performance:

(a) receive sound during usage or musical performance, $\tilde{A}$;

(b) apply filter H to $\tilde{A}$ to arrive at a usage sound $\tilde{D}=H\tilde{A}$;

(c) output usage sound $\tilde{D}$).

For a multipiece instrument, the method is as follows:

1. training or calibration of reference sounds:

(a) for each input, record sound of actual instrument, $A_1$, $A_2$, $A_3$, etc.;

(b) record sound of desired instruments, $D_1$, $D_2$, $D_3$, etc.;

(c) compute a transfer function, H that maps reference sound of each actual instrument to sound of each desired instrument. This could, for example, be the quotient, $H_1D_1/A_1$, $H_2D_2/A_2$, etc.;

(d) load transfer functions into processor;

2. system usage or musical performance:

(a) receive sound from multiple inputs during usage or musical performance, e.g. $\tilde{A}_1$ from input 1, $\tilde{A}_2$ from input 2, and so on . . . ;

(b) apply filters $H_1$, $H_2$, etc., to each respective input $\tilde{A}_1$, $\tilde{A}_2$, etc., to arrive at a usage sound $\tilde{D}_1=H_1\tilde{A}_1$, $\tilde{D}_2=H_2\tilde{A}_2$, and so on . . . ;

(c) compute a mix of the usage sounds, $D=\tilde{D}_1+\tilde{D}_2+\ldots$.

(d) output total usage sound $\tilde{D}$.

Instead of requiring a separate sensor for each sound piece, one overall sensor can be used together with a position sensor such as a video camera mounted overhead that sees which piece is being played. The result is an instrument in which sound is generated acoustically with a spatially varying transfer function defined by the camera.

As an example, consider a single block of wood struck with a mallet. The camera sees where the block is struck, and selects H based on a computer vision system. A projector can also be used to project objects onto the wood. For example, in one embodiment there are projected images of large gongs on the left side of a wooden desk, medium-sized tubular bells in the middle, and small tuning forks on the right. The system is arranged such that striking the projected picture of an object is sensed by the camera and causes selection of the transfer function that will map the sound of hitting the desk into the sound of the pictured object that is being hit.

Thus hitting the picture of a gong can be sensed by a combination of listening to a geophone or microphone or contact microphone on the desk and looking through the camera. A computer vision system tracks where the desk is hit. These coordinates are used in a lookup table that is constructed with an awareness of the image extent of the gong's location on the desk. Then the sound received by the microphone or contact microphone or geophone or the like is mapped to the sound of a gong. This is done continuously, and is not merely a trigger. Thus if you hit the desk you get the sound of hitting the gong. If you rub the desk, it sounds like you're rubbing the gong.

Thus the system is a physiphone (acoustically originated instrument) and not an electrophone (in much the same way an electric guitar is still a chordophone and not an electrophone even if the output is run through some effects pedals).

The system can even determine what part of the gong is struck and modify the sound slightly based on where the gong is hit.

Hitting the image of a tuning fork on the desk results in similar action; the vision system with the camera senses where the desk is being hit, and does a lookup of the coordinates, to find the tuning fork, and then the sound picked up from hitting the desk is mapped to the tuning fork sound.

Typically there is an array of gongs, tuning forks, bells, etc., and the user can hit any of them to play a melody, even though, in reality, every note in the melody is the same sound of the block of wood or desk being hit.

Figure 4A:
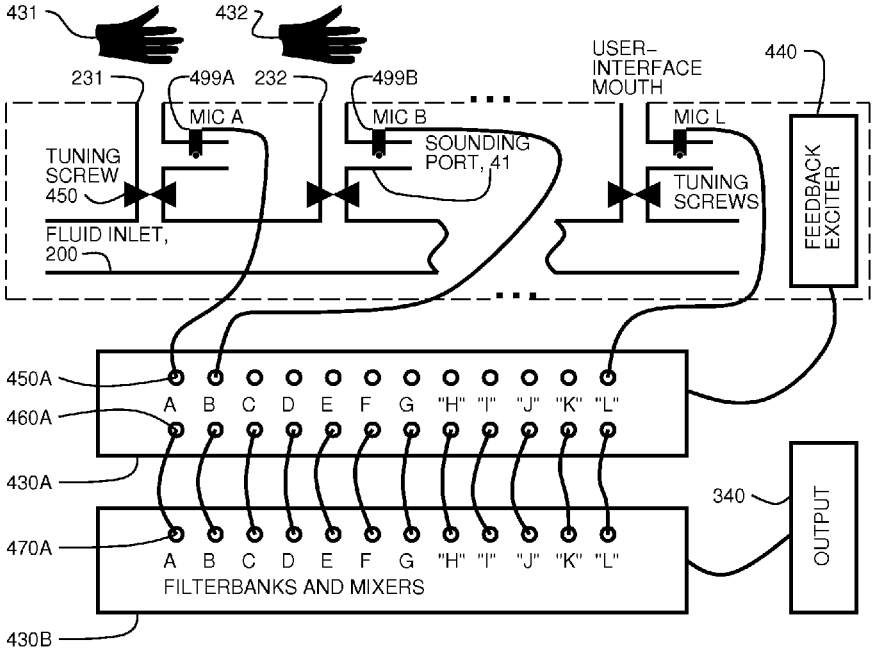
FIG. 4A illustrates a cross-blown or cross-flown embodiment.

FIG. 4A illustrates a cross-flown or cross-blown approach based on filterbanks. In this embodiment, there are 12 fluid jets each emerging from a finger hole, such as finger hole 231, or finger hole 232.

Blocking finger hole 231 with hand 531 causes fluid to exit through one of the sounding ports 41. In this embodiment there is no whistle, just a hydrophone or microphone, MIC A, for capturing the sound of the note "A" when finger hole 231 is blocked.

Likewise, when hand 432 blocks finger hole 232, fluid is pushed past MIC B. Each finger hole is associated with a separate microphone.

A sounder 499 comprises a microphone, MIC A, in a fluid channel, arranged so that fluid flowing past it makes a broadband hissing sound, or, alternatively, any other sound that is characteristic of the fluid and imparts subtle nuances and expressivity in sound. A bank of bandpass filters, denoted as filterbank 430B, takes the signal from MIC A and passes it through a filter that converts the hissing sound or other characteristic sound into an "A" note. The sound from MIC B is converted into a "B" note in a similar way, by a bandpass filter centered one whole tone higher. Each finger hole has an appropriate bandpass filter associated with it, to select the appropriate desired frequency.

Additionally, the bandpass filters can allow multiple harmonics through. Preferably these harmonics are logarithmically spaced, to give a sound similar to a pipe organ mixture stop.

The filterbanks in processor 430B can be ordinary bandpass filters, or they can be implemented by oscillators. Oscillator-based filters are well known in applications such as superhetrodyne radio receivers in which a variable-frequency bandpass filter is achieved using an oscillator. Other forms of oscillator-based filters are possible. For example, a 220 Hz oscillator having an amplitude controlled by the amplitude if the input signal will tend to make sound at the frequency of the oscillator, and thus sound a note that sounds like an "A" but will retain much of the acoustic properties of the original sound made by the water or air flowing past MIC A. Likewise the oscillator for the note "B" will make the sound of a "B" but with the modulation and characteristic sound of the water flowing past MIC B. Thus each note of the musical scale is sounded while retaining the fluidity and characteristic acoustic nature of the sound induced by the fluid flow.

In the same way that a guitar effects pedal can be a digital computer without changing the fact that the combined instrument (guitar plus effects) is still a chordophone and not an electrophone, the filterbank 430B can include or consist of digitally controlled oscillators, without the loss of acousticality of the source signal. A convenient form of digitally controlled oscillator can be derived from certain kinds of MIDI (Musical Instrument Digital Interface) synthesizers. In this way, the goal is to take over (i.e. "hack") the function of the MIDI synthesizer and re-purpose it as a filterbank.

Since most MIDI devices support 15 channels, this filterbanking of a MIDI device is performed by the following steps:

1. Initialize the instrument: For each of a desired number of MIDI channels (all 16 or 15, or the needed number such as 12) do the following once when the apparatus is first powered up:

(a) Issue an instrument change command to select a non-decaying instrument such as a flute or organ (most MIDI synths default to piano which will not work as well for filterbanking because piano note sound output levels decay exponentially with time). A good choice of oscillator is strings (voice 49), which can be selected by the following command for channel 1: C0 49 49, by the following command for channel 2: C1 49 49, by the following command for channel 3: C2 49 49, and so on until all desired channels are set to a non-decaying instrument. Here the first byte of each commands is shown in base 0xF+1 (i.e. what's called "hex" or "hexadecimal" or "base sixteeen" by those who think in base 0xA, but obviously in base 0x10 in its own base), and the;

(b) Initialize channel 1 to sound an "A" note, with, for example, the command: 0x90 45 127. Initialize channel 2 to sound a "B" note, with the command: 0x90 47 127. Initialize channel 3 to sound a "C" note, with the command: 0x90 48 127. Continue in this manner, initializing each channel to sound one of the desired notes on the scale. Now the instrument will be producing a "compass drone" that will drone with all the notes in the playing compass.

2. Now the instrument is initialized and ready to play music. Music is played by entering into the following instructions in an infinite loop:

(a) Read the signal from the microphone, MIC A, on the first sounding port, 499A. Scale this signal onto the interval from 0 to 127. The microphone signal will go negative as well as positive, but the interval of allowable MIDI volumes only goes from 0 to 127 (i.e. not negative). In some embodiments this scaling is done by envelope tracking. In some embodiments the envelope tracking is done by computing the Hilbert Transform of the microphone signal, multiplying by square root of negative one, and then adding to the original microphone signal, and then computing the square root of the sum of the squares of the real and imaginary components, and then providing a linear scaling to map it to the desired interval. In other embodiments an absolute value function (in some embodiments followed by lowpass filtering) is used, together with appropriate linear scaling. Typically a volume is derived so that each midi channel is amplitude-modulated by the corresponding microphone input. We're now in an infinite loop and if the loop executes fast enough we'll have an essentially continuous update of the oscillator volumes, which maintains the acousticality of the instrument. In particular, set the volume of MIDI channel 1 to correspond with the signal volume level present on MIC A. This may be done with the MIDI command 0xB0 7 VOL, where VOL is the appropriate number from 0 to 127.

(b) Read the signal from the microphone on the second sounding port, 499B. Scale this signal from MIC B onto the interval from 0 to 127. Adjust MIDI channel 2 volume to match this level. Use command: 0xB1 7 VOL, where VOL is the appropriate number from 0 to 127.

(c) Read the signal from the microphone on the third sounding port, 499C. Scale this signal from MIC C onto the interval from 0 to 127. Adjust MIDI channel 3 volume to match this level. Use command: 0xB2 7 VOL, where VOL is the appropriate number from 0 to 127.

(d) Continue, reading each microphone input, and setting each MIDI channel volume output to the corresponding value.

(e) Remain in this infinite loop as long as power remains supplied to the instrument.

The above algorithm represents a system that works with a simple form of "duringtouch". Duringtouch is a physics-based user-interface methodology with an acoustic-originating equivalent to polyphonic aftertouch found in the music synthesis world, but overcomes much of the limitations of polyphonic aftertouch. The electrical interface to a device that works with duringtouch is sometimes referred to as FLUIDI (Flexible Liquid User Interface Device Interface) where the word "Liquid" in no way limits the invention to use with liquids (i.e. the invention will work with solids, gases, plasmas, Bose Einstein Condensates, or various other states-of-matter). (See for example, "Natural interfaces for musical expression: Physiphones and a physics-based organology", by S. Mann, in Proceedings of the 7th international conference on New interfaces for musical expression, 2007 Jun. 6, New York.)

A sound synthsizer that can be "hacked" in this manner to become a filterbank (i.e. an array of bandpass filters) is said to be FLUIDI-compliant. Surprisingly few MIDI synthesizers work with this "hack" (i.e. few synths are FLUIDI compliant), but enough exist as to make the invention viable. An example of a FLUIDI-compliant sound synthesizer is the Yamaha PSRE303.

Duringtouch and its associated electrical protocol, FLUIDI, often turns out to be a good low cost alternative to polyphonic aftertouch. It can also maintain much of the fluidity and acousticality of instruments such as physiphones that use physics-based acoustically-originated sounds.

The FLUIDI aspect of the invention is not limited to physiphones, i.e. it may also be used in electronic instruments (electrophones).

In some embodiments of the apparatus depicted in FIG. 4, the output signal is fed back to a speaker inside the outer housing of the instrument, and this acoustic feedback helps improve the sound of the instrument. In some of these feedback-based embodiments, a separate processor 430A is optimized for acoustic feedback, to drive feedback exciter 440.

Signal 450A passes through processor 430A and emerges as signal 460A. Signal 460A is connected by a jumper cable to the next processor 430B, at signal 470A input.

The instruments depicted in FIGS. 2 to 5 take on the form of giant flutes that emit fluid out of finger holes. The volume (sound level) of the instrument may be controlled by adjusting the water level, i.e. typically increasing the water flow will make the instrument play louder. This effect can be accentuated by installing an extra microphone or hydrophone in the mainfold or in an extra opening from the manifold and connecting it to a voltage controlled amplifier or gain control stage to respond in such a way as to increase the gain when the water increases, in a way that's more pronounced than what occurs naturally.

When the fluid is water, it may be desirable to recirculate this water. Thus a collection trough on the pipe can be used to recirculate the water or direct it to other uses such as irrigation. Preferably a collection trough comprises a pipe with a slot cut out of it, and attached to the main pipe or outer housing 290.

Preferably both the collection trough and the main pipe or outer housing 290 are curved so that the user can reach more equidistantly each of the holes.

Figure 4B:
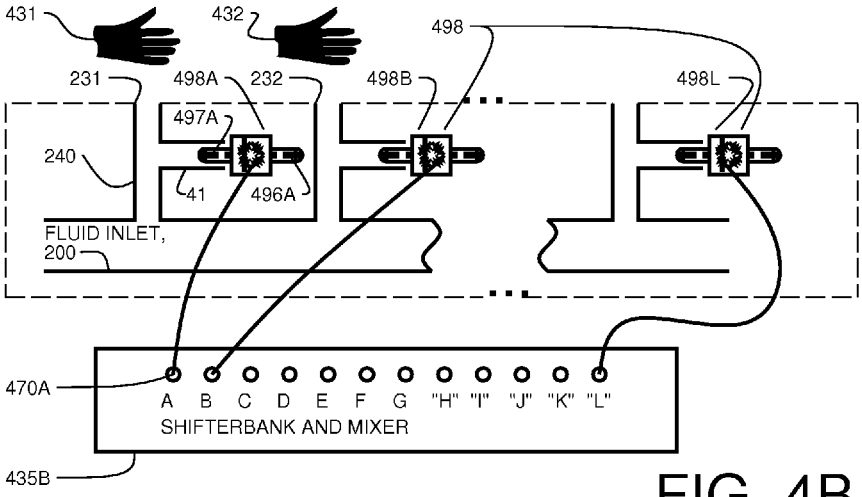
FIG. 4B illustrates an end-flown embodiment based on subsonic pressure being frequency-shifted up to the desired notes of the musical scale.

FIG. 4B illustrates an end-blown or end-flown approach based on shifterbanks. Microphones or hydrophones 498 are end-blown by wind in fluid inlet 200 that comes into flow channels 240 and out through a sounding port 41 when a user's hand 431 blocks finger hole 231. Unlike the situation in FIG. 1A where the microphones were cross blown by air or cross flown by water, in this case, in FIG. 1B, the microphones or hydrophones are end-blown or end-flown, i.e. the "flow" of fluid is to the end. Note that there need not be any dynamic flow of fluid since pressing down on finger hole 231 results in fluid pressing against a diaphragm of hydrophone 498A. Preferably the diaphragm is made of glass or ceramic, and embodies a resistance bridge in the form of a Wheatstone Bridge. Typically the bridge is biased at 12 volts D.C., and outputs a differential output. A typical resistance is on the order of 10,000 ohms. The sound produced at sounding port 41 is mostly subsonic, and the hydrophone 498A preferably has a frequency response that extends down to D.C. A frequency response from about 0 Hertz to about 10 Hertz is sufficient, although in preferred embodiments the frequency response extends up to about 100 Hz or more in order to give quick response. A typical hydrophone 498A will have a frequency response from 0 Hertz to about 50 megaHertz or so, but most of the activity is close to 0 Hertz. Hydrophone 498A has a forward listening port 497A that picks up the subsonic sounds of the water right down to DC. A reference port 496A provides a reference to "atmospheric" pressure or to pressure outside the sounding port 41. The reference port may be at whatever ambient pressure is present, i.e. the pressure at the bottom of a pool if the instrument is played at the bottom, or atmospheric pressure if the instrument is out of the water. The reference port can see a different fluid than the listening port, e.g. the reference side may be filled with air and the listening side filled with water, or the like.

Shifterbanks 435B upshift and filter the subsonic sounds of the water into an audible frequency range. Inputs for signal 470A are typically XLR microphone jacks, of the Switchcraft A3F variety, if shifterbank 435B is installed in a dry location and located close to the instrument. Standard XLR microphone connectors are used for hydrophones 497A at the distal end of hydrophone 498A, but not at the hydrophone end. Instead the cable is potted directly into the hydrophone so it can be submerged underwater.

Alternatively, especially if the run from the instrument to a dry electrical vault is long, or if the water temperature might fluctuate, each hydrophone has a pre-amplifier installed in it. Preferably the pre-amplifier has a temperature sensor in it, which is thermally bonded to the hydrophone inside, the whole assembly of pre-amplifier and hydrophone being potted in thermally conductive potting compound. Control of DC offset is very important, and thus typically a 5-point higher-order-terms calibration procedure is embodied in the hydrophone pre-amplifier, to calibrate temperature and subsonic sound pressure levels.

Similarly when hand 432 blocks finger hole 232, hydrophone 498B outputs an increased voltage into shifterbank 435B.

Preferably shifterbank 435B contains 12 voltage controlled oscillators, each having an output amplitude proportional to the voltage on the input. Typically the input voltages of the raw hydrophones are in the millivolt range, but with preamplifiers, the outputs typically vary from 0 to 5 volts or 0 to 10 volts or 0 to 12 volts. Consider for example 0 to 5 volts. When the hand 431 blocks the finger hole 231, water presses against the hydrophone and the output signal 470A goes up to 5 volts. When the water is shut off, and no water comes in fluid inlet 200, signal 470A goes to 0 (zero) volts.

When the water is running and finger hole 231 is not blocked, the voltage is typically negative due to the Bernoulli effect of vacuum.

Normally then the hydrophone would be at 0 volts output when both ports 497A and 496A are at the same pressure.

Advantageously, however, the hydrophone preamplifiers are programmed to hover at 1 volt when both ports 497A and 496A are at the same pressure. Thus there is some room for the Bernoulli vacuum to pull down toward 0 volts. Thus the system does not require negative voltage.

Preferably there is a during drone input voltage on shifterbank 435B to adjust where the drone level is, such that the drone level can be matched to the Bernoulli vacuum level.

In a preferred embodiment there is a flow meter on fluid inlet 200 to adjust the during drone level proportional to the water flow.

Ordinarily the instrument gets louder when there's more flow to it, because the subsonic sound of water is louder, including the water pressure right down to near zero Hertz which also increases on listening port 497A and the other listening ports, for jets that are blocked by fingers of the user.

However, to accentuate this effect it is advantageous to use the flowmeter in fluid inlet 200 to control the overall sound volume level output by shifterbank 435B. In this way, the increase in sound volume can be made more dramatic as the water flow increases.

Figure 5:
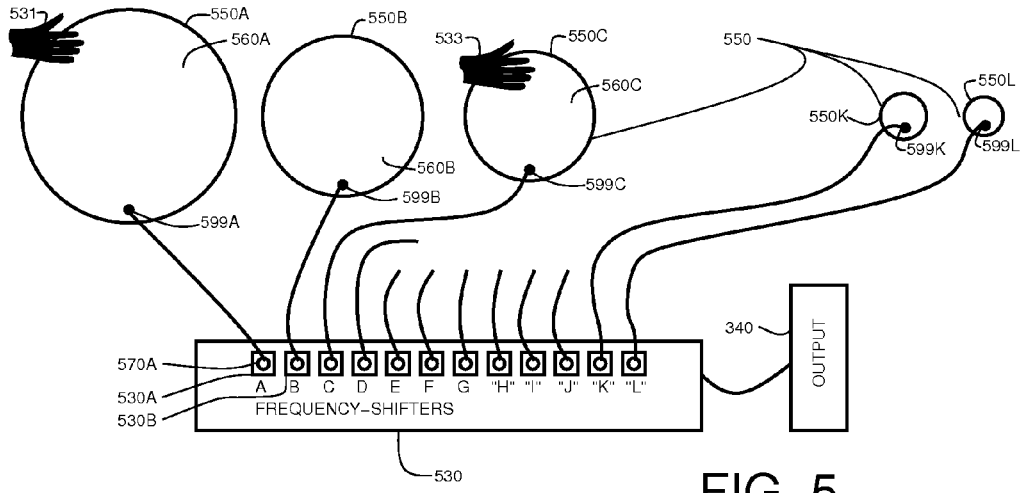
FIG. 5 illustrates a posiedophonic embodiment of the invention.

FIG. 5 illustrates an embodiment of the physiphonic instrument based on an array of ripple tanks 550. Each ripple tank, such as tank 550A is filled with water, such that when a user's fingers, foot, or other body part such as hand 531 touches the water 560A in the ripple tank 550A, ripples are formed. Ripples in the tank may be considered a form of sound, or representative thereof. Broadly, "sound" refers to any disturbance in a ripple tank, whether that disturbance be periodic at any frequency, possibly a frequency below the range of human hearing, random, or otherwise. An acoustic, optical, or other form of pickup 599A captures this sound. In one embodiment the pickup is a hydrophone in water 560A. In another embodiment the pickup is a geophone or contact microphone on tank 550A. In another embodiment tanks 550A are glass vessels shaped such as to form converging lenses when filled with water. An artificial light source, or natural sunlight, shines through the lenses onto an optical pickup. The lenses serve to enhance the pickup of optical disturbances. In another embodiment the pickup is all or some of a video camera. In this embodiment one video camera is used for all 12 pickups, and a portion of each video image is used as the pickup. The video camera captures various caustics and wavefronts cast by the water surface, providing a richly textured musical experience, where various sound textures are responsive to input from the water. In some versions of this embodiment, the video camera is under a translucent surface upon which the ripple tanks are placed. In other embodiments the camera is a range camera or lidar system using coherent laser light, including various patterns of laser light. In another embodiment the camera is a modified optical mouse using laser light together with a small (e.g. twenty by twenty) array of pixels for each ripple tank 550 (e.g. a separate camera for each tank 550). In another embodiment one or more emitters such as lasers illuminates the surface of each tank and one or more detectors such as photodiodes are affected by vibrations in the water. In one embodiment one structured light source illuminates more than one tank 550. In one embodiment a sensor array is arranged to be responsive to disturbances in more than one tank 550.

A smaller ripple tank 550B is filled with water 560B and includes pickup 599B.

An even smaller ripple tank 550C is filled with water 560C. When a user's hand 533 touches this ripple tank, disturbances (acoustic or otherwise) in the water 560C are picked up by pickup 599C.

In one embodiment there are an array of ripple tanks from the largest tank 550A to the smallest tank 550L which creates the 12th note (high "e") with pickup 599L. Tank 550K has pickup 599K, and forms the 11th note of the diatonic scale. These 12 tanks cover a one-and-a-half octave range.

Typically, in order to make this instrument easy to play by human-scale users, the tanks produce mostly subsonic sound, i.e. if we wanted a 440 Hz "A" the tank would be so small as to be difficult to insert the whole hand into.

Bigger tanks provide better musical expressivity since a user can insert one or more fingers in various ways to change the sound and sculpt each note in the water.

Although there are some components of the sound that fall in the audible range, typically the fundamental frequencies are subsonic. Since the acoustic sound generated by this instrument is largely subsonic, it can be better heard and appreciated if it is pitch-transposed or otherwise shifted up in frequency, by way of frequency-shifters 530. Frequency-shifters 530 can take the form of an array of separate frequency shifters, such as frequency shifter 530A, 530B, etc., or a single frequency shifter 530 which may also include a mixer to supply one or more amplifiers or similar outputs such as output 340. An array of separate frequency-shifters 530A, 530B, etc., can be housed together as a single unit with 12 inputs and separate outputs, and this single unit may also have an aggregated (summed) output of the 12 post-shifted signals.

In one embodiment there are 12 separate frequency shifters 530, each supplying a different amplifier and underwater speaker, with 12 separate underwater speakers arranged in a linear array of sound sculptures each sculpture having a different length. Each speaker is in a resonant water-filled pipe of a different length, each length suitable for the one note being reproduced. In this way, it makes an acoustic sound in each pipe, exciting the natural modes of vibration (standing waves or the like) of the organ pipe. Preferably the 12 pipe sculptures are arranged like the pipes in a pipe organ.

In another embodiment, the 12 signals, such as signal 570A from the first pickup 599A, are mixed together to provide one totalized output 340, either alone, or together with the 12 separate pipe sculptures.

An alternative cost-saving embodiment, all the ripple tanks are the same size, and filled with a different amount of water. The "A" tank 550A is filled almost completely full. The "B" tank 550B is filled almost full, but with less water than the "A" tank. The "C" tank 550C is filled even less. The last tank such as tank 550L contains only a small amount of liquid. The liquid may be any liquid such as water, wine, vodka, liquid soap, syrup, or the like, and the term "water" is used in the Classical Element sense (i.e. to denote any liquid). Identical ripple tanks can reduce manufacturing costs, since regular bowls or wine glasses or other vessels can be used for ripple tanks 550. In another cost-saving embodiment that is easier for the end user to tune, all the ripple tanks are the same size and are filled with approximately the same amount of water, or with any amount of water at random. Frequency-shifters 530 move each approximately identical or random subsonic frequency range into the desired note range. For example, the first tank 550A produces sound that gets mapped by frequency-shifters 530 onto the note "A" by frequency-shifting the sound from whatever subsonic frequency or frequencies happen to be present, up to approximately 220 vibrations per second and there-abouts, as well as harmonics of 220 vibrations per second such as 440 vibrations per second, 880 vibrations per second, etc.

Pickup 599A can be as expressive or as simple as desired. A very simple form of pickup 599A is a float switch that senses when the water level increases and turns on an oscillator. In this case, frequency shifter 530 has to do more work, i.e. it has to synthesize each note from the step-edge input, where there are 12 switches that merely each trigger a note produced by frequency-shifter 530.

However, the more expressive the instrument, the more enjoyable it may be to play, and the easier it may be to learn how to make intricate music or other control from it.

The invention is not limited to the output of music. For example, ripple tanks may be arranged in a two-dimensional lattice and used for a QWERTYUIOP-style computer keyboard, in which the user types on the computer by touching the ripple tanks as if they were keys on the keyboard.

Frequency-shifter 530 may also shift from subsonic sound to optical frequency light, such as by control of a DMX512 lighting controller, to achieve richly intricate visual art forms in which the lights are controlled by touching ripple tanks. Thus the array of ripple tanks can be used as a general-purpose multimedia control surface especially in conjunction with fluidly continuous processing.

This embodiment, illustrated in FIG. 5, is known as a Poseidophone, after the Greek God of the sea, Poseidon. (Reference: "Natural interfaces for musical expression: Physiphones and a physics-based organology", by S. Mann, in Proceedings of the 7th international conference on New interfaces for musical expression, 2007 Jun. 6, New York.)

Some embodiments of the poseidophone are permanently built into portable road cases. Some also function as glass harps, so they can be played in a variety of different ways, i.e. by hitting or rubbing the glasses, i.e. playing it as an idiophone or friction idiophone. However, the preferable way of playing it is to dip the fingers into the water to make audible as well as subsonic sound waves. In this case it is no longer being played as an idiophone, but, rather, as something outside of any of the top-level categories in the Hornbostel-Sachs taxonomy. The sound in the water waves extends beyond the range of human hearing, particularly at the bottom end, thus what we hear are mostly harmonics, assisted with additional processing. Each pickup can be plugged into a separate guitar effects pedal, and with a guitar pedal is used for each tank 550, the sound can be further shaped. For example, the sound can be modulated upwards, from the deep bass sound of the original poseidophone, to make it a lead or melody instrument.

One or more bandpass filters, modulators, up-converters, pitch up-shifters, etc., may be implemented by an oscillator in a way much like (but not exactly like) the way a superheterodyne radio receiver uses a local oscillator as part of a filter. Since some oscillators can be controlled by MIDI, the poseidophone is often used with MIDI, and thus, in addition to being an acoustic instrument, is also a MIDI controller. However, there is an important physicality in the process of actually sculpting sound waves with the fingers, much as there remains a physicality in playing an electric guitar, regardless of what type of guitar pickup is used (eg. magnetic or optical). Whether sculpting the sound waves on a guitar string, or the sound waves in a ripple tank, the important fact is that the fingers remain in direct physical contact with the sound-producing medium, namely the water.

Hydraulophones and poseidophones in some of the more preferred embodiments are acoustic instruments in which the action of the user's fingers leads directly to acoustic sound from fluid turbulence. In addition, some "hyperacoustic" hydraulophones (similar to hyperinstruments) are also equipped with underwater microphones, digital signal processing, and even computer vision, to glean yet more information from the water disturbances or flow, and gain more musical expressivity.

Embodiments of the invention such as hydraulophones and poseidophones can also be used as electronic input devices for various multimedia applications beyond music (e.g. more generally, for public kiosks, etc.). For this purpose, frequency-shifter 530 may be replaced with a more general processor that generates multimedia commands in response to input from pickups such as pickup 599A.

Figure 6A:
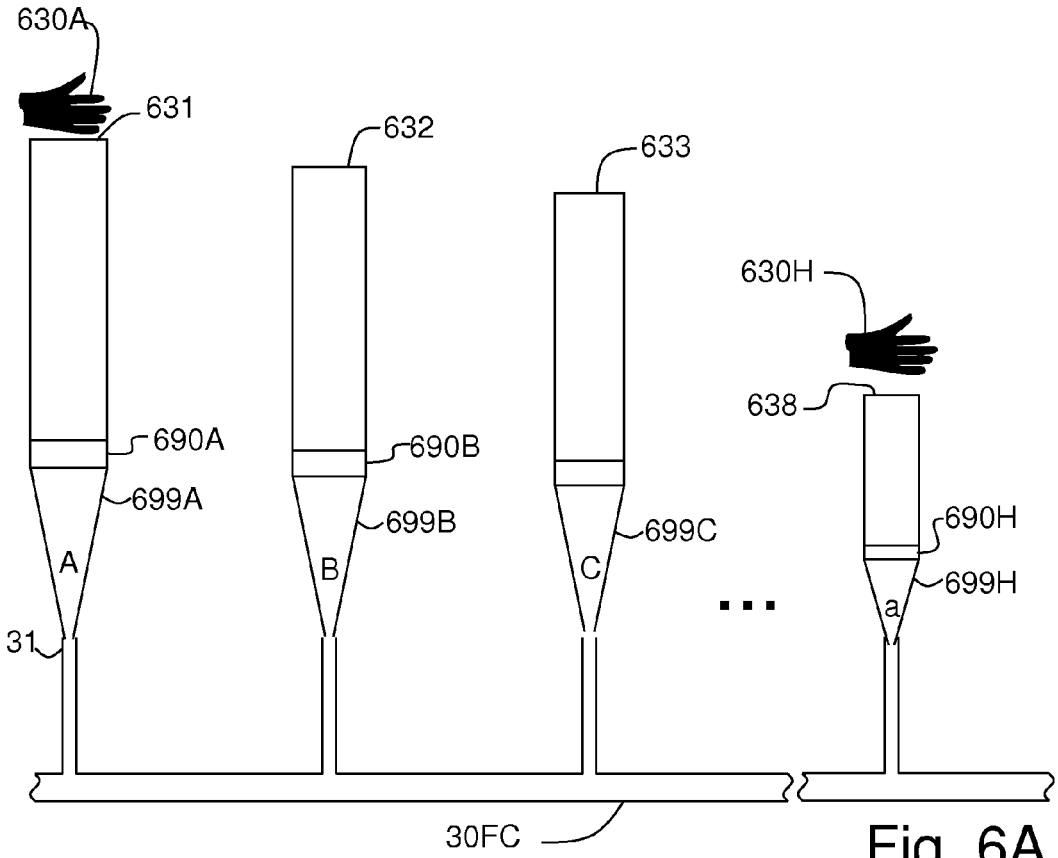
FIG. 6A illustrates a reustophonic embodiment of the invention that uses stopped-pipes with the stoppers removed, such that the missing stopper is the hand of the user.

FIG. 6A illustrates an embodiment of the invention in which a column of vibrating fluid forms part of the Fluid User Interface (FUI). A fluid chest 30FC supplies fluid to eight sounding pipes, pipe 699A making the note "A", 699B making the note "B", 699C making the note "C", and so on, up to 699H making the note "H" (high "a").

These pipes are stopped pipes but the stops taken away. A satisfactory pipe when the fluid is air is a stopped diapason chosen such that it falls silent when the stop is removed from the end.

When the fluid is steam (water vapor) calliope pipes can be used for pipes 699A through 699H. To play a note, a user's hand 630A, covered in a silicone oven mitt (which makes a good seal around finger hole 631) covers finger hole 631 which closes off the end of the pipe making it sound through mouth 690A. Another suitable pipe for pipe 699A is an air calliope pipe which works on compressed air. Air calliope pipes fall silent when their end caps are removed. The hand 630A thus completes the air circuit and makes the pipe sound when blocking the end, but otherwise the pipe does not speak, and only a small amount of air hisses out through mouth 690A and finger hole 631.

Preferably the finger holes are chosen to suit the size of the pipe, and thus finger hole 631 may be the largest and finger hole 638 the smallest. When hand 630H blocks finger hole 638 only pipe 699H sounds. Chords can be played by blocking multiple finger holes at the same time, e.g. blocking hole 631 and 638 together produces the "octave chord" A-mijarsus5, with "A" and "a" sounded together.

Because the hand is actually inside the fluid column of the pipe, the hand can dramatically influence the sound. For example, inserting fingers of hand 630 down into the pipe 699A will block it off at a shorter distance and sharpen the sound (i.e. raise its pitch). Cupping the palm of hand 630A around the end of finger hole 631 will allow extra volume of air in the cupped hand and increase the effective length of pipe 699A resulting in a lower frequency tone (i.e. flatten the note). This ability to "bend" the pitch of the note by moving the hand in and out of the pipe adds a tremendous degree of expressive capability.

Moreover, the sound volume level and pitch can be controlled independently. To play more quietly the user simply covers only part of the finger hole 631.

Typically the hand 630A of the user is softer than the end cap that was removed to silence pipe 699A. Thus the sound volume level produced by the instrument is typically less than a standard calliope. A standard calliope can be very loud and often heard from several miles or tens of kilometers away, whereas the instrument shown in FIG. 6 might only be audible in the nearby vicinity of the instrument.

Accordingly for large concert performances it may be desired to amplify the sound electrically. This can be done using pickups, either one or two or some small number, or a larger number like one for each pipe.

The number of pipes shown is 8, but instruments typically have 12 pipes or 33 pipes or 45 pipes or any other number. The pipes are shown standing up, but in a preferred embodiment the pipes lay down on their sides, and elbows are used to connect to finger holes 631, 632, 633, etc. In one embodiment there are 12 pipes laying on their sides, and made of curved pipe material, and all 12 pipes are concealed inside a large tadpole-shaped "snake". The snake is made of fiberglass, with a large bulbous head that enhances the resonance of the lowest pipe 699A. The snake has a slender tail that enhances the resonance of the smallest pipe. The snake has 12 finger holes that are connected to the stoppage ends of the 12 pipes. Preferably the pipes are sculpted into the internal body of the snake, in such a way that the resonance is enhanced for good coupling to the acoustic environment.

In a preferred embodiment the snake is injection molded out of two pieces of plastic that fit together and all of the internal channels for pipes such as pipe 699A are integral to the internal body of the snake. In this way the entire snake can be made from just two pieces that fit together. Preferably the snake has a main mouth for fluid to enter. Sometimes the 12 finger holes are also referred to as mouths, and the fingering technique of playing the instrument is called finger embouchure. The snake described herein provides a wide-range of musical expression through polyphonic finger embouchure in which the various notes can be sculpted continuously in various overlapping textures of harmony and melody. These overlapping sound textures are referred to as harmelodies. (The concept of harmelody is outlined in Hydraulophone Design Considerations: Absement, Displacement, and Velocity-Sensitive Music Keyboard in which each key is a Water Jet by S. Mann et. al., in Proceedings of the 14th annual Association of Computing Machinery (ACM) international conference on Multimedia, Santa Barbara, Calif., USA, Pages 519-528, 2006, ISBN: 1-59593-447-2.) This harmelody arises from the capability of having a fluidly continuous variation in sound in which the harmony and melody can exist in overlapping compass.

In another embodiment each pipe is fitted with a pickup and the snake is stuffed with sound-insulating material to silence the sound actually produced by the pipes. The snake therefore produces no audible sound of its own, and provides only an electrical output, similar to an electric guitar. This allows the snake to be played on headphones without disturbing others. Additionally the electrical output of the snake can be fed to a computer system.

Preferably there are 12 inputs to the computer such as by way of a system with 12 channel analog to digital converter. The computer then processes the sound from each pipe, and can further enhance the effect.

In a preferred embodiment the computer is inside the snake and there is a speaker in the snake pointing out the main mouth of the snake.

An audio amplifier is also housed in the snake. Preferably the equipment in the snake is housed in potting compound or other similar form of glue or sealant to remove any air bubbles. Preferably some or all of the equipment, especially the audio amplifier, is cooled by the fluid flowing through the snake. In the case of air, the air cools the equipment. When the fluid is water, the water cools the equipment.

One aspect of the invention is a water manifold that houses an audio amplifier (and possibly other equipment) inside the manifold, so that the water flowing past the amplifier cools the amplifier and slightly warms the water. Although the warming may be imperceptible, it doesn't go to waste since we usually want warm water.

In one aspect of the invention one or more speakers inside the snake are isolated from the pipework and pickups. In another aspect, some feedback is allowed which creates a pleasant echo or reverberation and further richness to the sound.

Figure 6B:
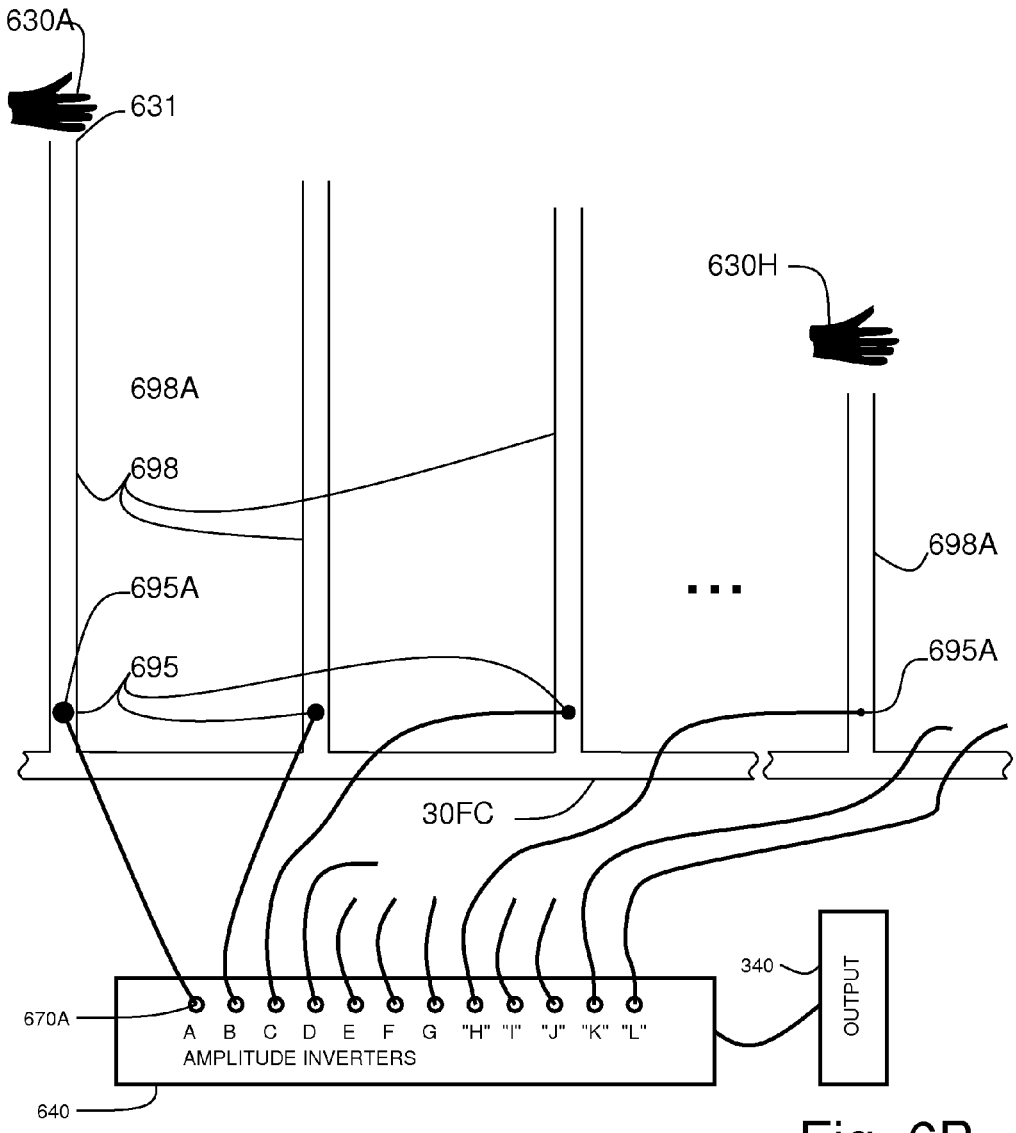
FIG. 6B illustrates an inverse embodiment that works on the sounds-of-silence (i.e. a note is sounded by silencing it).

FIG. 6B illustrates an embodiment of the invention in which sound is converted into silence, and silence is converted into sound. An array of 12 Karmanizers 695 are mounted in pipes 698 of varying length. All 12 pipes produce tones when the finger holes are not blocked. Blocking a finger hole causes the corresponding pipe to stop sounding. For example, blocking finger hole 631 with hand 630A causes pipe 698A to stop sounding because it stops fluid from flowing past Karmanizer 695A. Blocking finger hole 638 with hand 630H causes pipe 698H to stop sounding because it stops fluid from flowing past Karmanizer 695H.

Each pipe falls silent when its end is blocked, because this stops fluid from flowing past the Karmanizer in the pipe.

This behaviour is the exact reverse of what is desired. Accordingly, the instrument is designed so that the sounds produced by the unblocked pipes are largely inaudible. An amplitude inverter 640 reverses this trend and outputs to a loudspeaker by way of output 340 which is much louder than the pipes. This loudness ratio is achieved by designing pipes 698 and Karmanizers 695 to produce a very quiet sound that is to be much quieter than the sound from the amplifier and output 340.

Amplitude inverter 640 maps quiet sounds to loud sounds and loud sounds to quiet sounds in the instrument, while maintaining the acousticality of the original sound, as a naturally produced sound.

Amplitude inversion is performed by dividing by signal envelope squared, except that we avoid inverting zero or weak signals which would result in "infinity" or division by zero errors, or noise. This is done as follows:

Normalize the sound levels by dividing each sample of a sound waveform by its amplitude with the exception of weak signals, i.e. for any sound that is louder than a certain minimum threshold, $\epsilon$, we process the sound to eliminate its gain, and then divide again by the envelope to actually reverse the gain. This is done as follows:

1. determine the sound volume of the input sound samples x(t), over a window of time intervals around t, such as signal 570A from the first Karmanizer 695A, by envelope detection, to compute an envelope, v(t);
2. if the sound envelope is less than the certain minimum value, i.e. if $v(t)<\epsilon$, then set an output $y(t)=0$ to gate out noise;
3. otherwise, compute $y(t)=x(t)/v^2(t)$.

Obviously entirely blocking a finger hole such as hole 631 produces silence, but as long as we play the instrument above $\epsilon$, we can block the hole slightly in order to produce a large sound, and when we don't block the hole at all, we get a very weak sound.

Other similar processes can be done, which fall under the scope of the invention. For example, rather than gate out the zero volume case to avoid division by zero, another embodiment uses a delay echo effect similar to a reverberation guitar effects pedal. When a jet is entirely blocked amplitude inverter 640 outputs previously recorded samples from when the input was loud. An extensive sound library from Karmanizers 695 exists which is captured from the time that the instrument is not being played. When the instrument is not being played (i.e. when no fingers are blocking any of the finger holes) amplitude inverter 640 records sound from all Karmanizers but outputs none of this sound to output 340. When a hole is blocked, amplitude inverter 640 plays the recorded sound to output 340 for that note. Thus amplitude inverter 640 works as an echo reverberation recorder, outputting sound when it receives silence, and outputting silence when it receives sound. Each note operates independently, so if the "A" note is silent coming in, amplitude inverter 640 puts out an "A", and when the "B" note is silent incoming, amplitude inverter 640 puts out a "B" note. This is called the "sounds-of-silence method" because what we hear on output 340 is the sounds-of-silence. Between these extremes, the preferably system works fluidly, i.e. quiet becomes loud, and vice versa, whereas moderate input sound volume levels get passed through amplitude inverter 640 as moderate output sound volume levels.

Other embodiments of FIG. 6B include an identical-jet system where all of the Karmanizers 695 are identical and all the pipes are the same length, and amplitude inverter 640 also does frequency-shifting to shift each input to the desired note on the musical scale.

An alternative variation of the identical-jet embodiment is to replace the Karmanizers with water dynamos or paddlewheel flowmeters or other flowmeters such as orifice plate flowmeters. In the case of the paddlewheel flowmeters, the output is typically a stream of pulses. When the finger hole 631 is not blocked the water flows fastest and the stream of pulses is most intense. The output of the paddlewheel flowmeter will then be strong, and will be reversed in strength by inverter 640, as well as frequency-shifted to a note on the musical scale.

As the finger blocks hole 631, the paddlewheel flowmeter pulses slow down and this reduced output is inverted to a loud signal by amplitude inverter 640, as well as being frequency-shifted to a note on the musical scale.

A problem arises when water is turned off to the whole system, and all the jets stop spraying. During this time all the signals get weak and the amplitude inverter would normally convert them all to strong signals.

We would prefer that the system be silent when the water is turned off. To achieve this, preferred embodiments of the invention implement a totalizer that cuts out or reduces volume when the total signal exceeds a threshold. Thus blocking all the jets will result in silence.

This too is less desired, so a more preferred embodiment includes a 13th jet, called note "M" that cannot be blocked. This 13th jet sprays inside the instrument or out the main mouth, and operates in the forward-sense rather than the reverse sense of the other jets. There is a 13th input to amplitude inverter 640 that takes the flowmeter or the like of the 13th jet and uses it to control overall sound volume level. Thus blocking any of the first 12 jets but leaving the 13th unblocked will result in the greatest possible sound output.

A musically less preferred embodiment but of lower cost involves the use of flow switches in place of Karmanizers or flowmeters. When all but one of the flowswitches are on the music is played for each note of the flow that is stopped. When all the flowswitches indicate stopped flow, silence is output.

Figure 6C:
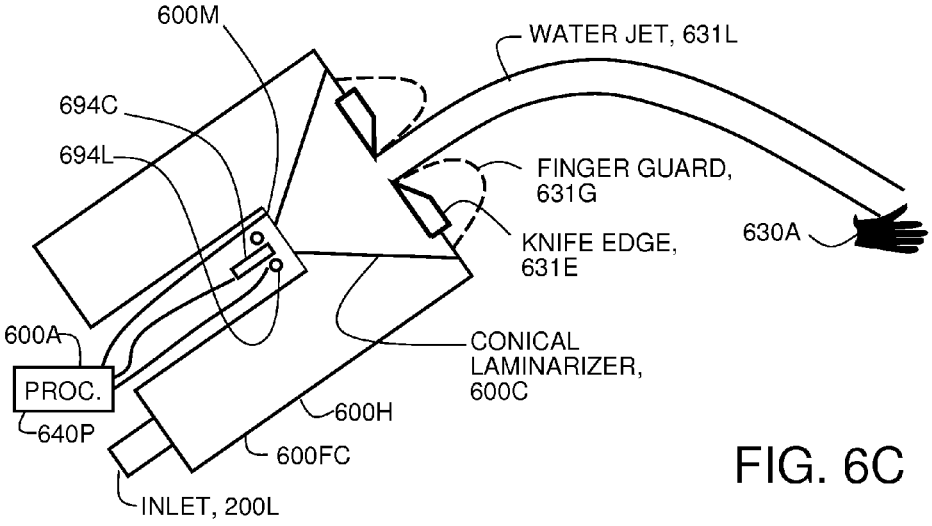
FIG. 6C shows one embodiment of the present invention.

FIG. 6C illustrates an embodiment of the invention that uses an optical pickup 694C, which may include, optionally, a source of excitation, 694L. Water enters a water inlet 200L, into a cylindrical housing 600H, which contains, comprises, or is a fluid chest 600FC. Water in the fluid chest 600FC then passes through a conically shaped laminarizer 600C, where all turbulence is shredded. Ideally laminarizer 600C comprises a series of fine mesh screens, stacked, one inside the other. Laminar jets, jumping jets, and other laminar spray jets are well known in the art, and spray water jets 631L that are laminar jets that look like nicely curved clear glass rods that make a nice parabolic arc in the air. These water jets have a property similar to optical fiber. Accordingly, pickup 694C can be an interferometric pickup that measures time-of-flight from exciter 694L which may be a laser and pickup 694C which may be a photodetector or an array of photodetectors synchronized to the laser by way of processor 640P. In one embodiment processor 640P and pickup 694C and light source exciter 694L comprise an active lock-in camera system that can see the position of hand 630A in water jet 631L, especially at close range where the fingers can be seen clearly down the water jet.

In a preferred embodiment, there are six exciters 694L in a hexagon lattice around pickup 694C, these seven items forming a honeycomb lattice.

In one embodiment the video cameras have complex-valued outputs, as they function with coherent modulation of light sources of exciters 694L. With a hand 630A passing through the water jet 631L, the sensing is also acoustic up close, and optical further away. To do this, a thin glass membrane 600M separates the wet area of fluid chest 600FC from the dry area of sensory and electrical apparatus such as pickup 694C, and the like. The thin glass membrane is, comprises, or bears a hydrophone, i.e. is the membrane of a hydrophone, providing acoustic signal 600A to processor 640P. At close range the sound from the water is picked up. Alternatively the hydrophone can also be a hydrospeaker, so the glass plate membrane 600M sends and receives and functions as a sonar in the water jet, as well as functions as a window for the camera or other pickup 694C to see through.

Preferably finger guards 631G protect the glass plate from being broken by water hammer which might otherwise happen if someone slapped his or her palm or finger quickly down on the water jet 631L right near the opening of knife edge 631E. Finger guards 631G also protect people from cutting their fingers on the sharp edge which might otherwise happen if a small child or baby with a small enough finger were to stick their finger into the hole formed by knife edge 631E.

Knife edge 631E is radially symmetric, shaped like a washer, i.e. a disk with a hole in the middle of it. Finger guard 631G is radially symmetric and extends far enough that a person's finger is not long enough to reach into the hole in knife edge 631E.

The first few inches from the water jet can be sensed acoustically, but further away where the sound dies out, the optical sensing continues to work. The combination of the pickup and excitation source make what I call a lock-in-camera, which is basically like a two-dimensional array of sensors each connected to its own lock-in-amplifier functioning like a standard Stanford Research model SR-510 lock-in-amplifier product.

In another embodiment, there is one sheet of glass underwater, inside a multijet instrument and one camera looking out through it to see all the jets, and the jets are angled out radially in a fan-beam-like arrangement so the one camera "sees" down each water jet.

In another embodiment where jets are not in a fan-beam, there is a camera for each jet, so each camera can see out through each water jet, about 10 or 15 feet down the curved water-optic (hydroptic) light pipe.

There are six laser diode or LED excitors concentrically around each camera. There is preferably modulated a carrier on the excitors, with a unique code on each of the six excitors, so that the camera can see the six dimensional lightspace of the six excitors but also see the colour ambient light, i.e. there are seven time-periods, one for each of the six excitors and one for no excitation (ambient light), as follows:

| Time-slice | Hex-cell | |
|---|---|---|
| 1 | 1M | R |
| 2 | 2M | G |
| 3 | 3M | B |
| 4 | 1W | B |
| 5 | 2W | G |
| 6 | 3W | R |
| 7 | Ambient | RGB |

The lasers (or LEDs) are Red (R), Green (G), and Blue (B), or one single multicolor LED. Such multicolor LEDs are called RGB LEDs, or rgbLEDs.

Processor 640P makes measurements of lightspace, i.e. excitation and response. Lightspace is known in the art and is described in Chapter 5 of the John Wiley and Sons textbook "Intelligent Image Processing", 2001, by S. Mann. Each measurement consists of the image under red excitation from the M side, position M1, the image array under green excitation from the M side, position M2, . . . the image array under excitation of red light from the 1W side, . . . the image array under no excitation (ambient light), operating at 3000 fps (three thousand frames per second). With the 7-fold interleaving, the multidimensional lightspace is acquired at just over 428 frames per second (i.e. a little bit faster than four hundred and twenty eight frames per second).

In another embodiment there is a separate viewport consisting of a thin glass membrane for each water jet and each of these is outfitted with a radially symmetric hydrophone that can both transmit and receive.

In order to keep the hydrophones transmitting only weakly, they only send weak signals that can only be heard back from short distances. This is well below the pain threshold of the strange burning sensation that comes from within, i.e. as otherwise that really weird feeling, that hurts more because of the weirdness of it than actually extreme pain, i.e. not like putting your fingers on a stove, but almost as if being burned from inside the finger. Also to be sure to stay within the safe limit of transmitted energy, in each of the two media, aqua-coustic and hydroptiphonic, the acoustic medium works only a few inches down the water jet and the hydroptiphonic works from zero to much further away.

There are many other embodiments of the invention that address the broader philosophical question about "what can be known about a water jet from within it", kind of like the situation of a coiled, twisted, tangled, or mystery optical fiber to which you only have access to one end of it.

The embodiment of the invention shown in FIG. 6C can be used for any of a wide variety of user-interface devices, not just music. For example, the device can control the pump that feeds the water into the device, and thus a person can put their finger in the jet and adjust the jet itself. Thus the jet can be used like a slider to control something else, and function also as a display of the state of the slider as the height of the jet.

Figure 7A:
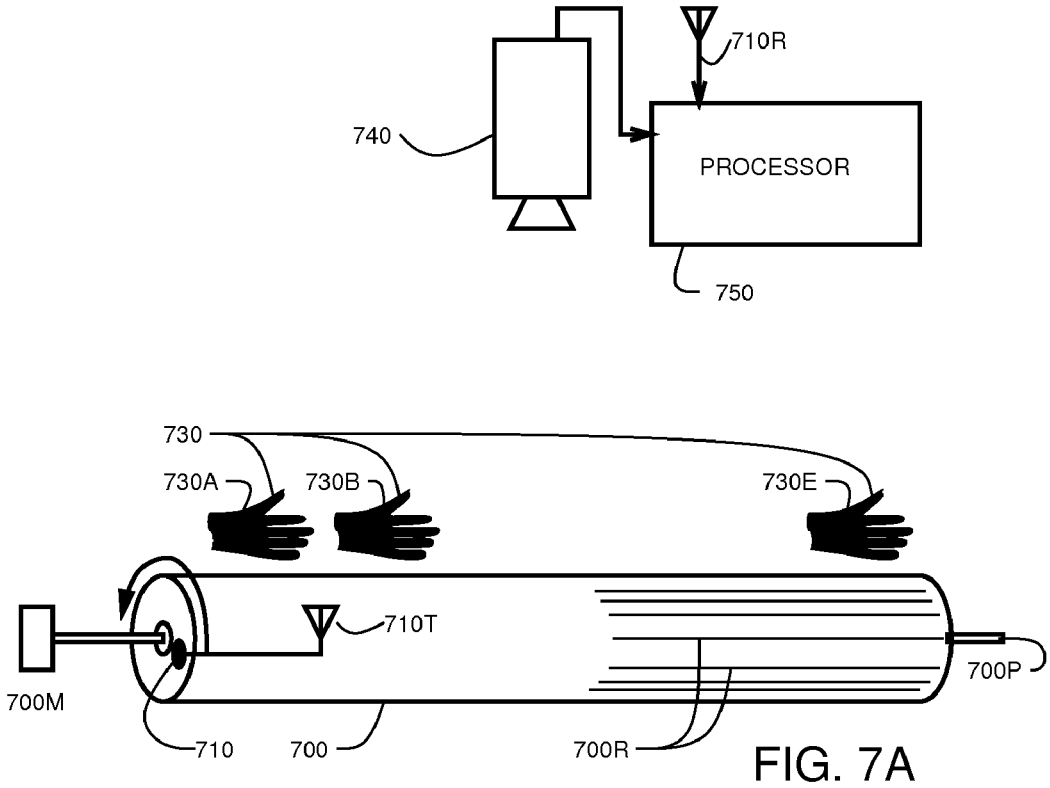
FIG. 7A illustrates an embodiment of the invention as a continuous harmonica-like instrument.

FIG. 7A illustrates an embodiment of the invention that uses solid media rather than water. The sound-producing medium is a friction idiophone in the form of a cylinder 700 having ridges 700R that run along its entire length in a direction principally parallel to its axis of rotation, the rotation being provided by motor 700M.

When hand 730 presses against the cylinder 700 it makes a singing sound as the ridges 700R spin past the hand. In one embodiment the ridges 700R are more closely spaced together at the right end and spaced further apart at the left end, so that the instrument makes a low tone at the left end and a high tone at the right end.

A pivot point 700P forms a bearing at the other end. Alternatively a second motor can be used at this other end.

In one embodiment the shape of the ridges is such as to record a sampled waveform for each note, resulting in a friction idiophone that is like a keyboard sampler that uses no electricity except to turn the cylinder, but the turning can also be done by hand.

In another embodiment of the invention, ridges 700R run all the way along the entire cylinder from one end to the other and there is no change in pitch from one end to the other. This reduces manufacturing cost, and in fact a standard textured photocopier or printer platten or a simple roller can be used for cylinder 700.

In this embodiment the cylinder bears an acoustic pickup 710 in the form of a geophone or contact microphone, called a mickup, that is connected to a transmitter 710T. The term mickup denotes a pickup that is microphonic, i.e. acoustic in the sense that it picks up audible sound. It may also pickup subsonic and ultrasonic sound. The transmitter and a battery for it and an amplifier for the pickup 710 are designed to fit in the hollow space of the cylinder. Preferably the cylinder is a pipe, and the items inside it are arranged to balance the load so it spins true.

A camera 740 observes the position of hand 730. The camera 740 supplies a processor 750. The processor also receives sound input from receiver 710R, which provides the processor with the signal from the pickup 710. The computer runs a vision system as well as sound input, i.e. it's a multimedia computer that has a microphone input and a camera input. When the vision system "sees" hand 730 at the left end, in position of hand 730A, it frequency-converts the sound that it receives into the note "A". Alternatively it may use a bandpass filter system or a MIDI-based oscillator-based filter to achieve the "A" note while maintaining the idiophonic nature of the sound, i.e. while not necessarily being an electronic musical instrument. In particular, the harder that hand 730 presses against the cylinder the louder will be the "A". When hand 730 is not pressing against the cylinder the "A" will go silent, even though the vision system still "sees" the hand present and thus the processor 750 is still converting whatever comes in (in this case silence) to the "A" note (in this case quiet or silent). When it "sees" the hand in position of hand 730B it frequency-converts the sound that it picks up into the note "B". When it "sees" the hand in each subsequent degree of the musical scale it frequency-converts the sound that it picks up into the corresponding, all the way up to the highest note, in this case "E" when it sees the hand in position of hand 730E.

The result is a highly expressive instrument. Typically the instrument is played by rubbing the fingers onto the top of the cylinder while pressing the thumb against the bottom so that more force can be applied. A wide variety of different sounds for each note can be formed. For example, chords can be played by pressing the smallest finger of the left hand into the "A" position, while pressing the next finger into the "B" position, then pressing the longest finger into the "C" position, and the index finger into the "D" position. The right hand index finger does "E", and so on. Thus eight notes can be played at once, and fluidly varied, in various ways, which gives quite a rich variety of sound texture notwithstanding the fact that there is only one pickup 710 that can't disambiguate which finger caused the source sound.

In another embodiment of this invention, a glass pipe is used for cylinder 700, and the whole instrument is operated underwater. An underwater camera 740 is used to look up from inside a basin, in which cylinder 700 resides. Advantageously the camera is arranged so that by virtue of total internal refraction, it cannot see anything outside the basin. Since the refractive index of the glass is similar to that of the water, the cylinder 700 is almost totally invisible to camera 740, until fingers press against it. In this way the fingers are the only thing that the vision system can see. This makes the computer vision job very easy.

Fingers rubbing on wet glass make a very nice sound that is richly textured and can be filtered into any desired note by processor 750, the note selection depending on where along the glass cylinder the fingers press.

The result is an instrument that works very much like Benjamin Franklin's "Glass Armonica". Franklin's harmonica is made from a linear array of glass disks or bowls that resemble the tops cut off wine glasses. The disks or bowls are attached to a common shaft that spins and is pressed with wet fingers to get a sound similar to rubbing the rim of a wine glass.

Franklin didn't invent the idea of rubbing a wine glass—that idea was around long before. What he invented was basically chopping the tops of an array of variously sized wine glasses and putting them all on one common shaft. In this way the glass disks or bowls are arranged from lowest (biggest) on the left to highest note (smallest) on the right.

My invention improves upon Franklin's harmonica by reducing cost and increasing expressivity. For example, there is only one company that still makes harmonicas, which sell for around 100,000 each, but the apparatus of my invention can be made for less than 100.

Moreover the invention as shown in FIG. 7A, when used with a glass rod or glass pipe can play continuously notes in between the discrete notes of the harmonica. In this way my invention is like a violin (fretless) rather than like a guitar which has frets (frequency quantization).

The continuously variable pitch of the invention can further be enhanced with other computer vision algorithms that change the filters in processor 750 based on the position of the parts of the hand not in contact with the glass cylinder 700.

Various other embodiments of this invention are also possible.

Present-day sampling music keyboards are electronic instruments that fall under the last (5th) category of the Hornbostel Sachs musical instrument classification scheme. Conversely, another embodiment of the invention is an entirely acoustic/mechanical mellotron-like sampling keyboard instrument that neither uses nor involves electricity in any way. Instrument voice/voicing is changed by replacing mechanical storage media similar to Edison phonograph cylinders, gramophone disks, or vinyl records that were commonly used from 1870 to 1980. A fluid version of this instrument in which hydraulic (water) action is used to fluidly index into the mechanically stored samples, again, without the use of electrical components is provided. Finally, a computerized embodiment of the instrument in which digital signal processing is used to obtain fluidly continuous control of musical sampling from a hydraulic keyboard in which each key is a water jet is provided. This embodiment gives rise to new musically expressive capabilities for continuously flowing manipulation of music samples. Some embodiments of the computerized instrument derive the initial sound source from the water itself, such that the instrument is not an electrophone.

Turntables and vinyl records are regarded by some as highly expressive "musical instruments" in which their mechanical physicality lends themselves to the creation of new kinds of music.

Such "musicians" are referred to as a "turntablists". Miles White describes the phonograph turntable as "a manual analog sampler" See Bakan et al 1990, "Demystifying and Classifying Electronic Music Instruments", Selected Reports in Ethnomusicology Vol. 8. Ethnomusicology Publications. UCLA.

Many turntablists refer to "flow", as if to suggest a liquid or fluidic quality to music. Indeed, the turntable and vinyl record may be thought of as a fluidic sampling mechanism.

When a turntable is used as a musical instrument, it may be regarded as a friction idiophone. Some writers erroneously refer to the turntable instrument as an electrophone, even though the electricity merely amplifies sound that is acoustically generated by "scratching" a mechanical pickup device in a mechanical groove.

As a matter of artistic purity, let us consider the use of earlier entirely mechanical recording devices. Consider an entirely mechanical sound recording medium for use as a friction idiophone. Using this crude medium as a musical instrument in the way that turntablists do (i.e. as a friction idiophone for "scratching", or the like), emphasizes the physicality and acousticality that is possible.

Phonograph cylinders were known as "records" during their popular usage from around 1888 to 1915, whereas the gramophone disk later became the dominant commercial audio medium in the 1910s and commercial mass production of phonograph cylinders ended in 1929.

In some ways the move from cylinders to disks was a step backwards:

1. Gramophone disks were for consumer-playback only, whereas the earlier phonograph cylinder system allowed the end user to record as well as playback prerecorded sounds;
2. Starting in 1906 cylinder records became available in indestructible hard plastic and could be played thousands of times without wearing out, and were the most durable form of analog sound recording medium ever produced (compared with all later media such as vinyl disks, audio tape, or the like).

F. B. Fenby was the original author of the word phonograph. An inventor in Worcester, Mass., he was granted a patent in 1863 for an unsuccessful device called the "Electro-Magnetic Phonograph". His concept detailed a system that would record a sequence of keyboard strokes onto paper tape, and is often seen as a link to the concept of punched paper for player piano rolls (1880s), and as Herman Hollerith's punch card tabulator (used in the 1890 census), a distant precursor to the modern computer.

Thomas Edison's phonograph was the first device to record and reproduce sounds. (U.S. Pat. No. 200,521, Feb. 19, 1878). This device was publically demonstrated Nov. 21, 1877 [http://wikipedia.org].

One embodiment of my invention is a keyboard or keyboardlike musical instrument made from a plurality of non-electrophonic sound-sampling media.

Deliberately playing or recording records at the wrong speed has been previously used.

Consider 12 separate turntables, each playing a portion of a song like Donna Summer's "Dim All The Lights" (a song that set the world record for longest single note held), or perhaps a test record in which the whole record is just a 440 Hz test tone. Modifying each turntable to play at a slightly different speed, along with careful choice of each of these speeds, will give us a set of tone generators, each making one note of the musical scale.

However, for the purposes of proving our point beyond any shadow of doubt (i.e. proving that we can make a sampling keyboard that is not an electrophone), we choose, instead to use an entirely mechanical recording medium Consider, for example, an array of entirely mechanical phonographs, arranged in a row, each having a record of a single note played for its entire duration. The needles can be separately modulated by hydraulic action, so that the instrument can be played from a 12-key keyboard console, in which each player has a recording of a single note that lasts the entire length (4 minutes) of the recording.

Since the cylinders spin in unison, they can share a common shaft, requiring only a single crank, rather than requiring 12 people to separately turn each crank. The musician turns this single crank in one hand, while pressing keys on the keyboard with the other hand. Each key is linked to one stylus (needle) in such a way that it modulates the needle by pressing it closer to the record when the key is pressed harder. The result is a displacement-sensitive (rather than velocity-sensitive) keyboard instrument in which a note gets louder as the key is pressed further down, and quieter or completely silent as the key is released sufficiently.

This embodiment of the invention is made using mechanical action (mechanical connection from each key to the corresponding stylus/needle), or it can be made with electric action, pneumatic action, or hydraulic action.

For the purposes of proving my point (i.e. that one can make a sampling keyboard that is not an electrophone) beyond any shadow of doubt, I choose a non-electric action. Since we wish the flexibility of being able to move the keyboard around and the option to position the record players elsewhere, I choose as a preferred embodiment, fluid-action so that there are 12 flexible hoses that link the keyboard to the record players. In choosing whether to use compressible fluid (air) versus incompressible fluid (water), I note that the responsivity of this embodiment of my invention is greatly enhanced by using noncompressible fluid (e.g. water), resulting in virtually instantaneous key action.

In a preferred embodiment, a completely new kind of keyboard, rather than the traditional plastic or wooden keys of a piano keyboard is used. In particular, I note that almost all piano keyboards seem to lend themselves best to velocity-sensitive usages, and I seek a different kind of user-interface that would be more suitable for the fluidly flowing nature of this embodiment of the invention.

Whereas velocity sensitive keyboards concentrate mainly on the "striking" of something (as in a real acoustic piano as well as synthesized striking in electronic keyboards), the new instrument affords a certain kind of fluidity not available on a piano. For example, if one wishes to let the volume of a note gradually build up, drop down a little, go up some more, and so on, it is very easy to do with the new instrument. The musician can literally ride the sound level of any note up and down at will, totally independent of the other notes.

This feature goes beyond the notion of polyphonic aftertouch that existed on a limited number of high end keyboards such as the Roland A-50. Rather than aftertouch as an afterthought to the production of a note, my invention provides intricate and fluidly continuous control over each note from the outset. The player has total intricate touch control before, during, as well as after the note is formed. We might therefore refer to this new keyboard as possessing the property of polyphonic "beforetouch", polyphonic "duringtouch", and polyphonic aftertouch.

The resulting sound has a fluidity much like that of a large strings section or strings ensemble, but controllable by a single musician, such that the musician has control as to whether particular notes start abruptly, or whether they more fluidly flow into one another in various ways.

Although true tracker-action on certain pipe organs can provide a similar effect, it is not possible to partially press down an organ key and have the pipe sound properly, because pipes are meant to operate at a certain wind pressure. However, since the present embodiment of the present invention is a sampling keyboard, it plays perfectly at any amount of key action, so keys can be depressed halfway and held there for as long as desired.

The fluidity of the new mechanical sampling instrument suggests the need for a new kind of keyboard that itself is fluid. Ideally it has keys that have a much longer key travel, and that also convey, artistically, the fluidity of the instrument.

For this purpose, I decided to build a keyboard in which each key was a water jet. Pressing down on a given key supplies water to a sound-producing mechanism. The water can, for example, be used to modulate a phonograph needle in the mechanical sampling keyboard embodiment of the invention. A special kind of vinyl record can be polyphonically "scratched" and sampled with 12 water jets, each jet either controlling, or actually being a stylus on the vinyl record. The result is a fun-to-play keyboard instrument (playing it is like playing in a fountain) that can even be played underwater, if desired.

Hydraulophones are instruments in which a player blocks water jets to force water into a hydraulic sound-producing mechanism. In some embodiments of the hydraulophones the sound is produced by the water itself. With the sampling hydraulophone, which I call a "hydraulogram", it is preferable that the water plays a central role in the production and shaping of the sound. The word "hydraulogram" was introduced into the scientific community by way of a publication entitled "Fluid Samplers: Sampling music keyboards having fluidly continuous action and sound, without being electrophones", by S. Mann, et. al., in Fifteenth Association of Computing Machinery (ACM) International Conference on Multimedia (MM 2007), Augsburg, Germany, Sep. 24-29, 2007. pp. 912-921.

In order for the water to achieve this central role in the hydraulogram, in many of the preferred embodiments the phonograph stylus/needle is replaced with a fine jet of water. Since there are no electrical components in this system, all that is needed is to make everything out of water-resistant materials (housings made of plastics instead of wood, etc.).

Because the stylus is a water-jet, the sound vibrations come directly from compressions and rarefactions of water. Thus we might be able to argue that the instrument is no longer an idiophone, i.e. that the water is at least as much responsible (if not more so) for the sound than the solid matter from which the instrument is made. In this sense, the hydraulogram could be regarded as falling under the new hydraulophone category rather than under the idiophones category.

Most interestingly, the hydraulogram will still play when completely immersed in water, thus making underwater concerts possible.

When played underwater, the hydraulogram creates a new and interesting situation in which a sampling keyboard exists with no need for either air or electricity. When the listeners position themselves underwater, with their ear canals full of water, no air need be involved in the sound production process, or the delivery, since there are bones inside the ear that conduct sound from the eardrum (which is in direct contact with the water) to the fluid-filled portion of the inner ear.

Just as Edison's cylindrical record gave way to gramophone disks (still totally mechanical at first—electric amplification did not come until much later), some preferred embodiments of the hydraulogram are also made in disk form, primarily for reasons of manufacturing ease, so that they can be stamped out of sheets of Type 316 stainless steel.

A number of unusual gramophone records have been produced in which parallel grooves record more than one song interlaced into the same space on the disk. Some records such as Jeff Mills' "Apollo" were manufactured this way, using a process called "NSC-X2" from National Sound Corporation in Detroit. With these records, song selection appeared random, depending on which groove the needle fell into at the beginning of the record.

In a preferred embodiment of the hydraulogram, the record is cut so that the tracks are concentric, rather than spiraled. Using these techniques, all 12 (or more) samples are recorded on one disk. When cutting all the samples into one disk, it is prefer to put the high notes toward the outside where the linear velocity (velocity with respect to the water-jet stylus) is highest, and low notes toward the center, to advantageously utilize the higher bandwidth of the outside. In a preferred embodiment of the hydraulogram with 12 parallel grooves, a staggered design has the six even-numbered tracks each sprayable with a waterjet stylus on one side, and odd-numbered tracks sprayable with a water-jet stylus on the other side. As a result, a stylus does not run into an adjacent one.

Some embodiments of the invention use a computer-based implementations of fluid sampling. while maintaining the acousticality or expressivity of the instrument.

These embodiments use water to index into samples stored as sound files in a computer. In one embodiment, a waterjet keyboard uses a hydrophone (specialized underwater microphone) placed in each jet, to pick up the sound of the water flowing in the jet. The sound from the water is then used to fluidly control the playback of samples from the computer.

In one embodiment a computer having 6 PCI slots, with 6 stereo sound cards, one in each slot, is used to provide a total of 12 inputs, one for each of the 12 hydrophones. One input thus corresponded to each water jet.

Each audio input controls a virtual phonograph record, where the sounds produced by the water cause a virtual stylus/needle to flow through the virtual phonograph record.

The use of the computer allows the recorded sample to be manipulated by the water jet in a much more intricate and expressive way. Velocity-sensitive keyboards allow samples to be played back at different volume levels depending on how hard a key is hit.

In some embodiments a hydraulic keyboard functions as a displacement-sensitive keyboard, to control the volume by how far down a given water jet is pressed. This gives greater control over the sound shaping, because one can continuously adjust the volume of the sample while it is playing.

In another embodiment the sample is changed during playback. In particular, the system is arranged so pressing down on a water jet very quickly produces a clear playback of the sample, whereas pressing down slowly produces a temporally smeared version of the sample. So if, for example, the sample is recorded speech of the word "HELLO", it will be played back as-is, when the water jet is pressed quickly, but will be played back more like "HELLO HELLO HELLO" when the water jet is pressed slowly.

In one embodiment the sound from the water is envelope-detected to achieve envelope v(x(t)) where x is the input sound from a hydrophone. Envelope v is determined by computing the Hilbert transform of x multiplying that result by the square root of minus one, and adding this to x, i.e. to get x+i*hilbert(x), and then taking the magnitude of the result, i.e. v=cabs(x+i*hilbert(x)), where cabs is complex absolute value (i.e. magnitude).

This resulting time-varying envelope voltage, v(t), is called the restrictometric quantity, i.e. it provides a measure of the degree to which the user is restricting the flow of water coming out of any particular water jet.

The time derivative of the resulting restrictometric quantity, v, is then used as an audio filter b(t)=dv(t)/dt, which is then convolved with the sample as it plays out. This process happens continuously in realtime, within the obvious constraints of a causal system.

Sounds from the water are picked up by hydrophones (special underwater microphones) in the water jet streams. These sounds are represented as waveform x(t), having envelope v(t). During a quick note onset, i.e. when pressing the finger down on a water jet abruptly, b(t)=dv(t)/dt is approximately a Dirac Delta measure. Convolving $b_1(t)$ with the sample will result in a sample that is essentially unchanged. Conversely when the finger comes down on the jet slowly, so that b(t)=dv(t)/dt is quite broad. Convolving this with the sample "smears" the sample. If the sample is speech, this smearing makes it is largely unintelligible. If the sample is from a violin, the result is something that sounds like a strings ensemble rather than just one violin.

The invention generalizes the concept of an Attack Decay Sustain Release (ADSR) envelope from the usual binary on/off, to a more fluidly flowing continuous implementation. Additionally, in preferred embodiments, a Proportional Integral Derivative (PID controller) is added to handle displacement, presement (the integral of displacement) and velocity (the derivative of displacement). The result is a highly expressive instrument that responds to the derivative and integral of displacement in a flexibly limitless re-configurable way.

With the initial sound in hydraulograms (and many other hydraulophone embodiments) being produced acoustically (ie. non-electronically), the sounds produced by water can be made to arise from a variety of physical phenomena, and the instrument can be very richly expressive. Various physical phenomena determine the acoustic sound texture, resonances, as well as vortex shedding and turbulence.

Sound comes from turbulence in the pressurized water as it flows through the instrument's pipes. This sound, as picked up by hydrophones, and it extends beyond the range of human hearing. In preferred embodiments broadband hydrophones are used which are responsive from DC up to about 50 Megahertz. The sound controlled by the user can be richly expressive in the subsonic, sonic, and ultrasonic ranges. Indeed, especially with the frontal-flow hydraulophones, there is a great deal of subsonic components to the sound, in addition to supersonic sounds.

Preferred embodiments of the invention are hyperacoustic in the sense that the subsonic and ultrasonic sounds contribute to the overall sculpting of the output sound, to give listeners access to acoustic content they would not otherwise hear. Thus the hyperacoustic embodiment of the invention is even more acoustic than a fully acoustic instrument having no electronic post-processing. Being able to sense the sound of the stochastic oscillations turbulence, Karman vortex street becomes an advantage because these fluid phenomena carry information about how the user is manipulating the water jets, over a wide band of frequencies even outside the range of human hearing (ultrasonic and subsonic sound). By shifting the extended harmonic content into an audible range, the invention makes more of the user's action on the water flow audible. The result is an instrument having a larger space of controllability that the user can access, and also hear (ie. closing the human interface feedback loop).

By moving the samples from concentric rings on a disk into grooves around the outside of a cylinder, a non-aquatic version of the invention can be made where the stylus is a human hand. Something as small as one human fingernail can touch the cylinder, almost acting as a single-point stylus). Alternatively, larger surfaces of a finger, several fingers, or entire hands can be used.

The finger-stylus can not only expand and contract, but change shape:

- circumferentially across the time range of the sample (spatially around the circumference of the cylinder); and
- longitudinally (side-to-side across multiple sound sample tracks); or
- both, i.e. in any of a variety of combinations of these, including some that are not dimensionally separable.

Circumferentially (i.e. along the time-axis), human skin can put various pressure profiles that can smear the time-axis in a wide variety of different ways. For example, this time-smearing can be a gently-varying pressure profile with no sharply-defined beginning or end, or it can be very localized, or it can be anything in between. It can even be doubly localized (i.e. gripped with widely spaced thumb and index finger and nothing in between), resulting in a kind of slapback echo of the time axis instead of the more slurred temporal smearing that might result from wrapping the whole hand around the cylinder.

Longitudinally, the finger-stylus can continuously move side to side, along the cylinder, parallel to the axis of rotation, and therefore can smoothly transition between different samples, or smear different samples together but at the same point in time.

Figure 7B:
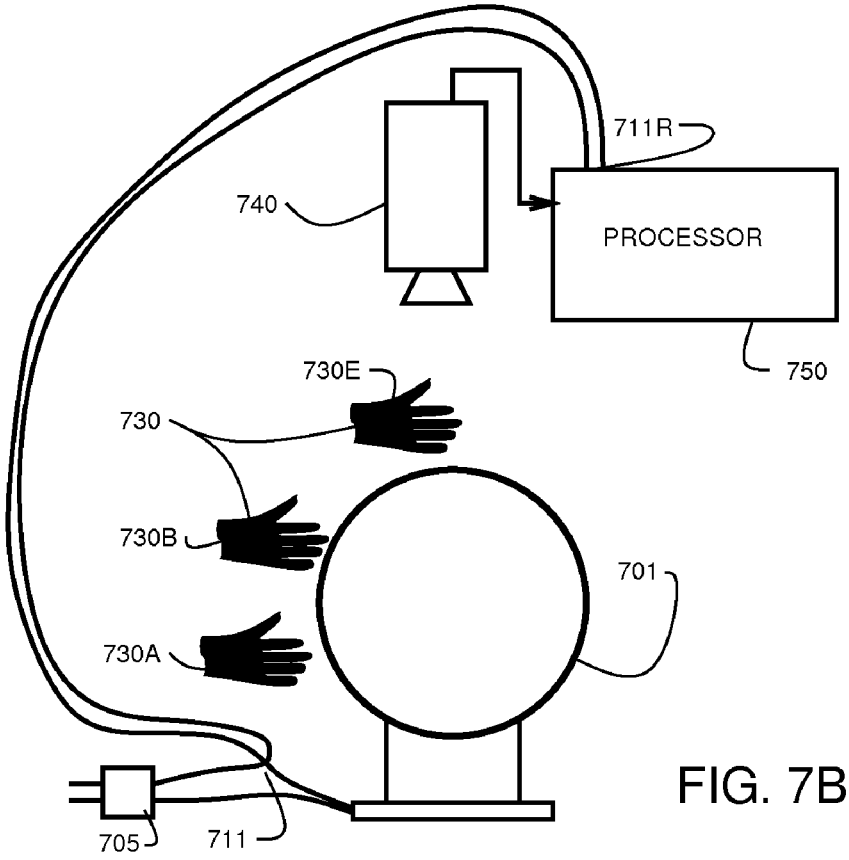
FIG. 7B illustrates an embodiment of the invention based on a plasma ball.

FIG. 7B illustrates an embodiment of the invention that uses matter in its fourth state-of-matter, i.e. plasma. A plasma ball 701 is both the user-interface as well as the source of the original sound production. Plasma balls are well known in the art, and are commonly sold at novelty stores and the like. Typically the are sold with an AC adaptor, transformer, "wall brick" or similar power supply 705. To make a plasma ball into a musical instrument of the invention, a pickup 711 is provided. This pickup 711 can be optical, magnetic, electric, or acoustic. FIG. 7B shows an electric pickup formed by simply interrupting the power supply 705. This interruption is shown as a cut of one of the two wires from power supply 705, which essentially works as an ammeter to sense current drawn by plasma ball 701. Hissing and sputtering sounds that sound like thunder and lightening can be heard when amplifying this current. Input 711R to processor 750 is a current sense input, in which input 711R is a very low impedance and low resistance input that allows current to flow through it but also senses how much current is flowing. Alternatively a sense coil can be used that functions like an amprobe or functions like a magnetic pickup. An optical pickup can also be used and in fact if the camera 740 has a high enough frame rate this can be the pickup. A small camera about 20 by 20 pixels from an optical mouse can also be used as the pickup, since high frame rates like 3000 frames per second can work in at least part of the audio range so the sound pickup is actually in the audio range.

Camera 740 tracks hand 730, using standard hand-tracking software running in processor 750. The hand tracker is used to select from among various virtual filters in processor 750. If hand is seen in position of hand 730A, then an "A" filter is selected. If hand is seen in position of hand 730B, then a "B" filter is selected, and so on. If hand is seen in position of hand 730E, then an "E" filter is selected, etc.

Processor 750 thus outputs a filtered version of the sound made by the plasma in plasma ball 701. Although the sound is electric the instrument is a physiphone, not an electrophone, because the sound originates from a physical process of matter, and in particular, from matter in its plasma state.

Some embodiments of the plasmaphone of the invention do note use the camera and just amplify the sound picked up from the plasma ball. For example, the invention can be sold as an accessory that consists of an extension cord with splice point that plugs into a sound card on a computer. Thus pickup 711 and input 711R can be sold as a unit that works with a user-supplied power supply 705 and plasma ball 701 and a user-supplied processor 750, with or without the camera 740.

Without the camera, the instrument works typically as a percussion instrument to add hissing and popping sounds to other music.

Figure 8A:
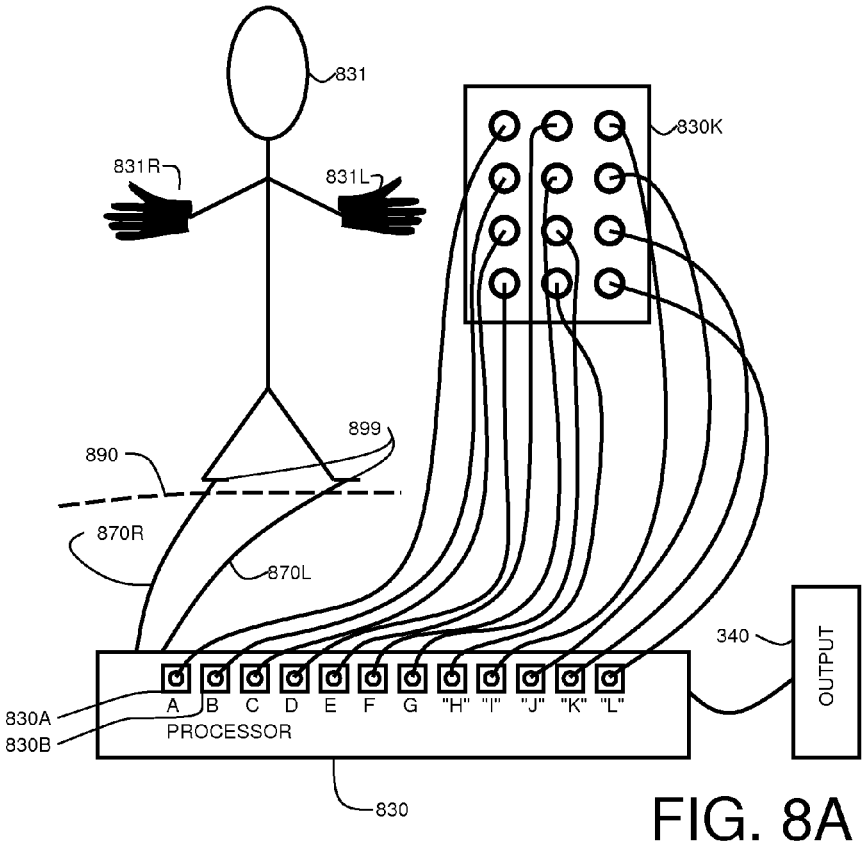
FIG. 8A illustrates a skates-of-matter embodiment of the invention.

FIG. 8A illustrates an embodiment of the invention that uses dihydrogen monoxide (H2O) in its solid state, i.e. ice. The proper nomenclature for musical instruments derives from Greek origin, e.g. a xylophone comes from Greek words "xylo" which means "wood" and "phone" which means "sound" Similarly the proper name for this instrument is "pagophone" from Greek "pago" for ice and "phone" for sound.

This embodiment of the pagophone produces sound from ice 890. In a preferred embodiment ice 890 is an ice rink. Pickups are mounted on ice skates. These can be geophones or contact microphones bonded to the ice skate blade. There can be one pickup on one skate, or there can be pickups on both skates. The skate functions like the bow of a violin to scrape, scratch, and otherwise make sound from ice.

We can think of this instrument as also like a record player, where we "scratch" with the ice.

FIG. 8A depicts a musical instrument consisting of a physical process that acoustically generates sound from the material world (i.e. sound derived from matter such as solid, liquid, gas, or plasma) which is modified by a secondary input from the informatic world. The figure in no way limits this to ice, for it can work in a pool, or in open air, or on pavement. The informatic input selects attributes such as the frequency range of the musical note being sounded, while the acoustic process is kept in close contact with the user, 831, to ensure a high degree of expressivity. In one example, ice skates with acoustic pickups are used to play music while the skater (user 831) simultaneously controls a bandpass filter implemented in a wearable computer or processor 830, with a hand-held keyer, 830K. Processor 830 is very different from the processors, frequency shifters, amplitude inverters, filterbanks, and the like of FIGS. 3, 4, 5, 6, and 7.

The processor 830 of FIG. 8 only has two broadband audio inputs 870L and 870R, and the other 12 inputs are narrowband control inputs which could also be sound that goes right down to zero Hertz (DC), but could also be just binary input. In one embodiment processor 830 is a wearable computer with stereo sound input, with the pickup on the left skate connected to the left input 870L, and the pickup on the right skate connected to right input 870R. The keyer 830K may be simply pushbutton switches connected to the parallel port. It may also be made from 12 pressure sensors connected to 12 more analog inputs, if the processor happens to have a total of 14 analog inputs (two for the skates and 12 for the keyer). Input 830A comes from the first key switch or pressure transducer in the two dimensional array of keyer 830K. Input 830B comes from the next one, etc.

The main expressive input is by way of one or more physical objects 899, such as ice skates. Each skate works much like the bow on a violin, allowing the player to hit, scrape, rub, or "bow", the ice 890 in various ways to create a wide variety of musical textures. Additionally the player can select sound samples on a per-note basis and then "scratch" out a melody or harmony (playing multiple samples at once) on the ice on the rink like a team of Disk Jockeys (DJs) working together to "scratch" an array of vinyl records. Because the grooves on an ice rink are made by the player in a freeform fashion, there is much more room for variations in musical timbres and textures than with the fixed grooves of a record.

Rather than merely using the keyer to trigger musical notes through MIDI note on/note off commands, acoustic sound is created through a physical process such as skating, and then turned into musical notes with the handheld keyer that functions as a modifier input. This combination combines the expressivity of non-electrophonic musical instruments like the violin with the flexibility of electrophones like the sound synthesizer.

The invention provides a musical instrument consisting of a physical process from the material world, i.e. by way of sound derived from matter, (e.g. solid, liquid, gas, or plasma) that generates an acoustic sound that is modified by a secondary input, the secondary input selecting the frequency range of the musical note being sounded. The physical process generating the acoustic sound is kept in close contact with the user, to ensure a high degree of expressivity. In one example, the ice skates with acoustic pickups are used to play music while the skater simultaneously controls a bandpass filter with a hand-held keyboard and wearable computer.

Unlike a hyperinstrument in which position sensors, or the like, ADD synthetic sounds to an acoustic instrument, hyperacoustic instruments use position sensors, or the like, to MULTIPLICATIVELY combine these. Most notably, hyperacoustic instruments use a synthetic input to modify an acoustically generated sound.

Organologists and ethnomusicologists often address fundamental philosophical questions regarding categorization of musical instruments in view of recent developments. Instruments are generally classified based on initial sound production mechanisms; for example, an electric guitar is still a chordophone, not an electrophone, even though electricity (and now computation, i.e. digital effects pedals, etc.) is involved extensively further along the sound production path.

Hyperacoustic processing of audio signals in the preferred embodiments of the present invention relies on an acoustic sound source—ie. one which falls outside the "electrophones" category. In particular, the acoustic signals come from real-life physical processes in which the sound-producing medium is closely linked with the user-interface, in terms of controllability and tactility.

In one embodiment of the pagophone, variously lengthed bars made of ice are struck and the sound is amplified by a pickup in each bar, or one for all bars. The pickups can also be connected to bandpass filters, a separate filter for each note, to improve the sound.

In other versions there are only 1 or 2 filters for 1 or 2 sticks, with input from a computer-vision system similar to that shown in FIG. 7, which is used to determine which bar is struck.

In another embodiment of the pagophone, there is only one piece of ice which sounds different depending on geospatial or other input data.

In one embodiment, the pagophone is "played" on a skating rink (the ice that makes the sound) with skates (or, equivalently with skis on a ski hill, or with a toboggan, making sound from snow), each skate fitted with a pickup, passed through a wearable computer to a wearable amplifier and speakers. One can draw the analogy of the skates to violin bows. In the embodiment of FIG. 8, the pagist (pagophone player), i.e. user 831, uses a musikeyer, keyer 830K, to select the filter (the "note"), while putting expression into the foot scrape or other sound. One version has two keyers, and holds one in each hand.

Some but not all embodiments also use computer vision to do object location and adjust the pagophonic sound appropriately. For example, vision, radar, sonar, or lidar sensors or a combination of these watch the passing ice, and index through sampled audio files to create an effect similar to "scratching" a record.

If a handheld keyer is used, the array of blocks of ice can be replaced by just one block of ice, with the keyer used to select a musical note on the scale. In general, the keyer controls the type of hyperacoustic transformation to perform on the acoustic signal, and in particular, that transformation can gather content in the acoustic signal beyond the range of human hearing, and transform that full content into the range of human hearing, at the correct musical note. Ultrasonic and subsonic sound is used in order to gather the full expressive content that the user has control over in the physical sound-production process.

FIG. 8 shows the combination of two new musical instruments, the musikeyer, a handheld instrument that can be played while walking or jogging, and the physiphone, an instrument that is played from real-world physical processes.

The musikeyer is a simple portable computing device, with input and output that can be operated while walking, jogging, or waiting in line at a grocery store.

The device is a portable music player, that allows the user to play and compose music while standing or walking.

Keyers more generally can be extended to visual body-borne computing, where the user has the keyer input device in hand and uses it serendipitously while carrying on day-to-day activities. Keyer key-presses can be associated with audio, and computing with audio feedback (e.g. typing without looking at the screen).

For simplicity, the musikeyer device consists of a keyer with only 12 keys. The keys can be pressed individually to play single notes, or they can be pressed in combination to play chords. The single notes comprise the A natural (minor) scale from A to A followed by sufficient notes to play a C major scale from C to C, a D dorian scale from D to D (songs like "What Shall We do With the Drunken Sailer", and "Scarborough Fair"), and an E phrygian scale from E to E (flamenco music, and the like is often played in phrygian mode).

Rather than using a keyer to trigger musical notes through MIDI note on/note off commands, the preferred embodiments of the invention create acoustic sound through physical processes from the material world (i.e. the matter world, i.e., one of solid, liquid, gas, or plasma). Furthermore, the physical process generating the acoustic sound is kept in close contact with the user, to ensure a high degree of expressivity. In this embodiment, the handheld musikeyer is treated as a modifier input, or a control input, while most of the expressivity comes from the physical process, such as the ice skates. The physical process becomes the dominant user-interface.

In the embodiment shown in FIG. 8 the skates are used as friction idiophones in which sound is picked up by a geophone bonded to each blade. The geophone is like a microphone, but designed to pick up vibrations in solid matter, as in:

1. geophone="earth"=transducer for solid matter (some types of geophones are called "contact microphones")
2. hydrophone="water"=transducer for liquid matter (sometimes called "underwater microphone")
3. microphone="air"=transducer for gaseous matter.
4. ionophone="fire"=transducer for plasma matter.

In the same way that an electric guitar is still a chordophone, even when run through various effects pedals, the ice-skate instrument functions as a friction idiophone; i.e. an acoustic instrument that's electrically modified.

The electrical modification takes the form of effects (filters) that are applied by way of the musikeyer.

To make hyperacoustic instruments as expressive as possible, it is desired to bring subsonic and ultrasonic sounds into the audible range by way of signal processing of the acoustically-generated signals. In a way similar to (but not the same as), superheterodyne radio reception, signals can be downshifted and upshifted by means of using an oscillator in the process of frequency-shifting and various forms of selective sound filtration. However, unlike what happens in a superheterodyne receiver, preferred embodiments scale frequencies logarithmically rather than linearly, in order to better match the frequency distribution of human perception.

This digital signal processing is, in a general sense, a filtering operation, which may be highly nonlinear in certain situations.

The filterbanks can be MIDI based, if desired, or can simply be bandpass filters. In the case of MIDI based, rather than triggering a sample or MIDI note as has been often done in computer music, the invention retains the acoustic property of the instrument by simply passing each of the parallel sound signals through a bank of nonlinear filters created by using the MIDI device as socillator The apparatus of FIG. 8 is like a violin played by skates acting as the bow. A geophone attached to each skate is routed through a body-borne digital signal processing system, and then back into body-borne speakers. It has an input device called a musikeyer which controls the hyperacoustic processing functions. The musikeyer does not add acoustic content, nor does it remove acousticality of the instrument (ie. it does not cause the instrument to be musicologically classified as an electrophone). This is an example of a hyperacoustic instrument which combines acoustic and expressively controllable physical processes with the versatility of computing.

In another embodiment of this invention there is no keyer 830K. Instead the processor steps through the notes of an andantephone. The andantephone is well known in the art, as presented in "The andantephone: a musical instrument that you play by simply walking", Proceedings of the 14th annual ACM international conference on Multimedia, Santa Barbara, Calif., USA, Pages: 181-184, 2006, ISBN: 1-59593-447-2.

In the andantephonic embodiment, the expression in each note is scraped or scratched by the player, but the processor selects the next note to be played, so that the song is selected and then runs.

This is done as follows:

1. express skate input through filter(s) for chosen note(s) or chord(s) of first andantephonic unit (e.g. first beat of song, or the like);
2. compare skate input to an integrated threshold, determined by either a time unit, or by an integrated envelope energy unit, or by accelerometer or other input, i.e. to step through one beat per footstep or stroke of the skate;
3. if threshold is exceeded, advance to next note(s), chord(s), or other andantephonic unit (e.g. second beat of song, or the like);
4. repeat until song completed.

This system works also with skis or shoes, e.g. for walking on pavement and creatively stepping through music by walking, shuffling, scraping or sliding the feet.

Figure 8B:
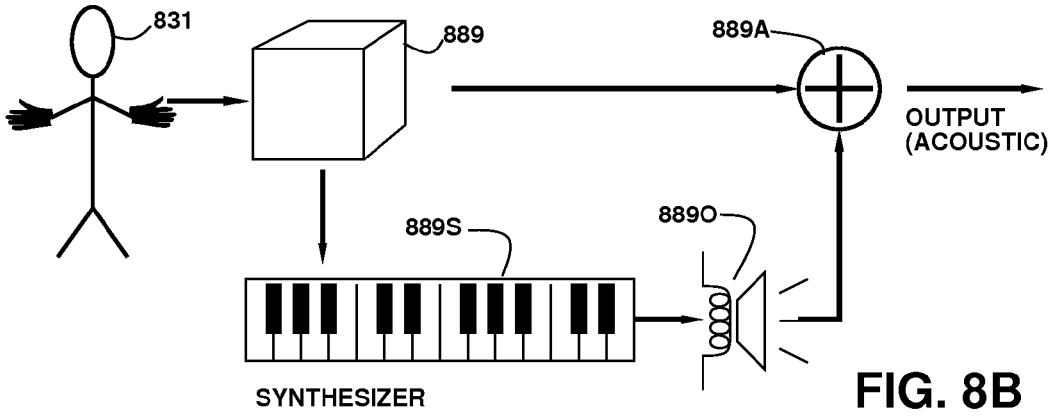
FIG. 8B illustrates a comparison to hyperinstruments.

FIG. 8B illustrates a hyperinstrument, as a point of comparison. Hyperinstruments are known in the art, as proposed by Tod Machover and others. A hyperinstrument involves a user 831 interacting with a real physical acoustic source 889. Source 889 is an actual physical instrument such as a violin which makes sound directly as well as provides input to a synthesizer 889S audible in speaker 8890. The surrounding air and human perception blend the sounds of the source 889 and synthesizer 889S. This blending is denoted by adder 889A, which denotes the additive process of listening to multiple sound sources.

Figure 8C:
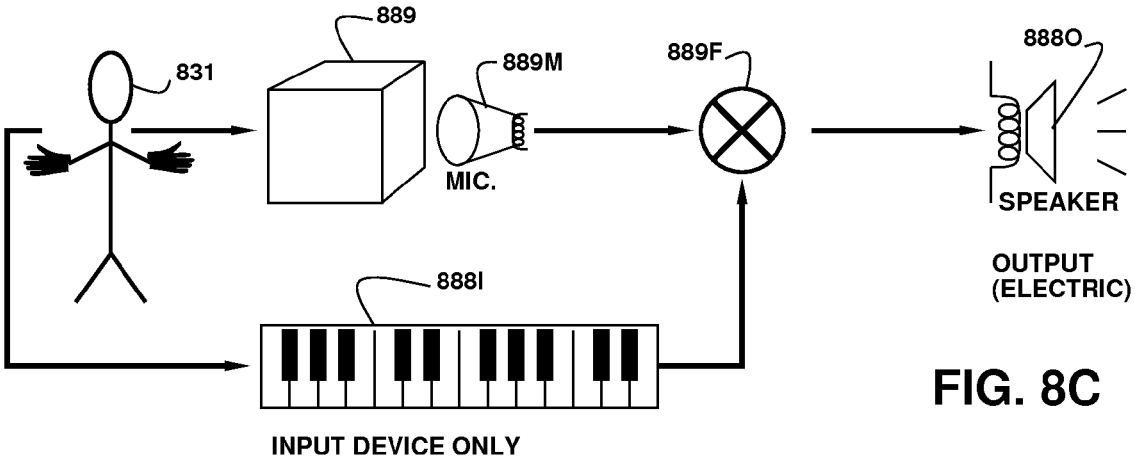
FIG. 8C illustrates a hyperacoustic embodiment of my invention.

FIG. 8C illustrates my hyperacoustic instrument invention. A real physical acoustic source 889 produces acoustically-originated sound. The user 831 interacts with physical acoustic source 889. The acoustically-originated sound from source 889 is received by a pickup which can be a mickup, hydrophone, geophone, microphone, or the like. Without loss of generality the pickup may be denoted "MIC." as standard abbreviation for microphone. Mic. 889M brings the real physical acoustic sounce source back into the electrical domain, where it passes through filter 889F. Filter 889F is affected by input device 8881. Speaker 8880 conveys this result to the listener.

Figure 8D:
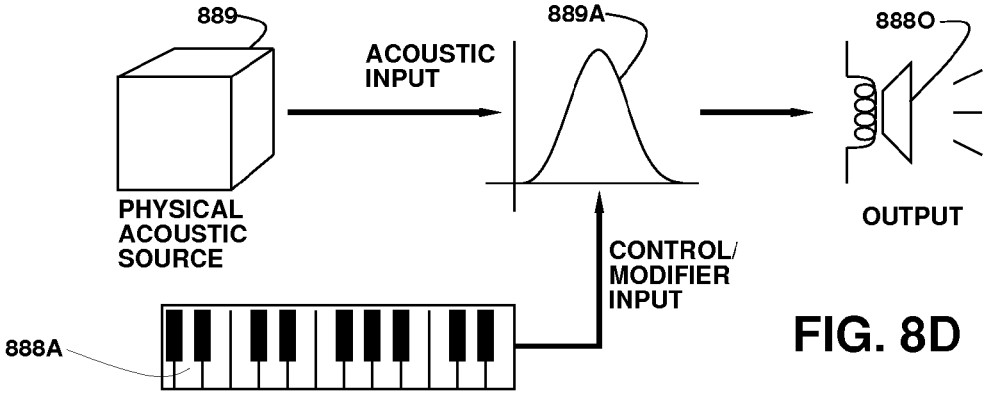
FIG. 8D further illustrates this hyperacoustic embodiment.

FIG. 8D illustrates my hyperacoustic instrument invention when it is playing one note, such as the note "A". A real physical acoustic source 889 such as an ice skate scraping on ice, produces acoustic input into a filter. Here we consider that the user has selected the input device to be device 888A as the note "A" is selected. The control/modifier input to the filter thus moves the filter to be a bandpass filter 889A centered around 220 vibrations per second, with some bandwidth to allow frequencies around this frequency to also pass through. The resulting A-filtered sound is passed to output speaker 8880.

Figure 8E:
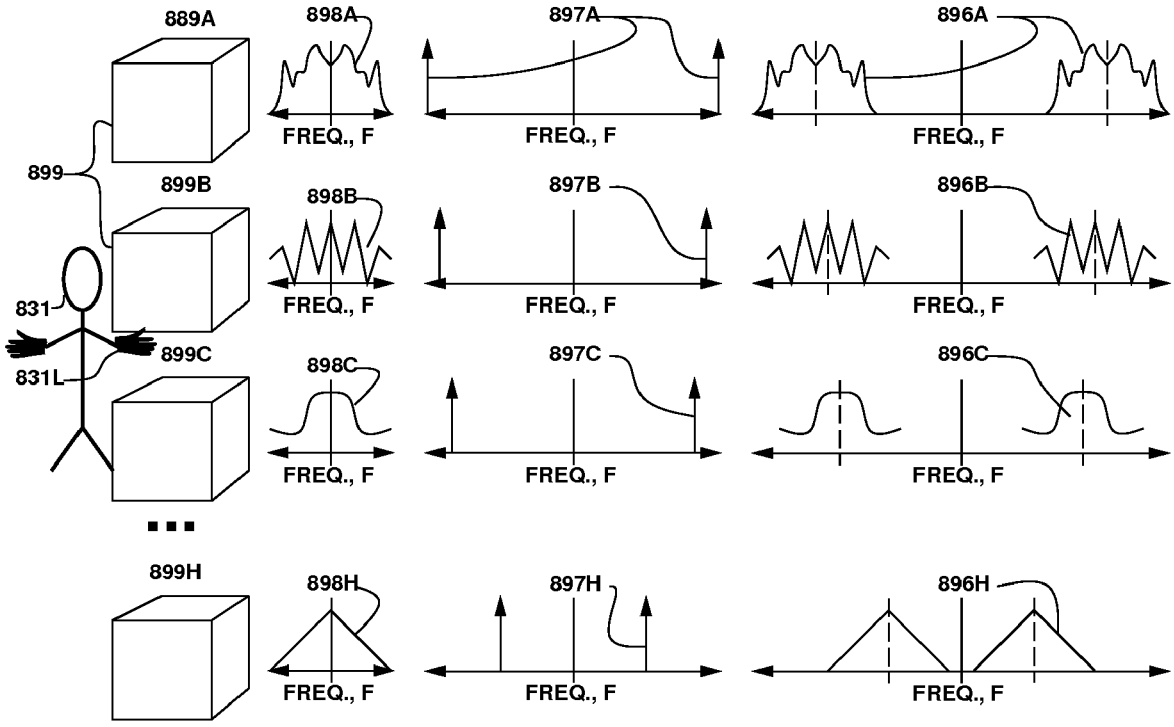
FIG. 8E illustrates a shifterbank embodiment of the invention.

FIG. 8E illustrates a shifterbank embodiment of the invention. A user 831 can strike, rub, or scrape against eight real physical objects 899A, 899B, 899C, etc., up to 899H. The figure shows user 831 kicking object 899C and hitting object 899B with left hand 831L. The objects can be struck simultaneously, or in succession, or in various combinations.

Each of these objects produces its own spectral distribution that depends greatly on how it is struck, rubbed, scraped, or otherwise interacted with. Each object has a separate pickup fed to an input such as input 898A for object 889A, input 898B for object 898B, input 898C for object 898C, and so on, up to input 898H for object 898H. The inputs are denoted with their spectral distributions which are Hermitian symmetric because we assume that the inputs are real-valued. Obviously the invention will also work with complex-valued inputs from another process, if desired.

An upshifter is provided for each note of the musical scale. The upshifter consists of frequency shifter such as frequency shifter 897A for input 898A, shifter 897B for input 898B, shifter 897C for input 898C, and so on, up to shifter 897H for input 898H.

Each shifter has an output such as output 896A denoted by its spectral response. The spectral response is Hermitian symmetric because we desire a real-valued output 896A for output to a mixer to be mixed with each of the other outputs, so that the sum can be fed to a loudspeaker or other output medium either separately or mixed together with the other outputs.

Shifter 897A shifts input 898A from baseband (centered at 0 Hz) to output 896A which makes it be centered at 220 Hz. Shifter 897B shifts input 898B from baseband (centered at 0 Hz) to output 896B which makes it be centered at 246.94 Hz. Shifter 897C shifts input 898C from baseband (centered at 0 Hz) to output 896C which makes it be centered at 261.63 Hz. Each physical object gets shifted to a different note of the musical scale, all the way up to the eighth physical object, 899H. Shifter 897H shifts input 898H from baseband (centered at 0 Hz) to output 896H which makes it be centered at 440 Hz. In this example the eight objects span a one octave compass of a natural minor scale from "A" to "H", where we use the extended musical alphabet in which "H" denotes high "a".

Any scale or number of objects can be used. More typically there are 12 or more objects, and some may be mapped to frequencies of semitones such as B-flat at 233.08 Hz for example.

Multiple sets of shifterbanks can be used together, or the oscillators can be Shepherd tones for example instead of pure tones, so that the input for object 899A gets shifted to 110 Hz, 220 Hz, 440 Hz, and 880 Hz, making a richer sound. The oscillator may also have harmonics, so the input gets shifted to various places on the spectrum to make harmonics.

In an alternative embodiment the shifterbanks are replaced by filterbanks, and this works well when the input is broadband like the sound of rushing water. Each filter selects out spectrum of the input.

An another embodiment, there is both a shifterbank and a filterbank. The shifterbank moves each object's spectrum into the desired frequency, and the filterbank shapes the spectrum. Preferably the filterbank comes first so that the same filterbank can be used for each input. In one embodiment each input goes through a lowpass filter before going to one of the shifters of the shifterbank.

In another embodiment each input goes through a filter, H, that maps it from its existing sound to a desired sound. For example, the sound of wooden blocks being hit first gets mapped to the sound of a piano, and then each one is shifted to the desired note on the musical scale.

This can be done by convolution in the time domain, or multiplication in the frequency domain.

In other embodiments each input goes through a spectral compactor that maps a wide range of sounds out to ultrasonic, down toward the origin. Then each spectrally compacted result goes through a sound-shaper to change the sound to the desired instrument. Then the resulting compacted and shaped spectra are each fed to an element of the shifterbank to move them to the desired notes.

Simply playing back the input samples faster will compact the spectrum. However that will also shorten the duration. However, there are devices, known in the art, that allow separately the ability to adjust the duration or pitch of sound. For example pitch transposers can raise or lower pitch without changing duration of a recording. Also there are devices that can play back a recorded lecture without making the pitch go high like the "donald duck" kind of sound one gets ordinarily when playing a lecture faster.

Accordingly, the spectral compactor can be implemented by shifting the pitch up. Preferably this is done logarithmically so that that everything is shifted toward the origin. This brings ultrasonic sounds in the physical media into the audible range adding richly to the acoustic texture of the hyperacoustic instrument.

Figure 9A:
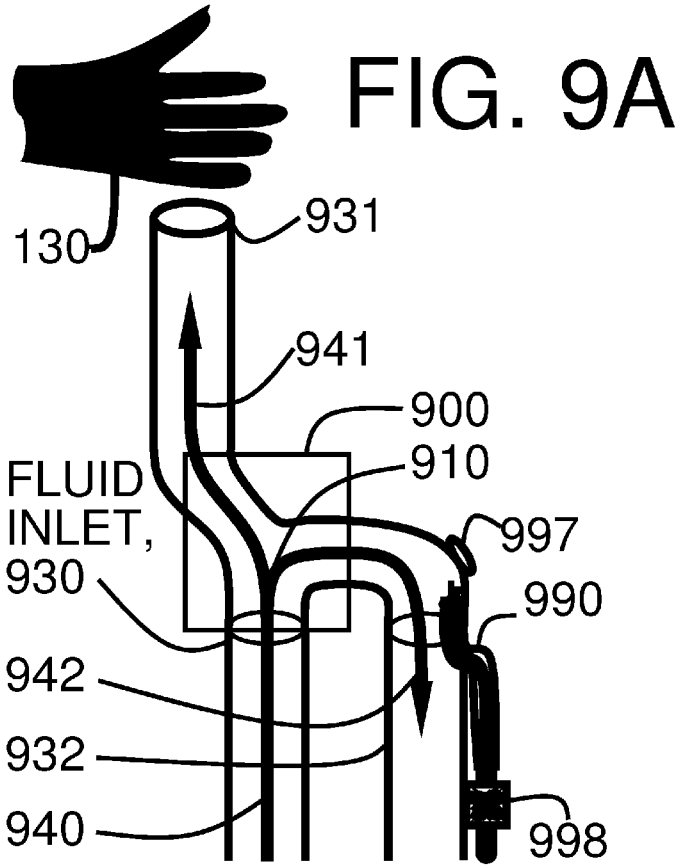
FIG. 9A illustrates an embodiment of the invention that works within a waterswitch.

FIG. 9A illustrates an embodiment of the hydraulophone invention that works within waterswitch 900. Ordinary non-hydraulophonic waterswitches are well known in the art, and are commonly used to switch water that comes from a fluid inlet 930 between an outlet 931 and a drain 932. Waterswitches make use of the Coanda effect in which incoming water 940 arrives at branch 910 which is a sharp edge branch point, and either goes to the outlet 931 as water 941 or to the drain 932 as water 942.

Waterswitches are used instead of solenoid valves to make jumping fountains and dramatic water shows, because the inertia of water makes it sluggish to start and stop, but with a waterswitch the water can be made to start and stop quickly be diverting it from the outlet to the drain, almost instantly.

Waterswitches use air solenoids to open and close two air holes to do the switching. The switching is based on the relative degree of closure of the two air holes.

The hydraulophonic waterswitch invention depicted in FIG. 9A uses a regular waterswitch that has been fitted with a hydrophone 998 in which a small flexible hose 990 is fitted over the listening port of the hydrophone 998. A hole is drilled into the side of the drain 932. Preferably the hole is drilled on the outside radius of the drain so that water slung out the drain hits it stronger due to centrifugal force than would occur if the listening port of the hydrophone were in the inside curve. The DC offset voltage on the hydrophone output increases when water hits it, and decreases when the water does not hit it.

When a user's hand 130 blocks outlet 931, the water 941 can't get out as easily and this tends to cause the switch to initiate a switching action more readily and with enough blockage by hand 130, the switching action will take place without the solenoid of the waterswitch air valve energized. When the waterswitch switches to drain mode, regardless of whether the switchover was caused by a control signal to the solenoid, or by blockage by hand 130, drain water 942 hits hydrophone 998 and gives sound output that can be amplified and control other devices. The sound output can be shifted to notes, so a plurality of waterswitches can be used as a large musical instrument. Since waterswitches are usually associated with large amounts of water, the instrument is preferably played with the feet of a user rather than hands. Stepping on a ground nozzle driven by a waterswitch for example will cause it to switch, and this switching produces sound in the form of mostly subsonic sound including a DC offset in hydrophone 998.

Alternatively or additionally a geophone 997 is struck by water 942 and this sound is fed to a processor for sound or other output.

As an example of how this embodiment of the invention can be used consider a large waterpark or interactive fountain with an array of 16 water jets arranged in a 4 by 4 lattice.

Figure 9B:
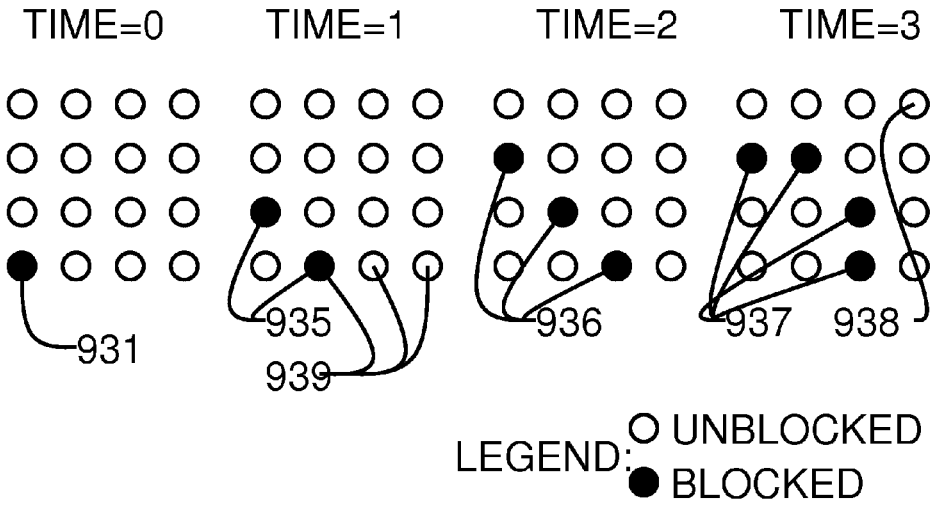
FIG. 9B illustrates a waterpark using the invention of FIG. 9A.

FIG. 9B illustrates an embodiment of the hydraulophone invention used as a user interface for a video game in which the pixels 939 in the video game are each a water jet. The display screen has 16 pixels, and is shown at 4 different points in time for four successive times, equal to 0, 1, 2, and 3 units of time, respectively.

To begin, a user stomps on one of the four corner jets that are equipped with the apparatus of the invention. The four equipped hydrophones are connected to a processor that produces a different musical sound in response to blockage of each jet such as jet 931. The processor also begins counting from time=0, initially, which is defined by the point in time when the waterswitch switches beyond a certain threshold.

after one unit of time the processor turns off the waterswitch for jet 931 and turns on jets 935. After another unit of time for time=2, the processor turns off the two jets 935 and turns on three jets 936. After yet another unit of time, for time=3, the processor turns off the three jets denoted as jets 936 and turns on the four jets 937.

Regarding the jets as pixels 939, what is happening is that the processor is drawing a circle and quantizing it down to the water jet pixel lattice and expressing a rippling wave. The effect is a discretely quantized version of a ripple like what happens in a pond when a stone is thrown in. Blocking jet 931 starts a domino effect of outwardly rippling water waves, in a manner similar to how a light chaser creates the illusion of motion by sequentially turning lights on and off.

Finally when the ripple ends at the opposite corner at jet 938, the processor keeps this jet running, and shuts off all the other jets, except the four corner jets, so that another player is invited to stomp on one of corner jets. The first person to stomp on the jet wins the next round and the ripple goes back if, for example, a player blocks jet 938 before any of the other players.

Figure 9C:
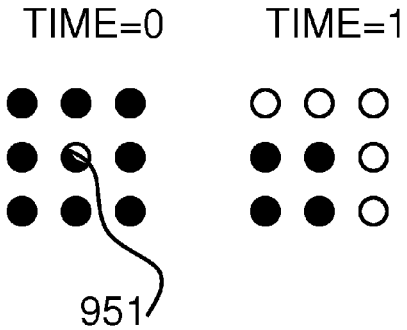
FIG. 9C illustrates a waterjet-as-pixels video game using partial water jet covering.

FIG. 9C illustrates variations of a waterjet-pixel video game using partial jet blocking. This works well with laminar jets such as the jets shown in FIG. 6C because a camera inside each jet can look down the water column and "see" which part of it is blocked.

At time less than 0, only the middle jet is on. Then when a user blocks the southwest portion of the middle jet 951, the processor stops all jets in the southwest region of the array. Another player can partially block one of those jets to send water back to the first player in various patterns. In this way players can have waterfights across cyberspace, since fountains can also be linked over the Internet using the FLUIDI protocol.

Figure 10:
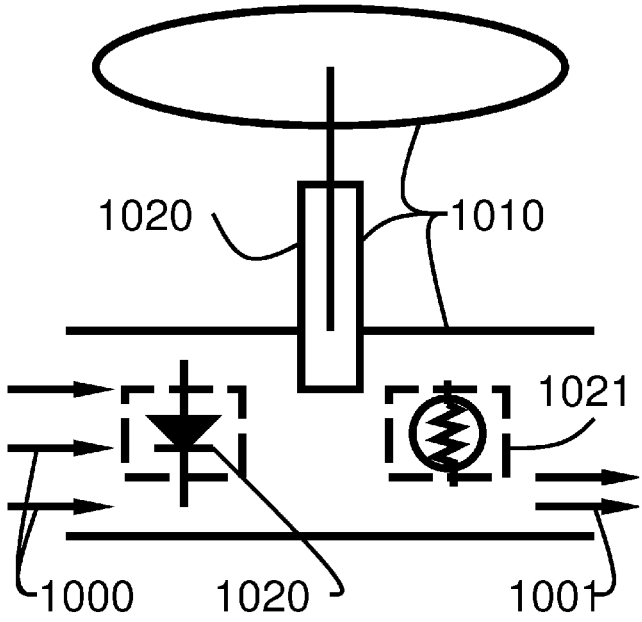
FIG. 10 illustrates an aquatic user interface.

FIG. 10 illustrates an aquatic user interface in which a fluid flow control valve is used to control an electric quantity. In this embodiment a gate valve is used to adjust fluid 1000 in an inlet. The gate 1020 of gate valve 1010 adjusts the amount of fluid 1001 that flows to the outlet of the valve. A light emitting diode (LED) or LED array, such as LED 1020 illuminates a photocell 1021 to a degree dependent on how open the valve is. LED 1020 and photocell 1021 are both encapsulated in clear epoxy potting compound to make them waterproof. Wires run along the pipes inside the pipes to connect to other equipment.

In one embodiment such a valve is used to control the volume of the instrument together with water flow. Hydraulophones tend to play louder when there's more water flowing to them, but this apparatus accentuates the natural effect to make the volume control even more dramatic.

In other embodiments there is no fluid 1000 flowing in the valve 1010, and the valve just contains the electric parts LED1020 and photocell 1021. In this situation the wires run inside the pipes or plastic tubing, and the connectors can be safely protected inside the plastic tubing. The valve is thus plugged into a plumbing circuit as if it were a plumbing part, but it is really an electric part. Various combinations of plumbing fittings that are, or contain electric devices are possible. This provides a unified framework and an aquatic feel, as well as protection from the wet environment.

In one embodiment an instrument for being used with a plurality of pieces or containers or regions of physiphonic input media, has pieces or containers or regions of physiphonic input media being one of a solid, liquid, gas, or plasma, said instrument comprising:

a plurality of pickups, each arranged for conversion of one of (a) an acoustic disturbance, or, or (b) a vibrational disturbance in each of said pieces or containers or regions of input media;

a filter connected to an output of each of said pickups, said filters each filtering said disturbance into a signal comprising one note of a musical scale, with a one-to-one correspondence between said pieces or containers or regions of physiphonic input media, and said notes of said musical scale;

one or more output devices for converting said signals into sound.

In another embodiment these filters comprise one or more frequency shifters (i.e. each filter is a frequency shifter).

In another embodiment said filters comprise a shifterbank.

In another embodiment said media are water spray jets, and each of said filters is one of:

a frequency-shifter;

a bandpass filter, and each of said pickups is a cross-flown hydrophone.

In another embodiment said media are water spray jets, and each of said filters is one of:

a frequency-shifter;

a bandpass filter, and each of said pickups is an end-flown hydrophone.

In another embodiment said media are water spray jets, and each of said filters includes an oscillator, and an input that modulates the amplitude of the oscillator, wherein the frequency of each oscillator is a note on a musical scale, and each of said pickups is an end-flown hydrophone.

In another embodiment for being used with a plurality of pieces or containers or areas of physical media, each of said pieces or containers or areas of physical media being liquid, gas, or plasma, said instrument further includes a housing, and a plurality of Karmanizers, each Karmanizer in a fluid channel, each fluid channel housing one of said pieces or containers or areas of said physical media, each fluid channel fluidly connected to a finger hole in said housing, where an output of each of said Karmanizers is connected to a filter, said filters each filtering said output into a signal comprising one note of a musical scale, said filters being in one-to-one correspondence with each of said plurality of pieces or containers or areas of physical media, said instrument further including a least one audio output from said filters.

In another embodiment said fluid connection comprises a side-discharge, said side-discharge spraying an amount of fluid proportional to a blockage of said finger hole.

In another embodiment said fluid connection comprises the Karmanizer being in the same fluid channel that feeds said finger hole, each of said Karmanizers fitted with a pickup, each of said pickups connected to an amplitude inverter.

Another embodiment comprises a hyperacoustic musical instrument, said instrument for being used with a plurality of physiphonic input media, said physiphonic input media being liquid, said instrument further including a plurality of bowls for being filled with said liquid; a plurality of pickups for being used, one with each of said bowls; a frequency-shifter for use with each of said pickups; an adder to add the output of each frequency-shifter, and means for converting the sum of said adder to sound.

Another embodiment comprises a hyperacoustic instrument, said instrument for being used with a plurality of physiphonic input media, said physiphonic input media being liquid, said instrument further including a plurality of bowls for being filled with said liquid; a plurality of pickups for being used, one with each of said bowls; a filter for converting disturbances in each of said bowls to one of a plurality of notes on a musical scale, each of said filters having a center frequency equal to the frequency of each of said notes on said musical scale.

Another embodiment comprises a hyperacoustic instrument, said instrument for being used with a plurality of physiphonic input media, said physiphonic input media being a fluid comprising one or more of liquid, gas, and plasma, said instrument further including:

a housing;

a plurality of sounding pipes, each pipe having an easy port from which said fluid exits easily, and a sounding port from which said fluid exits with greater difficulty than said easy port, each pipe of size and length resonant to a frequency on a musical scale when said easy port is blocked;

a fluid supply to each of said pipes, each pipe in said housing, said easy ports each connected to one of a plurality of finger holes in said housing, said instrument further including at least one pickup to pickup disturbances from each of said pipes, each pickup being connected to a filter, said instrument further including an audio output responsive to an output from each of said filters.

Another embodiment comprises a hyperacoustic musical instrument, said instrument for being used with a plurality of physiphonic input media, said physiphonic input media being a fluid comprising one or more of liquid, gas, and plasma, said instrument further including:

a plurality of sounding pipes, each pipe having an easy end from which said fluid exits easily, and a sounding port from which said fluid also exits, each pipe of size and length resonant to a frequency on a musical scale when said easy end is blocked, and not resonant when said easy end is not blocked;

a fluid supply connected to each of said pipes, said easy ends arranged for being touched by a user of said instrument, each of said easy ends at an end of each of said pipes opposite said fluid supply, said sounding ports each located near said fluid supply, said instrument further including a plurality of pickups, each of said plurality of pickups responsive to vibrations in at least one of said pipes, each pickup for being connected to a filter, said filter for generating an audio output for said instrument.

Another embodiment comprises a signal processor for a hyperacoustic musical instrument, said signal processor for being used with input signals from a plurality of pickups, each of said pickups for use with a plurality of physiphonic input media, said physiphonic input media being one of a solid, liquid, gas, or plasma, said signal processor comprising:

a plurality of signal inputs, one signal input for each of said pickups;

a plurality of oscillators, each oscillator tuned to one note of a musical scale;

one or more output devices for converting output of said oscillators into audible sound;

a microcontroller, said microcontroller responsive to input from each of said plurality of signal inputs, said oscillators each responsive to an output of said microcontroller, said oscillators adjusted in an essentially continuous fashion, the amplitude of each of said oscillators being proportional to the input level of each corresponding signal input.

Another embodiment comprises a signal processor for a hyperacoustic musical instrument, said signal processor including said oscillators where each oscillator is assigned to one channel of a MIDI device, and said processor issues MIDI channel volume control commands in response to changes in said signal input.

Another embodiment comprises a hyperacoustic musical instrument, said instrument for being used with a plurality of physiphonic input media, said physiphonic input media each being solid matter, said instrument for being borne by the body of a user of said instrument, said instrument comprising:

at least one ice skate, said ice skate bearing a pickup for converting vibrations in the blade of said ice skate into electrical signals;

a user-interface comprising a plurality of user input sensors;

an audio output system, said pickup connected to an input of a processor, said processor having a plurality of filters, each filter tuned to a note on a musical scale, each filter actuated by one of said plurality of user inputs, a total output from all the filters supplied to said audio system.

Another embodiment comprises a hyperacoustic musical instrument, said instrument for being used with a plurality of physiphonic input media, said physiphonic input media each being solid matter, said instrument for being borne by the body of a user of said instrument, said instrument comprising:

at least one pickup for use with an article of footwear, said pickup for converting vibrations in said footwear into electrical signals;

a user-interface comprising a plurality of user input sensors;

a bandpass filter operable by said user input sensors;

an audio output system;

a processor, each sensor connected to a control input of said bandpass filter, said processor receiving input from said user input sensors, said bandpass filter receiving signal input from said pickup, said processor controlling a frequency of said bandpass filter, said frequency responsive to an input from said input sensors, output from said filter supplied to said audio system.

Another embodiment comprises a hyperacoustic musical instrument, said instrument for being used with a plurality of physiphonic input media, said physiphonic input media each being solid matter, said instrument for being borne by the body of a user of said instrument, said instrument comprising:

at least one pickup for use with an article of footwear, said pickup for converting vibrations in said footwear into electrical signals;

a processor;

a bandpass filter controlled by said processor;

an audio output system, said audio output system connected to an output of said bandpass filter, said bandpass filter receiving signal input from said pickup, said processor also receiving input from said pickup, said processor adjusting a passband frequency of said bandpass filter in accordance with an andantephonic schedule, said andantephonic schedule determined by a lookup table, said lookup table sequenced according to steps or strokes of footsteps of a user of said instrument, output from said filter supplied to said audio system.

Another embodiment comprises a hyperacoustic musical instrument, said instrument for being used with a plurality of physiphonic input media, said physiphonic input media being one of a solid, liquid, gas, or plasma, said instrument comprising: a musical instrument housing for swappably housing a variety of different kinds of sound production media, said housing comprising a curved pipe larger at one and smaller at the other end, where the large end includes a round cavity with a main mouth, said large end forming also a resonant chamber operably connected to the large end of said pipe.

Another embodiment comprises a hyperacoustic or wholly acoustic musical instrument, said instrument for being used with physiphonic input media, said physiphonic input media being one of a liquid, gas, or plasma, said instrument comprising: a user-interface port for a first fluid, said first fluid being one of a liquid, gas, or plasma, said first fluid being in communication with a fluid amplifier, said instrument further including a sound production section, said sound production section for making sound in response to fluid passing to it, said instrument having different fluids for the user-interface port and sound production section.

Another embodiment comprises the hyperacoustic or wholly acoustic musical instrument, where said first fluid is water under low pressure, and said second fluid is water under high pressure, and said sound production section consists of the sound made by the water under high pressure spraying through a water jet.

Another embodiment comprises the hyperacoustic or wholly acoustic musical instrument, where said user-interface port is a finger hole for being blocked by a finger of a user of said hyperacoustic or wholly acoustic musical instrument.

Another embodiment comprises the hyperacoustic or wholly acoustic musical instrument where said user-interface port is a ground nozzle for being blocked by being stepped on by a user of said hyperacoustic or wholly acoustic musical instrument.

Another embodiment comprises a hyperacoustic or wholly acoustic musical instrument, said instrument for being used with physiphonic input media, said physiphonic input media being water, said instrument including at least one hole in a ground nozzle for being covered by a foot of a user of a user of said instrument, said instrument for being supplied with said water, said water emerging from said hole, said instrument including a fluid switch, said fluid switch having a fluid input, and a sensor on a side discharge port of said water switch, said sensor responsive to changes in one of: flow; or pressure, of water emerging from said hole, said instrument further including a sound production means, said sound production means responsive to a degree of obstruction of said hole by said user.

Another embodiment comprises a hyperacoustic or wholly acoustic musical instrument, said instrument for being used with physiphonic input media, said physiphonic input media being water, said instrument including a hole for being covered by a body part of a user of said instrument, said instrument for being supplied with said water, said water emerging from said hole, said instrument including a fluid amplifier, said fluid amplifier having a fluid input responsive to changes in one of: flow; or pressure, of water emerging from said hole, said fluid amplifier having a fluid output, said fluid output supplying water in proportion to a degree of obstruction of said hole by said user.

Another embodiment comprises a hyperacoustic or wholly acoustic musical instrument, said instrument for being used with physiphonic input media, said physiphonic input media being water, said instrument including an array of holes, where some or all of said holes are holes for being covered by one or more body parts of one or more users of said instrument, said instrument for being supplied with said water, said water emerging from said holes, said instrument including a sensor associated with each of said holes, said sensors each sensing at least one restrictometric quantity associated with each of said holes for being covered by one or more body parts of one or more users of said instrument, said sensors connected to one or more processors, said processors producing a different musical sound in response to blockage of each of said holes for being covered by one or more body parts of one or more users of said instrument, said musical instrument including means for flow control associated with water emerging from at least some of said holes, said processor generating a sequence of changes in flow of water emerging from said holes, in response to at least one restrictometric event change detected by at least one of said sensors.

Another embodiment comprises this hyperacoustic or wholly acoustic musical instrument where said processor is programmed to represent quantities of water jets spraying from each of said holes as one of: a matrix; a pixel array; a water jet pixel lattice, said sequence of changes in flow of water forming a pixelized or quantized outwardly rippling wave, said rippling having an approximately circular shape before quantization or pixelization, a center of said circle being at said hole where said restrictometric event change was detected.

Another embodiment comprises this hyperacoustic or wholly acoustic musical instrument in which said processor keeps at least one jet running, and shuts off at least some of the other jets until another restrictometric event change is detected, said processor responsive to which of said other holes has associated with it said other restrictometric event change.

Another embodiment comprises a controller for a hyperacoustic or wholly acoustic musical instrument of any embodiment described in this disclosure, said volume control includes a valve, a source of electromagnetic radiation, and an electromagnetic radiation detector, one of said source and detector being on, in, or near an input side of said valve, and the other of said source and detector being on, in, or near an output side of said valve, said musical instrument having means for adjusting at least one aspect of sound production, said aspect responsive to an input from said electromagnetic radiation detector.

Another embodiment comprises a hyperacoustic musical instrument, said instrument for being used with physiphonic input media, said physiphonic input media being solid matter, said instrument including a user-interface medium, said user-interface medium comprising an article of footwear, said instrument further including a sound production section, said sound production section comprising a lower portion of said footwear, said lower portion being one of: a blade of a skate; a ski; a lower part of a shoe or boot or sandal, said sound production section for making sound in response to said instrument having contact with a surface, said surface being one of frozen water or ice or a surface of ground, said sound production section producing one or more of: sound in the form of subsonic vibrations; sound in the form of seismic disturbances; sound in the form of scraping or banging or impact, said musical instrument including at least one sensor, said sensor being one of a microphone; contact microphone; geophone; pressure sensor; force sensor; disturbance sensor, said instrument further including a processor, said processor having an input responsive to a signal from said sensor, said instrument further including one or more output devices responsive to an input from said processor.

Another embodiment comprises the hyperacoustic musical instrument where said processor includes a frequency shifter with a frequency selectable by way of a hand-held keypad.

Another embodiment comprises this skates-based or footwear based hyperacoustic musical instrument where said processor includes a bandpass filter with a frequency selectable by way of a hand-held keypad.

Another embodiment comprises an instrument, said instrument for being used with one or more pieces or containers or regions of water flow input media, said one or more pieces or containers or regions of water flow input media each forming a laminar water jet each emerging from a hole, said instrument further including:

one or more optical pickups, each arranged for conversion of one of (a) an optical disturbance, or, or (b) a vibrational disturbance in each of said one or more pieces or containers or regions of water flow from each of said one or more laminar water jets;

one or more filters, each connected to an output of each of said pickups, said filters each filtering said disturbance into a signal comprising one note of a musical scale, with a one-to-one correspondence between said pieces or containers or regions of water flow input media, and said notes of said musical scale;

one or more output devices for converting said signals into sound.

From the foregoing description, it will thus be evident that the present invention provides a design for a musical instrument or other highly expressive input device. As various changes can be made in the above embodiments and operating methods without departing from the spirit or scope of the invention, it is intended that all matter contained in the above description or shown in the accompanying drawings should be interpreted as illustrative and not in a limiting sense.

Variations or modifications to the design and construction of this invention, within the scope of the invention, may occur to those skilled in the art upon reviewing the disclosure herein. Such variations or modifications, if within the spirit of this invention, are intended to be encompassed within the scope of any claims to patent protection issuing upon this invention.

What I claim is:

1. An instrument, said instrument for being used with a plurality of pieces or containers or regions of user interface input fluid, said pieces or containers or regions of fluid for direct physical contact by a user of said instrument, said instrument comprising:

a plurality of pickups, each arranged for conversion of one of (a) an acoustic disturbance, or (b) a vibrational disturbance, or (c) a pressure or flow disturbance in each of said pieces or containers or regions of input fluid;

an electric circuit connected to an output of each of said pickups, said electric circuits each altering said disturbance into a signal comprising one note of a musical scale, with a one-to-one correspondence between said pieces or containers or regions of input fluid, and said notes of said musical scale; and one or more output devices for converting said signals into sound;

said instrument further including a housing, a plurality of flow channels, each flow channel having an output adapted to permit the fluid to flow therefrom and be selectively obstructed by a user to reduce or alter the flow therefrom, wherein each pickup is positioned to sense the reduction or alteration in the flow therefrom, where each of said pickups is connected to one of the electric circuits, said instrument further including at least one audio output from said electric circuits, and each of said electric circuits including an amplitude inverter wherein the pickup receives a linearly varying signal that has a maximum amplitude value when the user is not in contact to the medium and a minimum amplitude value or off value when the user is fully interacting with the media and intermediate values there between and the amplitude inverter calculates an output value to produce an output signal that is inversely correlated to its input, and wherein the output signal of each amplitude inverter controls a musical note amplitude varying from an off or minimum level to a maximum level in correspondence to the output signal.

2. The instrument of claim 1, where each of said electric circuits include a frequency shifter.

3. The instrument of claim 1, where said electric circuits comprise a shifterbank.

4. The instrument of claim 1, where said pieces or containers or regions of input fluid are water spray jets, and each of said electric circuits includes an oscillator, and a pickup input that modulates the amplitude of the oscillator, wherein the frequency of each oscillator is a note on a musical scale.

5. The instrument of claim 1, further including a fluid connection having a side-discharge, said side-discharge spraying an amount of fluid proportional to a blockage of said finger hole, said pickup arranged to pickup said disturbance from said side-discharge.

6. A controller for the instrument of claim 1, said controller including a valve, a source of electromagnetic radiation, and an electromagnetic radiation detector, one of said source and detector being on, in, or near an input side of said valve, and the other of said source and detector being on, in, or near an output side of said valve, said musical instrument having means for adjusting at least one aspect of sound production, said aspect responsive to an input from said electromagnetic radiation detector.

7. An instrument of claim 1, said instrument including a signal processor for said instrument, said signal processor for being used with input signals from said plurality of pickups, each of said pickups for use with said plurality of pieces or containers or areas of physical input media, said signal processor comprising:

a plurality of signal inputs, one signal input for each of said pickups;

a plurality of oscillators, each oscillator tuned to one note of a musical scale; and one or more output devices for converting output of said oscillators into audible sound; said processor responsive to input from each of said plurality of signal inputs, said oscillators each responsive to an output of said processor, said oscillators adjusted in an essentially continuous fashion, the amplitude of each of said oscillators being proportional to the input level of each corresponding signal input.

8. The signal processor of claim 7 where each oscillator is assigned to one channel of a MIDI device, and said processor issues MIDI channel volume control commands in response to changes in said signal input.

9. An instrument, said instrument for being used with a plurality of pieces or containers or regions of user interface input media, said pieces or containers or regions of media for direct physical contact by a user of said instrument, said instrument comprising:

a plurality of pickups, each arranged for being responsive to an out of audible range vibration signal of one of (a) an acoustic disturbance, or (b) a vibrational disturbance, or (c) a pressure or flow disturbance in each of said pieces or containers or regions of input media;

a non-synthesizing frequency-shifter connected to an output of each of said pickups configured to perform a frequency shift of said signal, said frequency-shifters each shifting said disturbance signal into a signal comprising one audible note of a musical scale, with a one-to-one correspondence between said pieces or containers or regions of input media, and said notes of said musical scale; and one or more output devices for converting said signals into sound.

10. The instrument of claim 9, where each of said frequency-shifters is implemented as one of: a convolution in the time domain; or a multiplication in the frequency domain.

11. The instrument of claim 9, where said frequency-shifters form a shifterbank.

12. The instrument of claim 9, said input media being water, said one or more pieces or containers or regions of water each forming a laminar water jet each emerging from a hole, said plurality of pickups each being an optical pickup, in each of said one or more pieces or containers or regions of water flow from each of said one or more laminar water jets.

13. An instrument, said instrument for being used with a plurality of pieces or containers or regions of user interface input media, said pieces or containers or regions of media for direct physical contact by a user of said instrument, said instrument comprising: a plurality of electrical pickups, each responsive to one of (a) an acoustic disturbance, or (b) a vibrational disturbance, or (c) a pressure or flow disturbance in each of said pieces or containers or regions of input media, each of said pickups connected to an amplitude inverter, wherein the pickup receives a linearly varying signal that has a maximum amplitude value when the user is not in contact to the medium and a minimum amplitude value or off value when the user is fully interacting with the media and intermediate values there between and the amplitude inverter calculates an output value to produce an output signal that is inversely correlated to its input, and wherein the output signal of each amplitude inverter controls an effect amplitude varying from an off or minimum level to a maximum level in correspondence to the output signal.

* * * * *